US006523330B1

(12) United States Patent
Hurd

(10) Patent No.: US 6,523,330 B1
(45) Date of Patent: Feb. 25, 2003

(54) METHOD AND APPARATUS FOR CAPPING, EVACUATING AND FOLDING COLLAPSIBLE PLASTIC CONTAINERS

(75) Inventor: Frederick E. Hurd, Toronto (CA)

(73) Assignee: In-Flo Liquid Dispensing Corporation, Markham (CA)

( * ) Notice: Subject to any disclaimer, the term of this patent is extended or adjusted under 35 U.S.C. 154(b) by 0 days.

(21) Appl. No.: 09/807,330

(22) PCT Filed: Oct. 13, 1998

(86) PCT No.: PCT/CA98/00957

§ 371 (c)(1),
(2), (4) Date: Apr. 12, 2001

(87) PCT Pub. No.: WO00/21837

PCT Pub. Date: Apr. 20, 2000

(51) Int. Cl.[7] ..... B65B 31/04

(52) U.S. Cl. ..... 53/405; 53/432; 53/438; 53/448; 53/486; 53/79; 53/510; 53/529; 53/540; 53/289

(58) Field of Search ..... 53/403, 405, 432, 53/433, 448, 485, 486, 507, 510, 511, 540, 289, 467, 267, 268, 79, 438, 529; 414/797.8, 795.6, 796.4

(56) References Cited

U.S. PATENT DOCUMENTS

| | | | | | |
|---|---|---|---|---|---|
| 3,578,038 | A | * | 5/1971 | Burford | 141/114 |
| 3,619,974 | A | * | 11/1971 | Kupcikevicius | 53/512 |
| 3,674,060 | A | * | 7/1972 | Ruekberg | 141/114 |
| 3,727,803 | A | * | 4/1973 | Cobb | 222/215 |
| 4,158,376 | A | * | 6/1979 | Erb | 220/666 |
| 4,397,132 | A | * | 8/1983 | Pardes et al. | 53/470 |
| 4,807,425 | A | * | 2/1989 | Abrams | 53/381.4 |
| 4,815,256 | A | | 3/1989 | Brown | |
| 4,919,309 | A | * | 4/1990 | Arona-Delonghi | 222/153.02 |
| 5,024,354 | A | * | 6/1991 | Ledewitz | 222/107 |
| 5,080,260 | A | * | 1/1992 | During | 222/107 |
| 5,269,427 | A | | 12/1993 | Hurd | |
| 5,330,317 | A | * | 7/1994 | Akimoto et al. | 414/795.6 |
| 5,528,833 | A | | 6/1996 | Jamison | |
| 5,588,472 | A | * | 12/1996 | Johnson | 141/20 |
| 6,418,701 | B1 | * | 7/2002 | Navarro | 221/223 |

* cited by examiner

*Primary Examiner*—Rinaldi I. Rada
*Assistant Examiner*—Paul Durand
(74) *Attorney, Agent, or Firm*—Patrick J. Hofbauer

(57) ABSTRACT

A method and apparatus for automated leak testing, capping, labelling, evacuating and loading collapsible plastic containers in bulk into magazine clips for subsequent handling operations is provided. The apparatus is compact and intergrated, defining discrete stations for each stated method step.

25 Claims, 57 Drawing Sheets

METHOD AND APPARATUS FOR CAPPING, EVACUATING AND FOLDING COLLAPSIBLE PLASTIC CONTAINERS

FIELD OF THE INVENTION

The present invention relates generally to the field of handling systems for collapsible plastic containers, such as bottles, and in particular to an automated method of capping, leak testing, labelling, evacuating and packing collapsible plastic containers in bulk into magazine clips for subsequent handling operations, and to a compact, integrated apparatus for carrying out such a method.

BACKGROUND OF THE INVENTION

In an earlier issued U.S. Pat. No. 5,269,427, there is disclosed a collapsible plastic container having a collapsible body portion and a non-collapsible neck portion defining an opening into the plastic container. The non-collapsible neck portion preferably defines two indexing flats arranged in parallel orientation to one another on diametrically opposed outer sides of the non-collapsible neck portion. The indexing flats preferably extend longitudinally between a spaced pair of annular tables arranged in opposed encircling relation to one another around the outside of the neck portion. This arrangement forms a waisted portion on the non-collapsible neck portion which adapts the neck portion to be received in register with corresponding portions of mechanical means for selectively positioning the container in predetermined radial alignment relative to the mechanical means during various mechanical handling and processing operations. An example of one form of such handling means is a bulk filling station for filling and dispensing collapsible plastic containers as shown and described in U.S. Pat. No. 4,815,256 (Brown et al.). This arrangement also beneficially adapts containers having such a waisted neck portion to be used in conjunction with a magazine clip means, such as that disclosed in detail in U.S. Pat. No. 5,269,427. Such a magazine clip means has a longitudinal body portion adapted to receive a plurality of the containers in supported, intermitting, releasably slidable relation with the respective waisted portions of the container necks. Moreover, the body portion of the magazine clip means is operable to direct delivery of succeeding ones of the containers longitudinally to at least one discharge opening of the body portion. In this manner, the magazine clip means is adapted to receive a plurality of the collapsible containers for collective storage, handling, shipping distribution and merchandising in a particularly compact and economical manner, without the need for re-packaging during any of these phases. Moreover, the magazine clip means can be readily used to collectively load the plurality of containers held there within into automated handling and processing equipment adapted to accept such clips without the need to individually handle the containers.

Lastly, the magazine clips are preferably constructed from plastic or cardboard to facilitate re-use, or recycling, thereof. The advantages of utilizing such magazine clips of collapsible plastic containers are numerous and well-documented in, inter alia, U.S. Pat. No. 4,815,256 and in U.S. Pat. No. 5,269,427. The present invention relates to a compactly designed high speed packaging integrator that can be located at the manufacturing level for labelling, capping, evacuating, folding and placement of collapsible plastic containers into a magazine clip, without the need for trans-packaging or shipping of the empty containers between manufacturing, packaging, and labelling sites. Moreover, a plurality of the collapsible plastic containers, still loaded in the magazine clips, can be transferred directly into a point-of-sale filler/merchandiser, such as that disclosed in U.S. Pat. No. 4,815,256. The economies realized in manufacturing facility space and time, storage and transportation costs, and retail point of sale space using the system of which the present invention is a part, are significant. More particularly, at the manufacturing facility level, it is in the prior art necessary to utilize separate automated process lines for each of the leak testing, labelling, capping and filling processes, which lines are often linear, or near linear, in their layout, and are often arranged at separate plant locations. This arrangement is not only wasteful of valuable factory floor space, but may also engender significant additional handling costs and delays as the containers are moved from one process line to the other for completion of the next process step. Additionally, as the several process steps typically occur at different speeds, stockpiling or warehousing space may be necessary between the various process steps to hold inventories of containers from the previous process step for subsequent next-step processing. All of the factors add to the inefficiencies, delays and associated costs associated with prior art container is handling systems and devices.

It is, therefore, an object of the present invention to provide a method for machine packing a plurality of collapsible plastic containers into a magazine clip means for subsequent handling of the containers, which method provides, in a preferred embodiment, for leak testing, capping, labelling, evacuation and folding of the containers prior to loading into the magazine clip, all of said process steps being carried out in seriatim as part of an integrated process without the need for intervening handling of the containers.

It is a further object of the present invention to provide a method for machine packing a plurality of collapsible plastic containers into a magazine clip means for subsequent handling of the containers, which method utilizes minimal factory floor space to carry out the method.

It is a further object of the present invention to provide a method for machine packing a plurality of collapsible plastic containers into a magazine clip means for subsequent handling of the containers, which method obviates the need for warehousing or inventorying of containers between sub-steps of the method.

It is yet a further object of the present invention to provide a method for machine packing a plurality of collapsible plastic containers into a magazine clip means for subsequent handling of the containers, which method is fast, efficient and economical, as compared to the prior art.

It is a further object of the present invention to provide an apparatus for machine packing a plurality of collapsible plastic containers into a magazine clip means for subsequent handling of the containers, which apparatus provides means for leak testing, capping, labelling, evacuation and folding of the containers prior to loading into the magazine clip, all of said means being provided as part of an integrated apparatus, which apparatus obviates the meed for intervening human handling of the containers between stations of the apparatus.

It is another object of the present invention to provide an apparatus for machine packing a plurality of collapsible plastic containers into a magazine clip means for subsequent handling of the containers, which apparatus provides means for leak testing, capping, labelling, evacuation and folding of the containers prior to loading into the magazine clip, all of said means being provided as part of an integrated apparatus, which apparatus is compactly sized to minimize the factory floor space which it utilizes.

It is a further object of the present invention to provide an apparatus for machine packing a plurality of collapsible plastic containers into a magazine clip means for subsequent handling of the containers, which apparatus obviates the need for warehousing or inventorying of containers between stations of the apparatus.

It is yet a further object of the present invention to provide an apparatus for machine packing a plurality of collapsible plastic containers into a magazine clip means for subsequent handling of the containers which apparatus is fast, efficient and economical, as compared to equipment utilized in the prior art.

SUMMARY OF THE INVENTION

In accordance with the present invention there is disclosed a process for machine packing a plurality of collapsible plastic containers into a magazine clip means for subsequent handling of the collapsible plastic containers, each collapsible plastic container having a collapsible body portion and a non-collapsible neck portion defining an opening to the collapsible plastic container. The process comprises, in order, the steps of: mechanically selecting one of said collapsible plastic containers from a serially arranged row of said plurality of containers by gripping said first collapsible plastic container about said neck portion; mechanically translating said selected collapsible plastic container to a predetermined capping station; at said capping station, mechanically applying to the neck portion of the selected collapsible plastic container, in closed, sealing relation to said opening of the collapsible plastic container, a closure cap having a rim portion and a lid portion connected to the rim portion by a hinge means; mechanically translating said select collapsible plastic container to a predetermined collapsing station; adjacent said collapsing station mechanically opening the lid portion of said closure cap to break said sealing relation to said opening of the collapsible plastic container by hinged movement in a first direction of the lid potion about said hinge means; at said collapsing station, mechanically removing a substantial portion of the volume of air from within the selected collapsible plastic container so as to cause substantial collapse of the body portion of said selected collapsible plastic container at said collapsing station; at said collapsing station, mechanically closing the lid portion of said closure cap to re-establish said sealing relation with said opening of the selected collapsible plastic container by hinged movement of the lid portion in a second direction opposed to said first direction about said hinge means, mechanically translating said selected collapsible plastic container to a predetermined magazine loading station; and, at said magazine loading station, mechanically loading said selected collapsible plastic container into said magazine clip means so as to hold said selected collapsible plastic container within said clip means by way of frictional interaction between said non-collapsible neck portion and said magazine clip means.

In accordance with another aspect of the present invention, there is further provided, before the step of mechanically translating the selected container to the capping station, the further steps of, mechanically translating the selected plastic container to a predetermined leak testing station; at the leak testing station, mechanically pressurizing the plastic container with a pressurized fluid, such as air. After such pressurizing takes place,. mechanically measuring the retention of the pressurized fluid within the selected collapsible plastic container over a predetermined period of time and comparing the retention value so obtained with a predetermined threshold value; and, before the step of mechanically loading the selected collapsible plastic container into the magazine clip, mechanically ejecting from the process each selected collapsible plastic container having a retention value less than the predetermined threshold value.

In accordance with another aspect of the present invention, there is further provided, after processing of the selected collapsible plastic container at the leak testing station, as previously outlined, but before translation to the selected container to the capping station, the further steps of; mechanically translating the selected collapsible plastic container to a predetermined labelling station; at said labelling station, mechanically pressurizing the selected collapsible plastic container with a fluid, such as air, so as to cause the collapsible body portion to become distended; and, while the collapsible body portion is so distended, mechanically applying a self-adhesive label to said body portion.

In accordance with another aspect of the present invention there is disclosed an apparatus for machine packing a plurality of collapsible plastic containers into a magazine clip means for subsequent handing of the collapsible plastic containers. Each of the collapsible plastic containers has a collapsible body portion and a non-collapsible neck portion defining an opening to the collapsible plastic container. The apparatus according to this aspect has a selection means for selecting one of the collapsible plastic containers from a serially arranged row of similar collapsible plastic containers by gripping the selected collapsible plastic container about the neck portion. Once gripped in this manner, the selection means transfers the selected collapsible plastic container to a transfer station, at which transfer station a translation means receives the selected container in retained relation about the neck portion. Thereafter, the translation means translates the selected container, in serially indexed relation, to each of a capping station, a collapsing station and a magazine loading station, which stations form part of the apparatus. A capping means is positioned at the capping station for applying to the neck portion of the selected collapsible plastic container, in closed, sealing relation to the opening of the collapsible plastic container, a closure cap having a rim portion and a lid portion connected to the rim portion by a hinge means. A cap opening means is positioned between the capping station and the collapsing station for opening of the hinged lid portion of the closure cap in a first direction, thereby breaking the sealed relation of the closure cap to the opening of the selected collapsible plastic container. A collapsing means is positioned at the collapsing station for removing a substantial portion of the volume of air from within the selected collapsible plastic container, thereby causing substantial collapse of the body portion of the selected collapsible plastic container at the collapsing station. A cap closing means is positioned at the collapsing station for closing the lid portion of the closure cap by hinged movement of the lid portion in a second direction opposed to the first direction, thereby re-establishing sealing relation between the closure cap and the opening of the selected collapsible plastic container. A loading means is positioned at the magazine loading station for translating the selected collapsible plastic container from the translation means into the magazine clip means so as to hold the selected collapsible plastic container within the clip means by way of frictional interaction between the non-collapsible neck portion and magazine clip means.

In accordance with another aspect of the present invention, the translation means of the apparatus comprises a carousel means adapted for accepting the selected collapsible plastic container at the transfer station as aforesaid in radially indexed, retained relation about its neck portion, and for translating the selected collapsible plastic container in serially indexed rotary relation to each of the capping, collapsing and magazine loading stations.

In accordance with yet another aspect of the present invention, the carousel means translates the selected container in serially indexed rotary relation to each of a leak testing station, the capping station, the collapsing station and the magazine loading station, and wherein the apparatus additionally comprises: at said leak testing station a first pressurizing means for pressurizing the selected collapsible plastic container with a fluid, such as air, and a leak testing means for measuring the retention of the pressurized fluid within the selected collapsible plastic container over a predetermined period of time and for comparing the retention value so obtained with a predetermined threshold retention value so as to permit identification of the selected container as a leaking container, if the retention value so measured is less than the threshold value. Ejection means are also preferably provided for ejecting from the carousel means each of the plastic containers that are so identified as a leaking container.

According to yet another aspect of the present invention, the carousel means additionally translates the selected container in serially indexed rotary relation to each of the leak testing station, a labelling station, the capping station, the collapsing station and the magazine loading station, and the apparatus additionally comprises, at the labelling station, a second pressurizing means for pressurizing the selected collapsible plastic container with a fluid, such as air, so as to cause the collapsible body portion to become distended, and a label applicator means for applying an adhesive label to the body portion of the selected collapsible plastic container when so distended.

According to yet another aspect of the present invention, a folding means is provided adjacent to the magazine loading station for folding the collapsible body portion of each selected collapsible plastic container held within the magazine clip about an axis transverse to the longitudinal axis of the selected container, thereby shortening the effective longitudinal length of each selected collapsible plastic container projecting from the magazine clip.

According to yet another aspect of the present invention, a transport means is also provided adjacent the magazine loading station for transporting the selected collapsible plastic container held within the magazine clip in a direction parallel to the longitudinal axis of the magazine clip from an initial loaded position within the magazine clip, which initial loaded position is proximal to the magazine loading station, to a final loaded position within the magazine clip, which final loaded position is distal to the magazine loading station.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which are briefly described herein below.

BRIEF DESCRIPTION OF THE DRAWINGS

FIG. 6*l* is a side elevational view along sight line 61—61 of FIG. 6*k;*

FIG. 9*a*' is a simplified diagrammatic perspective view (not to scale) of the bracketed area 9*a*' of FIG. 9*a;*

DETAILED DESCRIPTION OF A PREFERRED EMBODIMENT

Figure 1A:
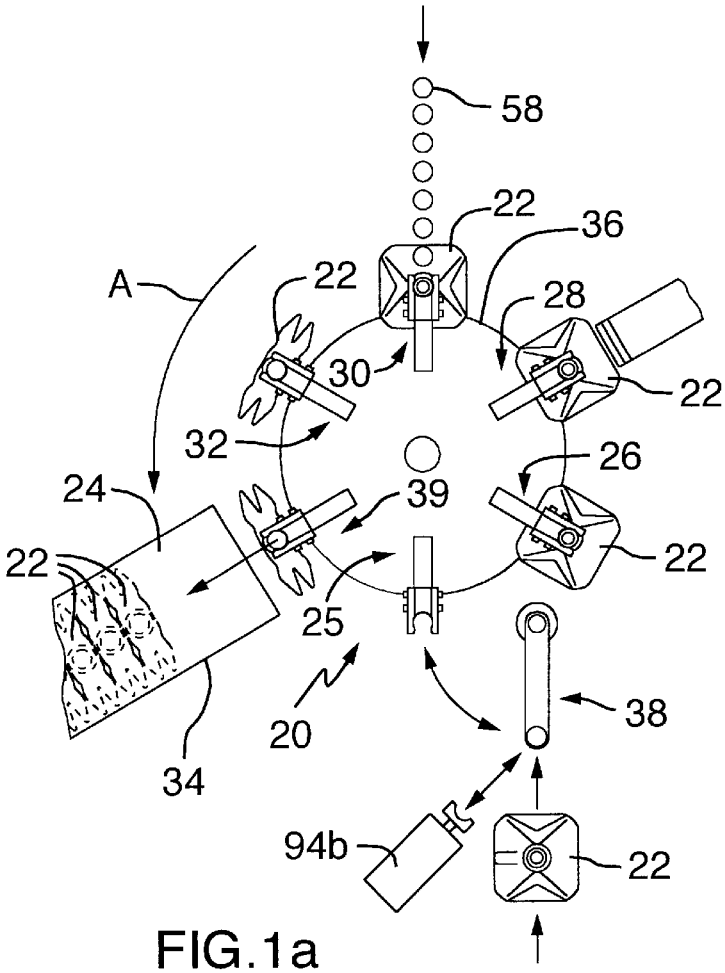
FIG. 1*a* is a top plan schematic view showing, in simplified diagrammatic form, the various stations of an apparatus according to the invention, which apparatus performs the steps of a preferred method according to the invention.

Referring now to FIG. 1*a* of the drawings there will be seen a schematic top plan view which illustrates, in simplified diagrammatic form, the various stations of a preferred embodiment of apparatus according to the invention, which preferred embodiment performs the steps of a preferred method according to the invention. More particularly, there is shown a six station apparatus, designated by the general reference numeral 20, for machine packing a plurality of collapsible plastic containers 22 into a magazine clip means 24 for subsequent handling of the collapsible plastic containers 22 en masse while still loaded within the magazine clip means 24, or individually as they are removed in seriatim from the magazine clip means 24, such as is disclosed in detail in U.S. Pat. Nos. 5,269,427 and 4,815,256. The six stations are: 1) a transfer station 25; 2) a leak testing station 26; 3) a labelling station 28; 4) a capping station 30; 5) a collapsing station 32; and, 6) a magazine loading station 34. Each collapsible plastic container 22 is introduced by a selection means 38 into a rotatable carousel means 36 at the transfer station 25, which carousel means thereafter turns in a radially indexed manner (in the clockwise direction of arrow A of FIG. 1*a*) to carry each collapsible plastic container 22 in a stepped manner from station to station. At each station, one or more method steps of the invention are carried out on the particular collapsible plastic container 22 then positioned at that station, such that each collapsible plastic container 22 is eventually loaded in a capped, collapsed configuration into the magazine clip means 24 at the magazine loading station 34. Accordingly, each complete rotation of the carousel means 36 results, on a continuous basis, in one collapsible plastic container 22 being loaded into the magazine clip means 24 at the magazine loading station 34, as another collapsible plastic container 22 is being loaded into the carousel means 36 at the transfer station 25. Thus, the process of the invention is substantially continuous, with one collapsible plastic container 22 being processed per revolution of the carousel mean 36. This arrangement makes the apparatus 20 extremely compact and easy to fit into existing blow moulding plants or similar installations. The apparatus 20 illustrated and described in detail herein is considered a single cavity machine, since only one collapsible plastic container 22 is being process per station. However, it will be appreciated by those skilled in the art that the apparatus described and claimed herein can be readily adapted by the exercise of routine skill to provide for a multiple cavity type of apparatus that simultaneously processes a plurality of plastic containers 22 at each station, such that each revolution of the carousel means 36 results in an equal plurality of collapsible plastic containers 22 being loaded into one or more magazine means 24 positioned adjacent to the magazine loading station 34. Such a multiple cavity machine is not, for ease of illustration, specifically described herein, although it is specifically within the spirit and scope of the invention disclosed and claimed herein.

Figure 1B:
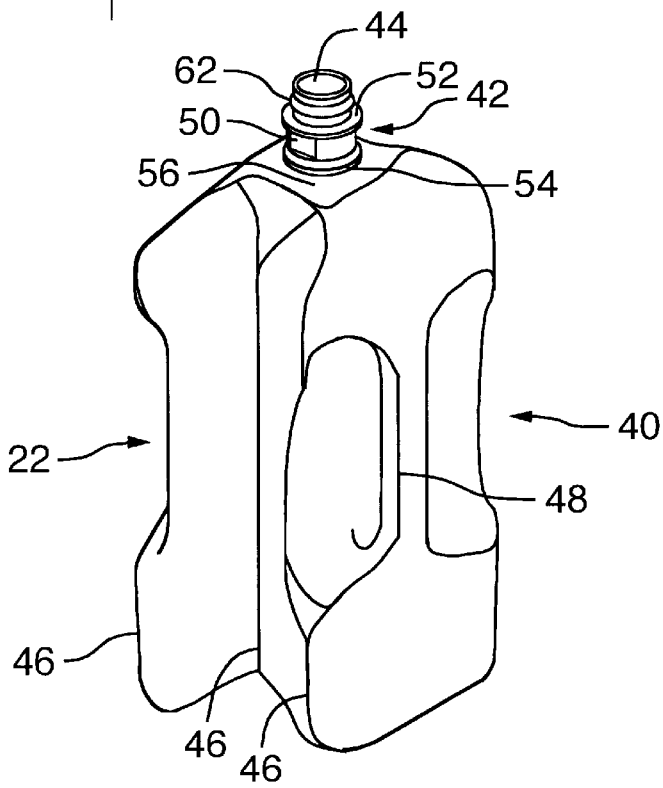
FIG. 1*b* is a perspective view from the top and side of an exemplary collapsible plastic container, without a closure cap applied, for use with the apparatus of FIG. 1*c* and method of the present invention.
Figure 1C:
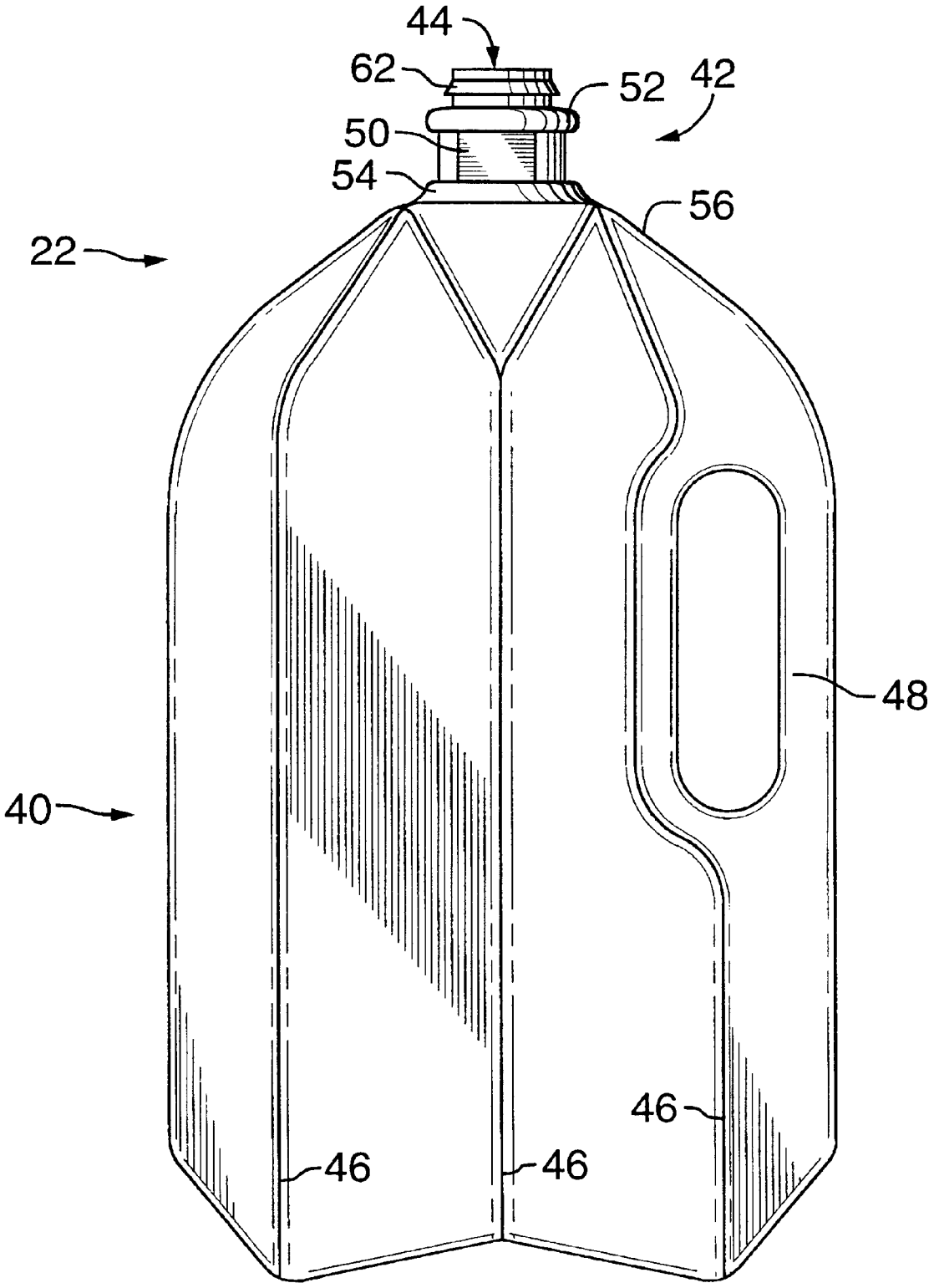
FIG. 1*c* is a perspective view from the side of an exemplary collapsible plastic container for use with the apparatus of FIG. 1*a*.
Figure 1D:
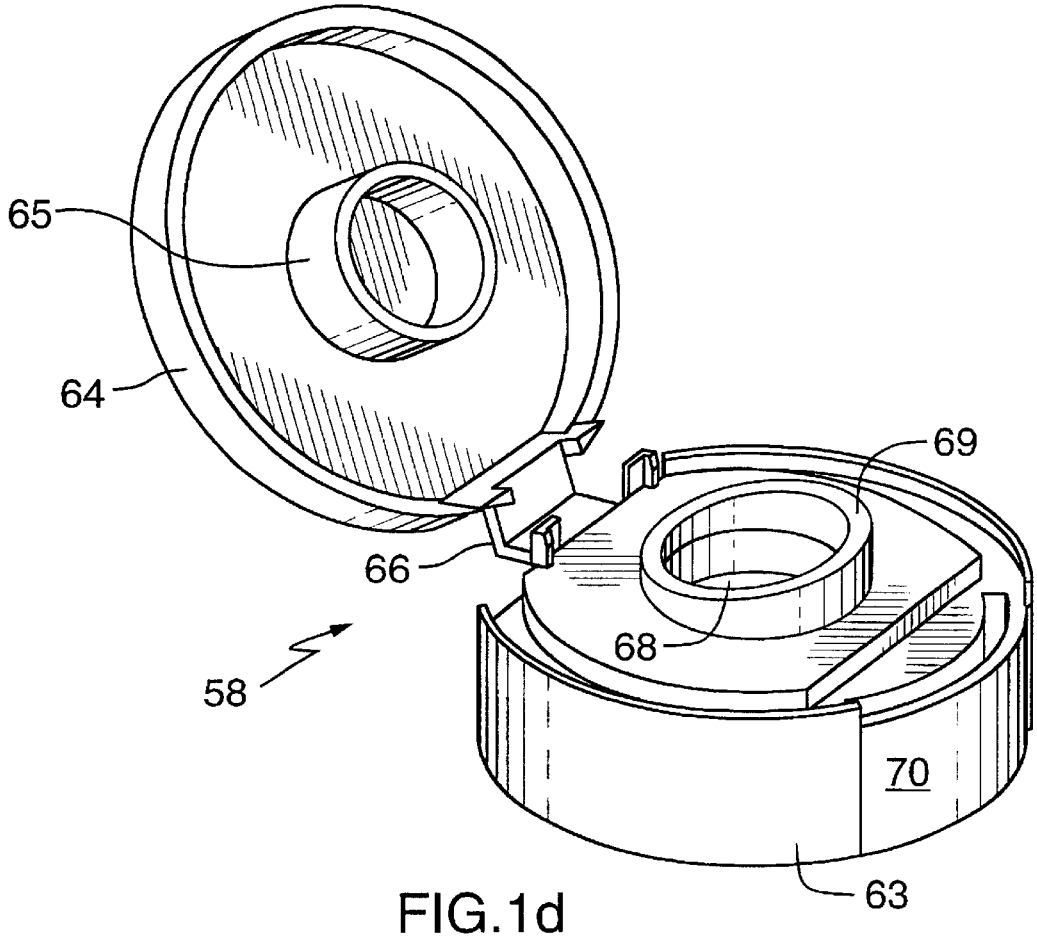
FIG. 1*d* is a perspective view of the closure cap for sealing the collapsible plastic container of FIG. 1*b,* said closure cap being illustrated in the fully opened position.
Figure 1E:
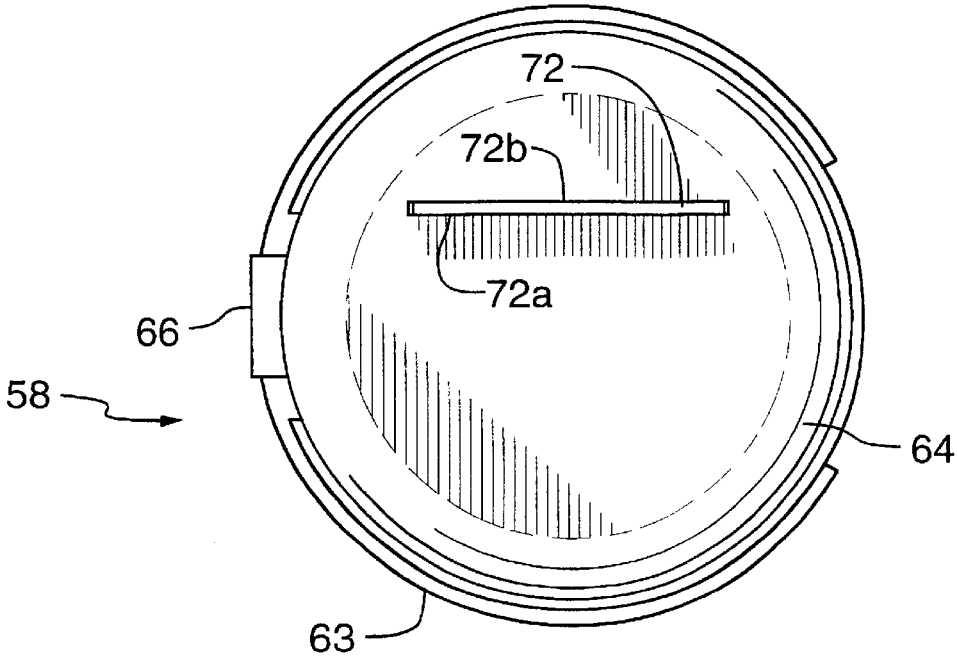
FIG. 1*e* is a plan view of the closure cap in sealing engagement with the collapsible plastic container of FIG. 1*b.*

Turning to FIG. 1*b,* there will be seen an exemplary form of collapsible plastic container 22 for use with the apparatus and method according to the invention. Suitable forms of collapsible plastic containers 22 are already known in the prior art, and one such container is described in detail in U.S. Pat. No. 5,269,427. Such collapsible plastic containers 22 each have a collapsible body portion, generally designated by the reference numeral 40, manufactured from thin plastic material, such as recyclable low density polyethylene, and are collapsible for storage or transport purposes, along hinge lines 46 integrally formed along side walls thereof. Each collapsible plastic container 22 also preferably includes a grasping means in the form of an integrally formed handle 48. A non-collapsible neck portion, designated by general reference numeral 42, is integrally formed of thicker plastics material atop the collapsible body portion 40. The neck portion 42 defines an opening 44 into the internal volume defined by the collapsible body portion 40 together with indexing means, comprising a pair of opposed flats 50, 50 arranged on the outer side surface of the neck portion 42. Although only one flat 50 is visible in FIG. 1*b,* collapsible plastic container 22 actually includes two such flats which are arranged on diametrically opposed outer sides of the non-collapsible neck portion 42, and are adapted to be received in register with corresponding portions of means for selectively positioning the container 22 in predetermined radial alignment relative thereto during handling operations of the container 22.

Figure 1F:
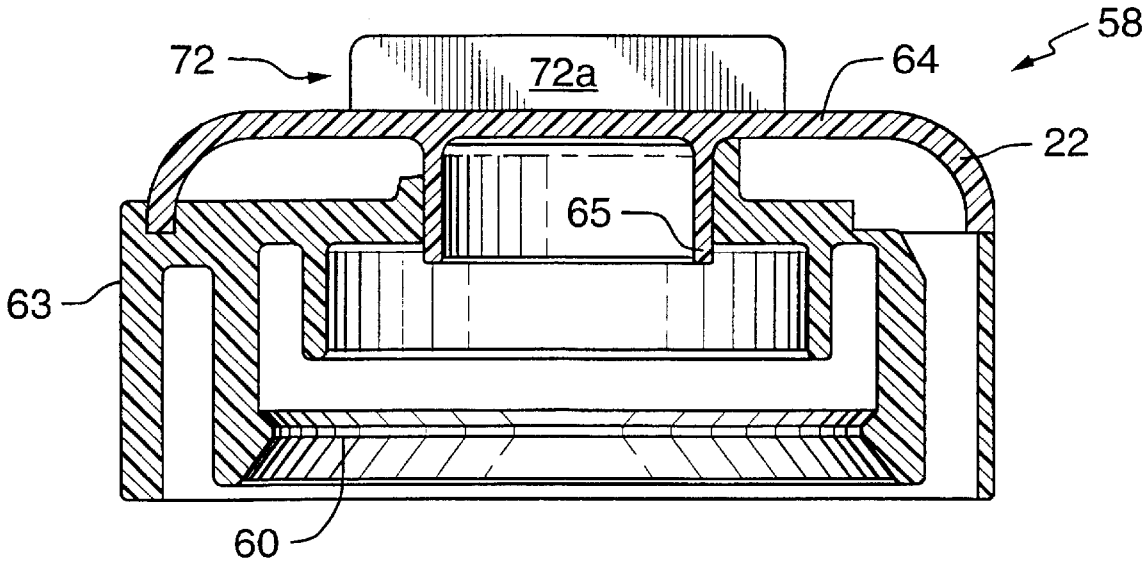
FIG. 1*f* is a side elevational view of the closure cap in sealing relation with the selected collapsible plastic container.

The non-collapsible neck portion 42 includes further indexing means comprising two annular rings 52 and 54, adapted to be secured in register with corresponding portions of means for selectively positioning the collapsible plastic container 22 in predetermined axial alignment thereto. Annular rings 52 and 54 are axially spaced apart from one another across the flats 50 and 50. Ring 54 comprises a raised portion of shoulder 56 of the collapsible plastic container 22. Ring 52 is arranged along non-collapsible neck portion 42 at an axial location immediately below a point where a lower annular edge 60 (see FIG. 1*f*) of a closure cap (designated by general reference numeral 58 in FIGS. 1*b* through 1*f*) is adapted to be positioned with the closure cap 58 secured in snap-on intermitting relation over annular rib 62. Ring 52 is sized to be at least generally radially coextensive with the closure cap 58 when the closure cap 58 is so secured.

The closure cap 58 is of a general type known in the prior art and described in detail in , inter alia, U.S. Pat. No. 5,269,427. For present purposes, it is sufficient to describe such type of closure cap as follows, with reference to FIGS. 1*d* through 1*f* of the drawings. Closure cap 58 includes a hinged lid portion 64 and an underlying rim portion 63 which attaches as aforesaid in sealed relation to the non-collapsible neck portion 42 of the plastic container 22. The hinged portion 64 is adapted to articulate with respect to the rim portion 63 about an integrally formed hinge means 66 between opened (See FIG. 1*d*) and closed (See FIGS. 1*e* and 1*f*) positions. In the open position, the closure cap 58 is adapted to pass materials through a central opening 68 defined by a raised spigot portion 69 defined on the rim portion 63. In the closed position, the plug member 65 seals the central opening 68. In this manner, closure cap 58 is adapted to be applied to the non-collapsible neck portion 42 in closed, sealing relation over the opening 44 of the plastic container 22. Closure caps of this general type can be constructed from recyclable low density polyethylene, or from high density polyethylene. Such a closure cap 58 may optionally have a pressure-sensitive area 70 on the rim portion 63, which area is adapted to act as a child-resistant feature by facilitating manual opening only of the lid portion 64 upon the application thereto of a radially inwardly directed compressive force of threshold magnitude. The preferred closure cap illustrated additionally comprises a cap indexing means, in the form of an upstanding elongated rib 72 having mutually opposed sides 72*a* and 72*b,* the rib 72 being arranged on the top surface of the lid portion of 64 in off-set relation to the centre of the lid portion 64. This allows the elongated rib 72 to be received in register with corresponding portions of the capping means of the apparatus 20, as described more fully below, so as to facilitate positioning of the closure cap 58 in predetermined radial alignment over a collapsible plastic container 22 at the capping station. Such alignment, in turn, permits mechanical application of the closure cap 58 onto the non-collapsible neck portion 42 of the collapsible plastic container 22 in corresponding indexed radial alignment, as will also be described in more detail below.

Turning to FIGS. 2 through 9*i,* a preferred embodiment 20 of apparatus according to the invention will now be described in detail, which apparatus 20 performs the preferred method according to the invention.

The collapsible plastic containers 22 are manually loaded onto a conventional conveyor means 74 from a blow moulding machine or the like (not shown). The conveyor 74 is numerically controlled by means of a conventional computer CPU means (not shown) as are all the automated components of the apparatus 20, and such computer CPU means will not be specifically detailed herein. The conveyor 74 comprises a belt 76, driven roller 78 and has guide rail s 80 associated therewith, to retain the collapsible plastic containers 22 thereon. The collapsible plastic containers 22 move under urging of the conveyor 74 in the direction of arrow "A" of FIG. 2*a*. Container spacing means 82 are provided to maintain the lead collapsible plastic container 22 at a predetermined spaced apart interval on said conveyor 74 from the serially arranged row of collapsible plastic containers 22 therebehind prior to axial orientation and to indexing by the selection means 38.

Having particular reference to FIGS. 2*a* through 2*e,* the container spacing means 82 provides a release gate member 84 which in use with the conveyor 74 operates to control movement of the conveyor belt 76 at timed intervals, whereby each successive collapsible plastic container 22 arrives at the selection means 38 as required. The release gate member 84 cooperates with a photoelectric cell 86 and sensor 88 to release a pair of holding rods 84*a*, 84*b* controlled by way of respective solenoid means 85*a*, 85*b*, with the photoelectric beam 92 being positioned to register the presence of each collapsible plastic container 22 as it interrupts the photoelectric beam 92 on its way to the section means 38. In operation, the conveyor 74, the container spacing means 82, the photoelectric cell 86, and the sensor 88, cooperate with each other and the computer CPU means (not shown) to transport each collapsible plastic container 22, in turn, into abutment against a stationary stop member 102 provided at the selection means 38. More particularly, there will be seen in FIGS. 2*b* and 2*c* a second one of the collapsible plastic containers 22 approaching the photoelectric beam 92 of the container spacing means 82, which is in its inactivated configuration, with the holding rods 84*a*, 84*b* each fully retracted by the respective solenoid means 85*a*, 85*b*. As the photoelectric beam 92 is broken by the leading edge of the second bottle 22, the solenoid means 85*a*, 85*b* are triggered through the computer CPU means (not shown) to be activated so as to cause sliding of the holding rods 84*a* and 84*b* in the direction of the arrows "A" and "B" of FIGS. 2*d* and 2*e* to the activated configuration of the container spacing means 82 shown in these latter two Figures, at which configuration the holding rods 84*a* and 84*b* frictionally restrain the second collapsible container 22 from further forward movement. When the second collapsible container 22 is required at the section means 38, the computer CPU means (not shown) will send an appropriate signal to the solenoid means 85*a*, 85*b* returning them to their original retracted positions to permit travel of the second container 22 along the conveyor belt 76.

Figure 3:
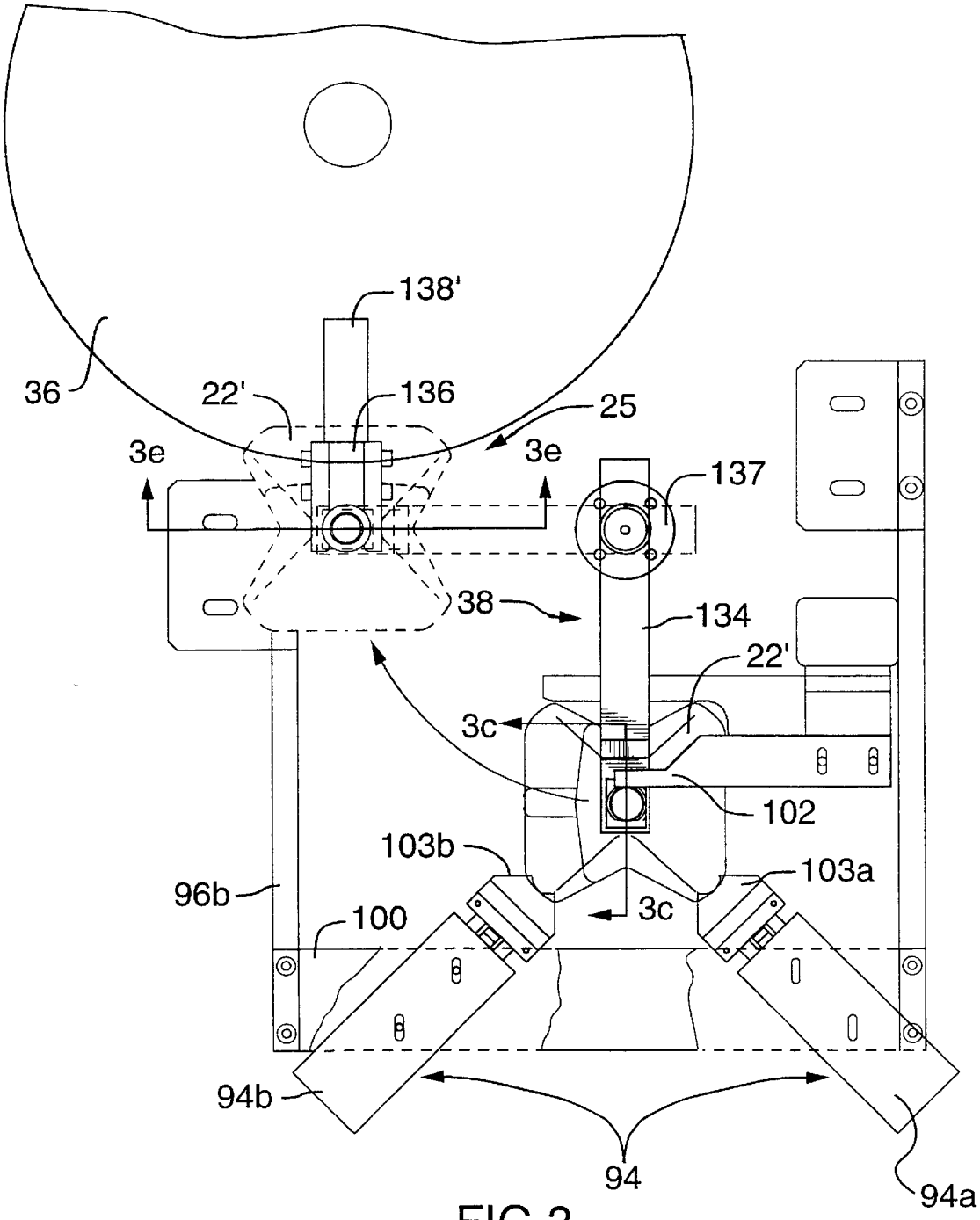
FIG. 3 is a top plan view of substantially the same portion of the apparatus shown in FIG. 2*a,* showing, in solid outline, the selection means selecting one of the plurality of collapsible plastic containers and, in phantom outline, the transfer of the collapsible plastic container so selected at the transfer station to the translation means.
Figure 3B:
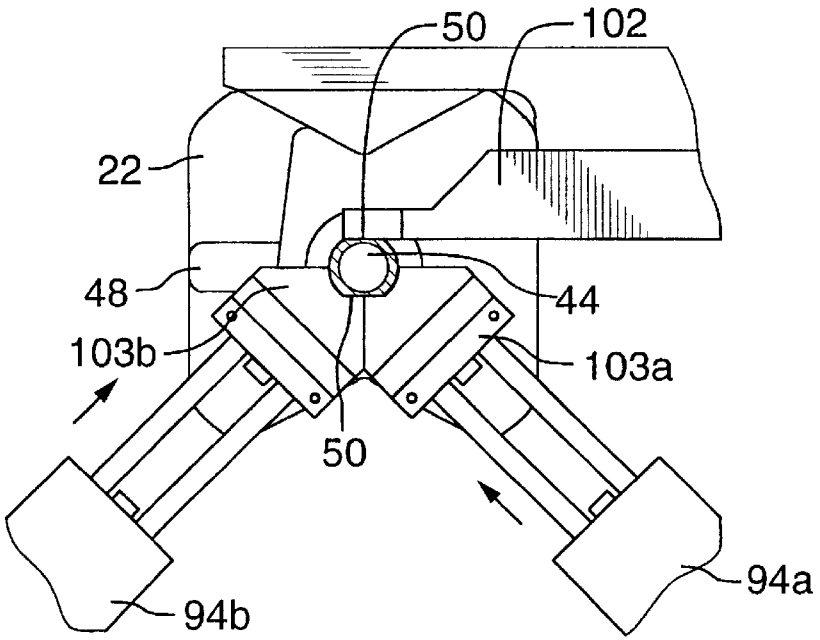
FIG. 3*b* is a view similar to FIG. 3*a* showing the axial orientation means in its operatively extended position.
Figure 3A:
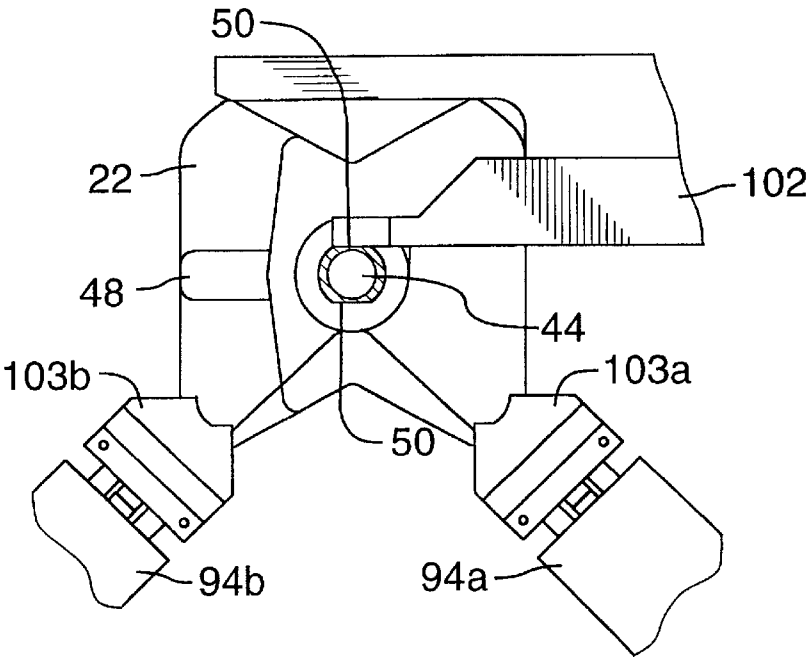
FIG. 3*a* is a view of a portion of FIG. 3 on a larger scale showing an axial orientation means in its operatively retracted position.

Preferably, prior to indexing the collapsible plastic container 22 at the selection means 38, axial orientation means 94 are activated to ensure the requisite operative registering of the collapsible plastic container 22 at the selection means 38. More specifically, the axial orientation means 94 comprises a pair of opposed, angularly disposed pneumatically actuated ram assemblies 94*a* and 94*b* mounted beneath a support frame 96. The support frame 96 defines a pair of downwardly extending spaced arm members 96*a* and 96*b* interconnected by means of a horizontally extending leg member 100. The dual ram assemblies 96*a* and 96*b* respectively define, at each of their outer ends, collapsible plastic container positioning members 103*a* and 103*b*, which members 103*a* and 103*b* are chamfered with such high tolerance so as to permit them to together positively engage one of the indexing flats 50 of the neck portion 42 of the collapsible plastic container 22, when both ram assemblies 96*a* and 96*b* are actuated form their operatively restricted positions (as seen in FIG. 3*a*) to their operatively extended positions, (as shown in FIG. 3*b*) under timed control of the computer CPU means (not shown). The opposite other flat 50 on the circumference of the non-collapsible neck position 42 abuts against the edge of the stationary stop means 102. Thus, the axial orientation means 94 and stationary stop member 102, which latter, engages the opposed indexing flat 50, function in combination to precisely axially index the collapsible plastic container 22 in a pick-up zone adjacent to the selection means 38.

Figure 2:
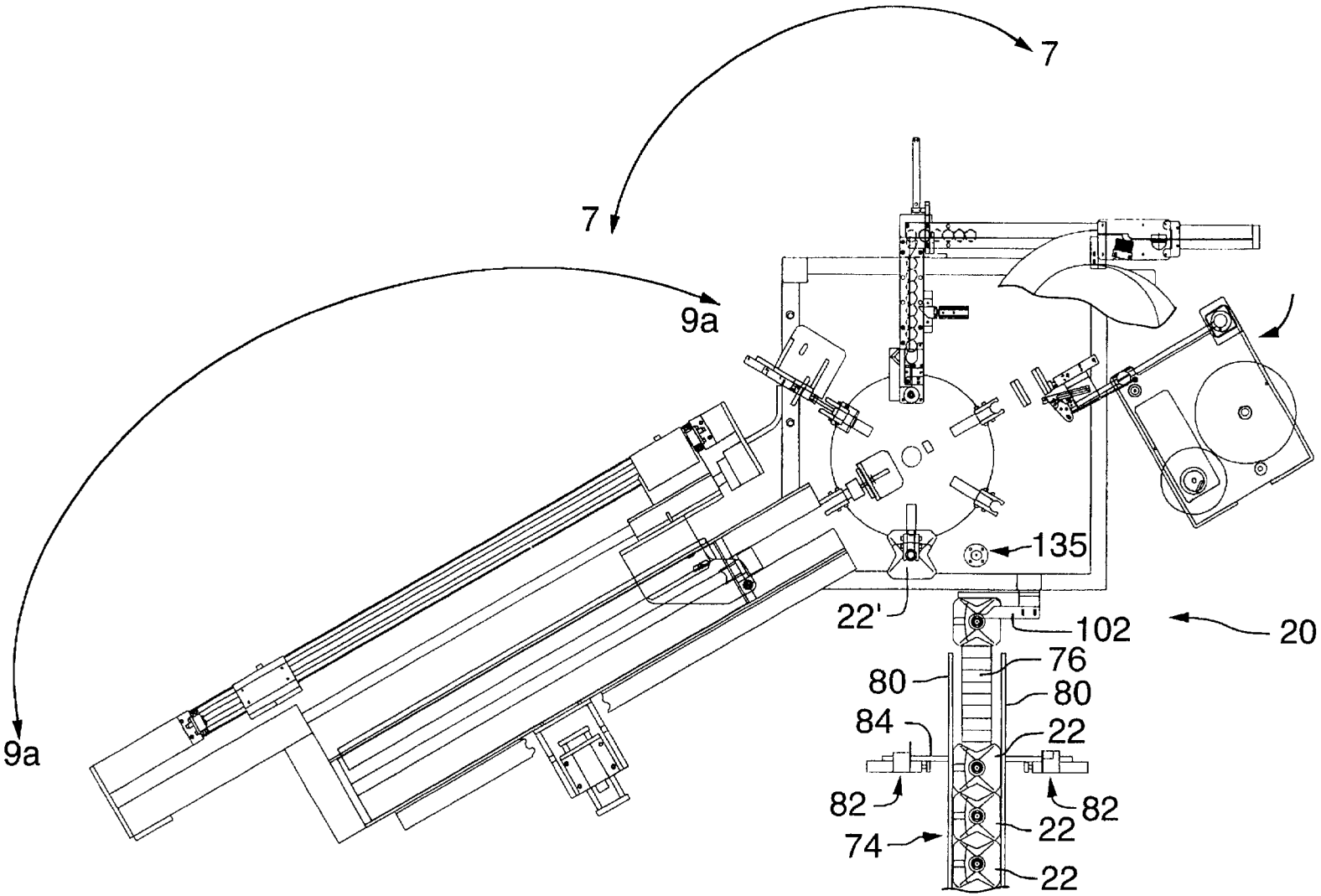
FIG. 2 is a partial top plan of a preferred embodiment of an apparatus for machine packing a plurality of collapsible plastic containers into a magazine clip means, which apparatus performs the preferred method according to the invention, with the capping means being partially omitted for ease of illustration of the label applicator means.
Figure 2A:
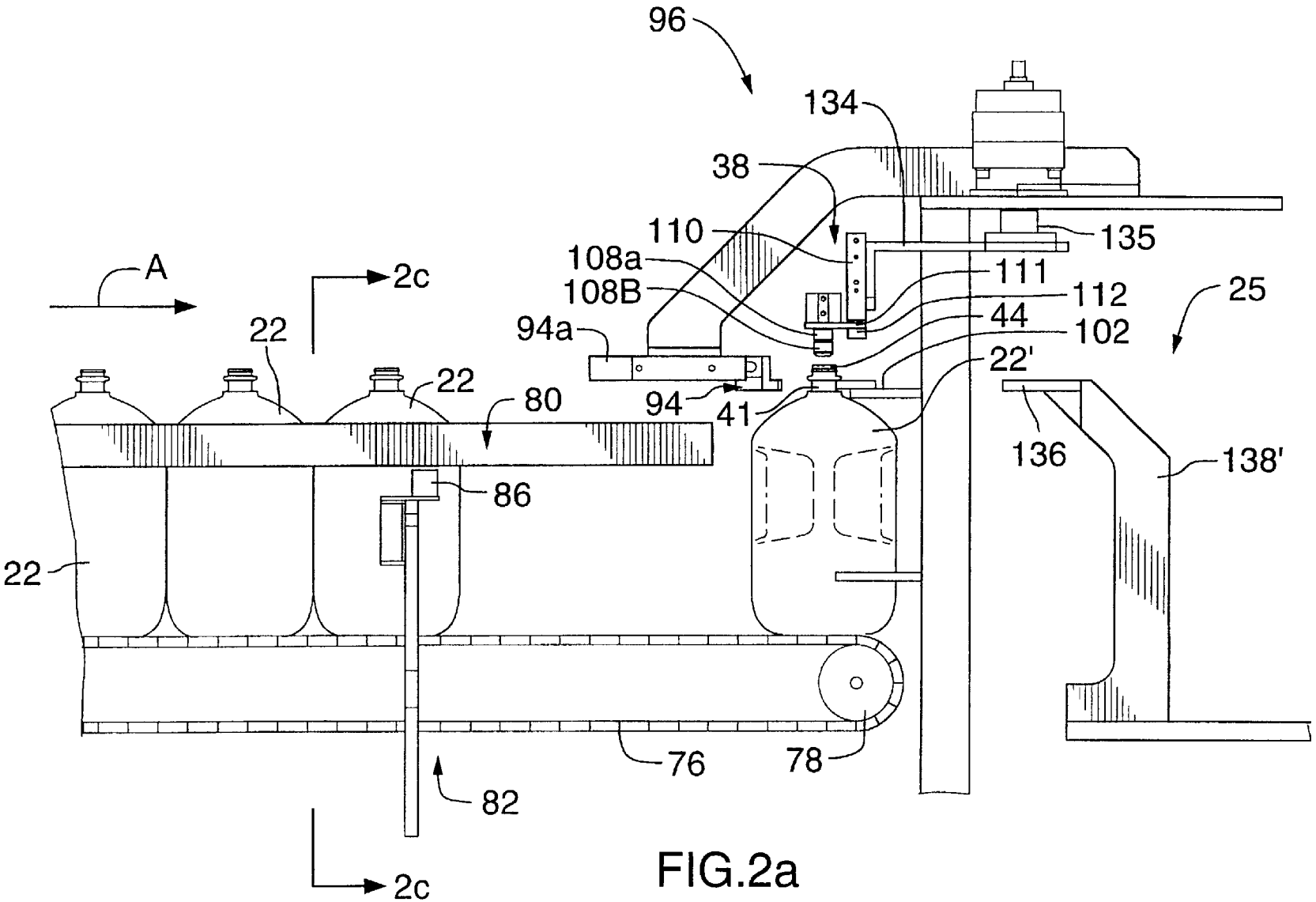
FIG. 2*a* is a side elevational view, on a larger scale, of a portion of the apparatus of FIG. 2 showing the selection means about to select one of the plurality of collapsible plastic containers and the translation means for receiving the selected one collapsible plastic container.
Figure 2B:
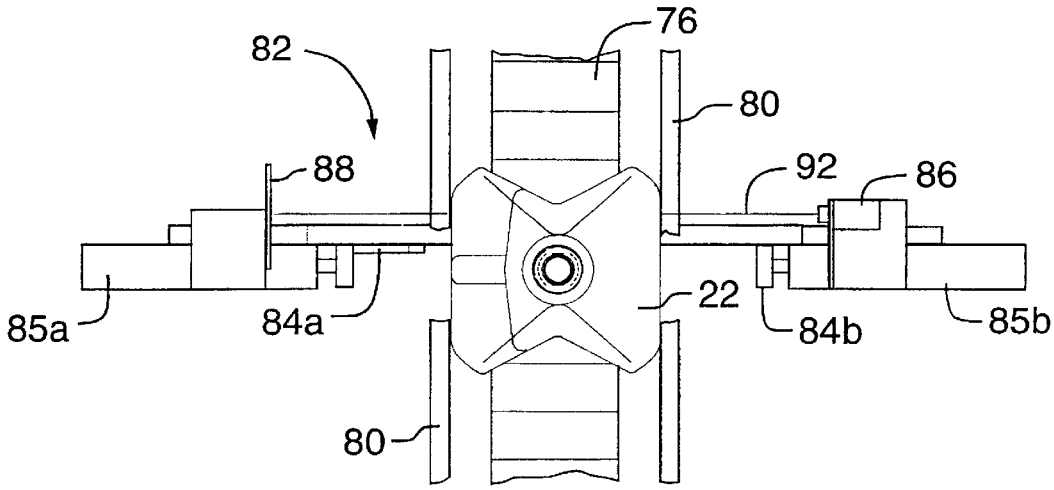
FIG. 2*b* is a top plan view of a portion of the apparatus shown in FIG. 2*a* in the region of sight line 2*c*—2*c* of FIG. 2*a,* and showing a second one of the plurality of collapsible plastic containers passing a container spacing means associated with the apparatus of the invention, with a container spacing means in its inactivated configuration.
Figure 2C:
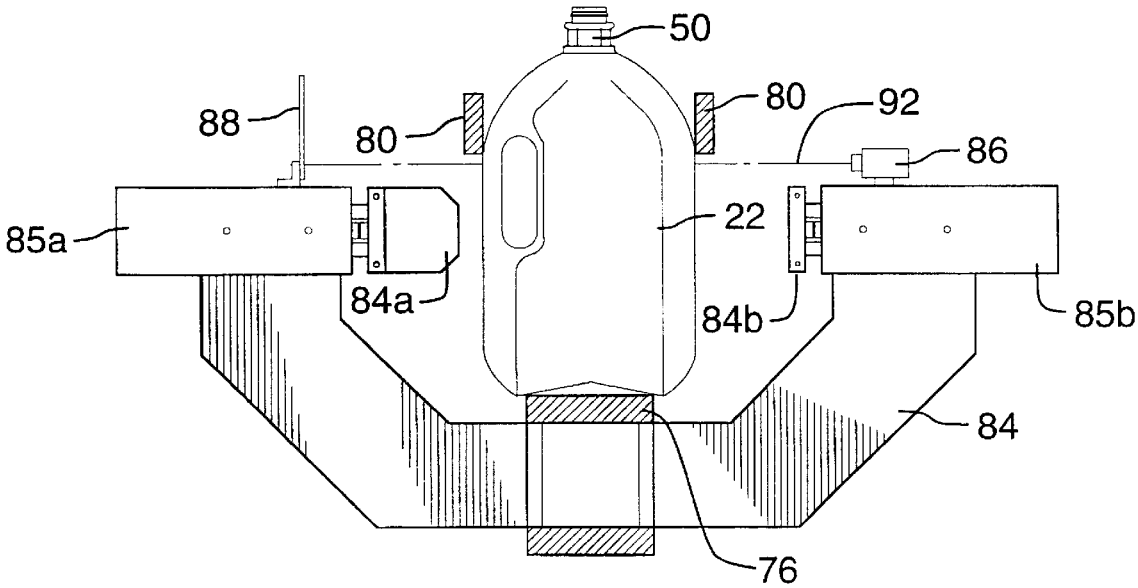
FIG. 2*c* is an end on elevational view along sight line 2*c*—2*c* of FIG. 2*a;*
Figure 2D:
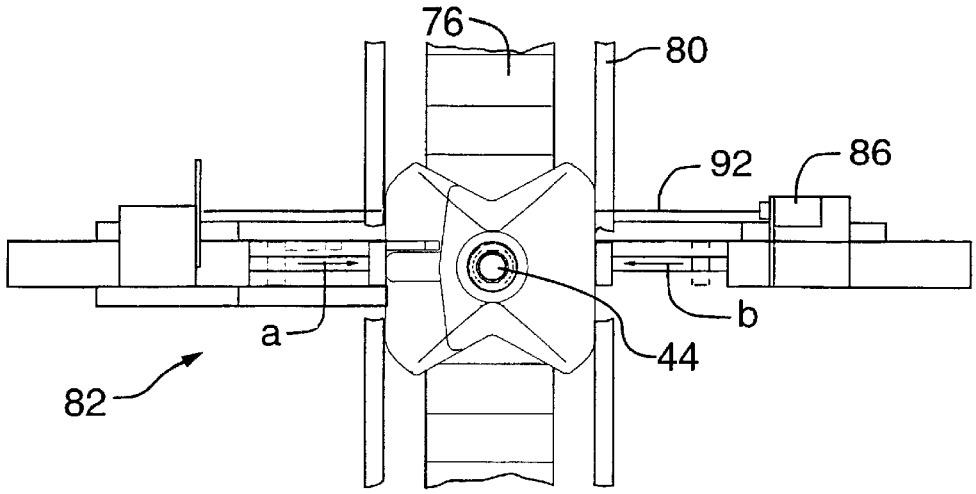
FIG. 2*d* is a top plan view similar to FIG. 2*b* in the region of sight line 2*c*—2*c* of FIG. 2*a,* with the container spacing means in its activated configuration.
Figure 2E:
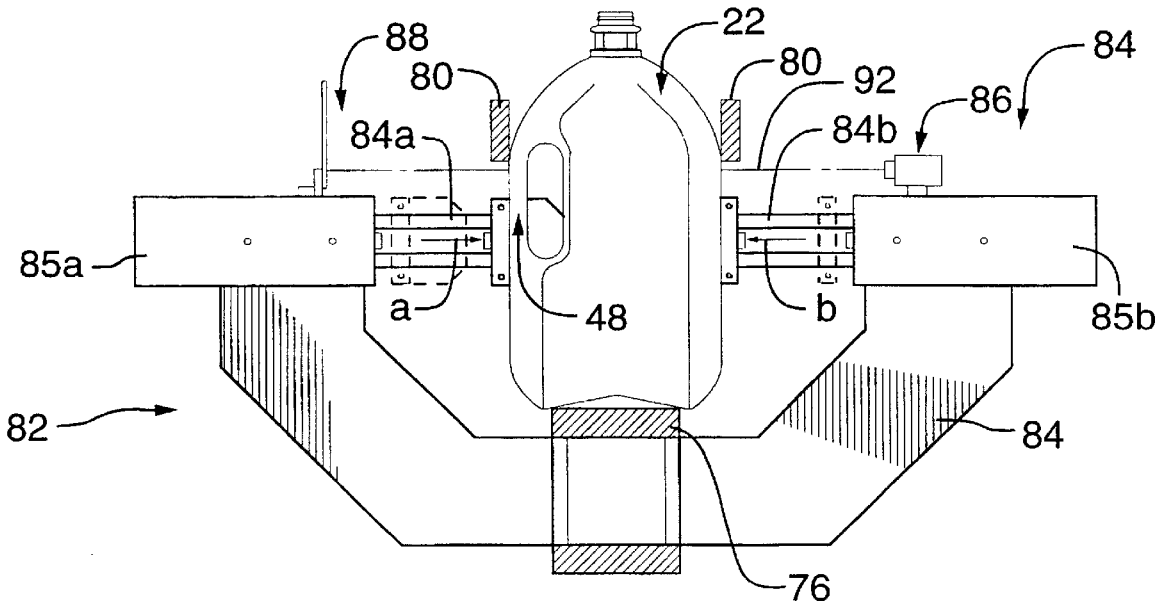
FIG. 2*e* is an end on elevational view similar to FIG. 2*c* with the container spacing means in its activated configuration.

The selection means 38 is functional to select one of said collapsible plastic containers 22 from a serially arranged row of the plurality of collapsible plastic containers 22 positioned on the conveyor 74, and to thereafter transfer said selected plastic container 22' to the transfer station 25 of the apparatus 22. This function will now be described in more detail with particular reference to FIGS. 2*a*, 3 and 3*c* through 3*g*, inclusive. With the selected collapsible plastic container 22' axially indexed in the pick-up zone in abutting relation to the stationary stop means 102, as described-above and as illustrated in FIGS. 2*a* and 3, a first pneumatically controlled ram assembly 104 is provided to lower and raise a resilient plunger 108 into the opening 44 of the non-collapsible neck portion 42 of the selected collapsible plastic container 22'. A second pneumatically controlled ram assembly 106, operatively interconnected with said first ram assembly 104, is functional to expand and contract the plunger 108 within the opening 44 of the non-collapsible neck portion 42, to thereby grippingly engage the selected collapsible plastic container 22' during its transfer between the pick-up zone and the transfer station 25.

Figure 3C:
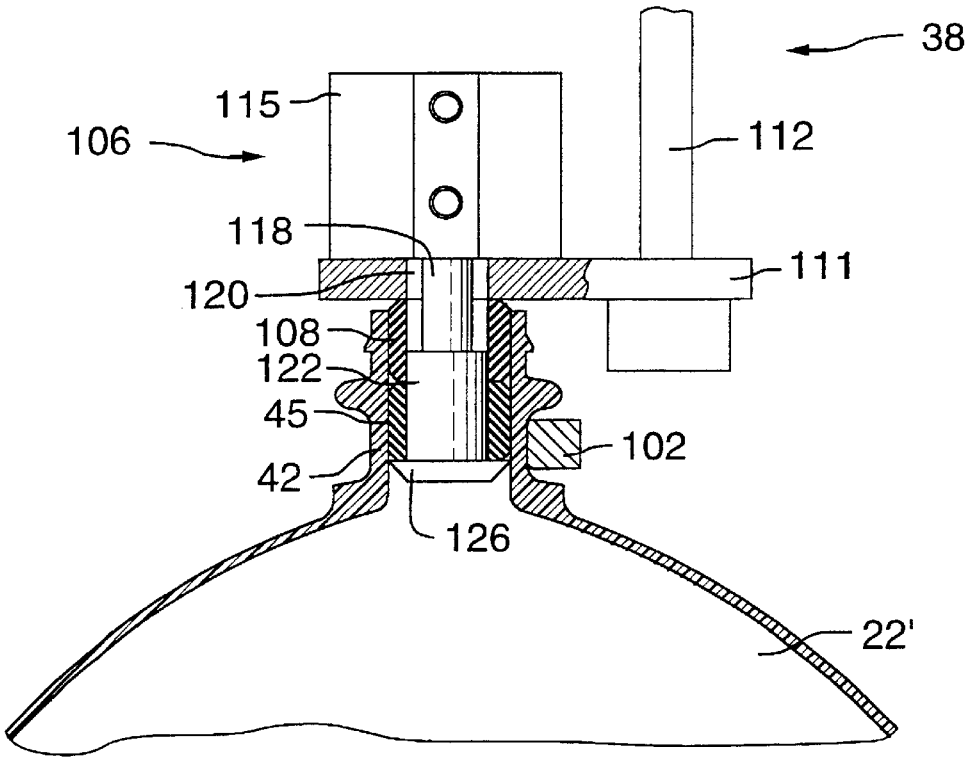
FIGS. 3*c* and 3*d* are sectional views along sight line 3*c*—3*c* of FIG. 3 illustrating, in sequence, the manner in which the selection means grips the selected collapsible plastic container about its non-collapsible neck portion.
Figure 3D:
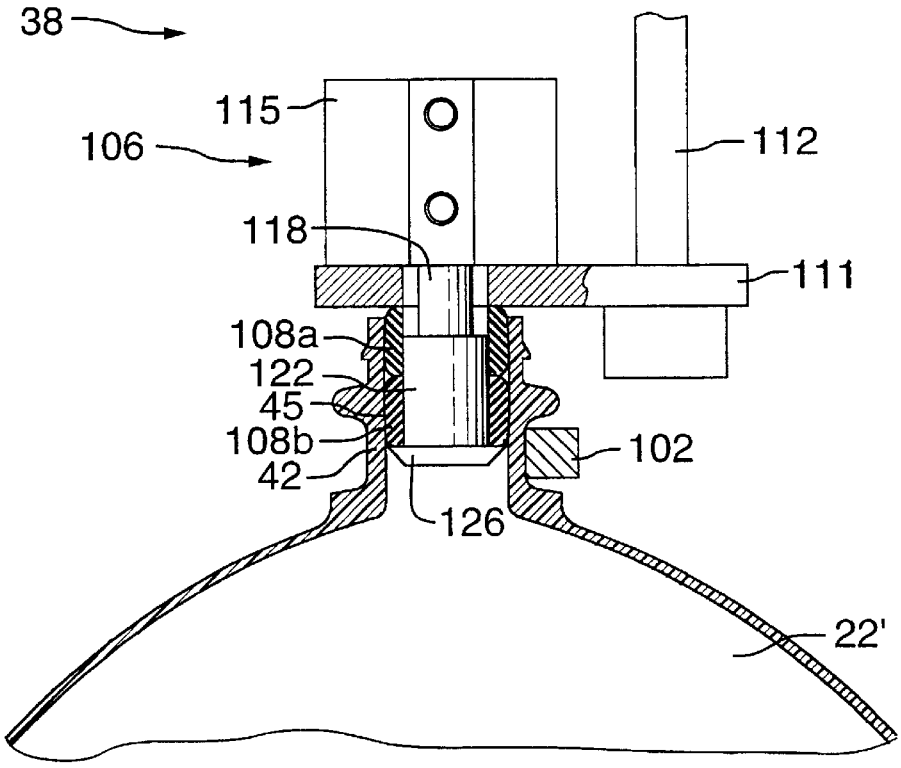
Figure 3E:
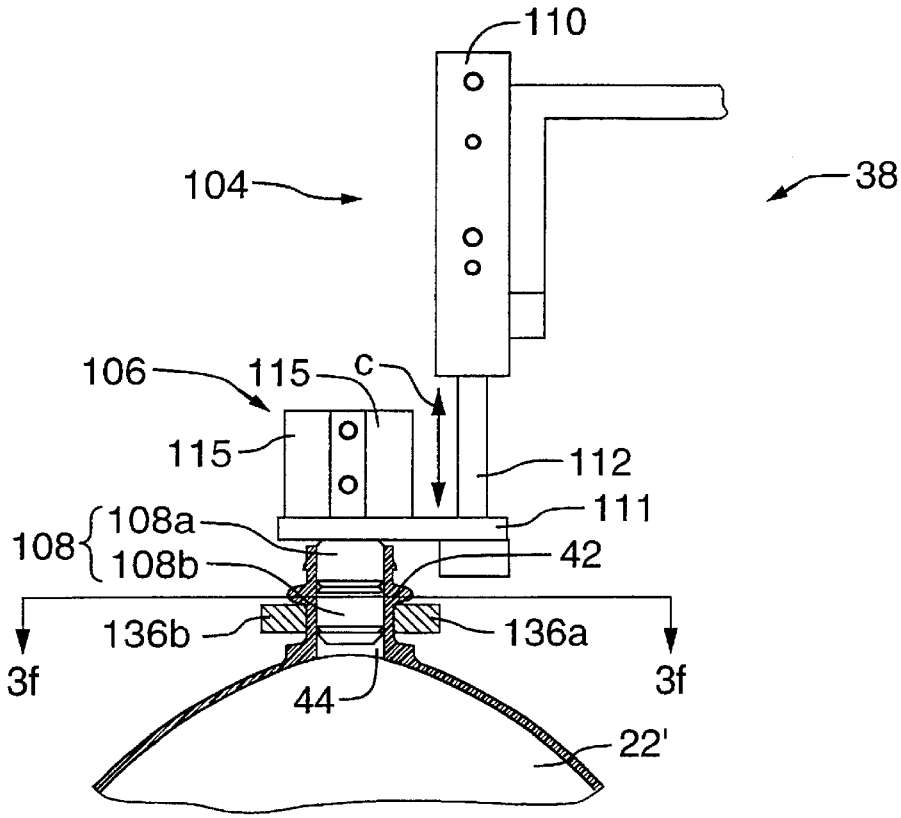
FIG. 3*e* is a sectional view along sight line 3*e*—3*e* of FIG. 3.

The first pneumatically controlled ram assembly 104, as illustrated in FIG. 3*e*, comprises a cylinder 110 and a piston 112, which piston 112 is operatively connected via a support arm 110 to the second pneumatically controlled ram assembly 106. The support arm 110 moves up and down (as illustrated by arrow "c") in conjunction with controlled movement of the piston 112.

The second pneumatically controlled ram assembly 106 is mounted on the support arm 111, and comprises a pneumatic cylinder 115, which cylinder 115 controls vertical travel of its associated piston 118 within a bore 120 defined therethrough (see FIGS. 3*c* and 3*d*).

The resilient plunger 108 is preferably constructed in two symmetrical halves 108*a* and 108*b*, which halves snugly encircle a central, non-resilient sleeve 122 secured to the lower end of piston 118. The sleeve 122 presents at its lower end a protruding annular flange portion 126. The flange portion 126 is sized larger than the internal diameter of the lower plunger half 108*b*, but slightly undersized to the opening 44 of the neck portion 42. The outer perimeter of the flange portion 126 is preferably chamfered, as shown, to facilitate smooth, non-binding insertions into the opening 44 of the neck portion 42.

As seen in FIGS. 2*a* and 3, the selection means 38 is initially positioned with the resilient plunger 108 centered over the opening 44 of the selected container 22'. Upon receipt of an actuation signal from the CPU computer means (not shown), the first pneumatically controlled ram assembly 104 is actuated so as to cause the piston 112 to move downwardly, which causes the plunger 108 to enter the opening 44 of the neck portion 42 to its full extent of travel, as seen in FIG. 3*e*. A further sequenced actuation signal form the CPU computer means (not shown) then causes the piston 118 of the second pneumatically controlled ram assembly 106 to retract upwardly a predetermined distance, causing the resilient plunger halves 108*a* and 108*b* to be compressed by concurrent upward travel of the flanged tip portion 126 of the plunger sleeve 122. This compression of the halves 108*a* and 108*b* within the opening 44 of the non-collapsible neck portion 42 (shown in section in FIG. 3*d*) causes outward radial expansion of the halves 108*a* and 108*b*, thereby bringing the plunger 108 into secure gripping engagement with the inner wall 45 of the neck portion 42, so as to permit subsequent transfer of the selected collapsible plastic container 22' from the pick-up zone to the transfer station 25 of apparatus 22, as is more fully described below.

Figure 3F:
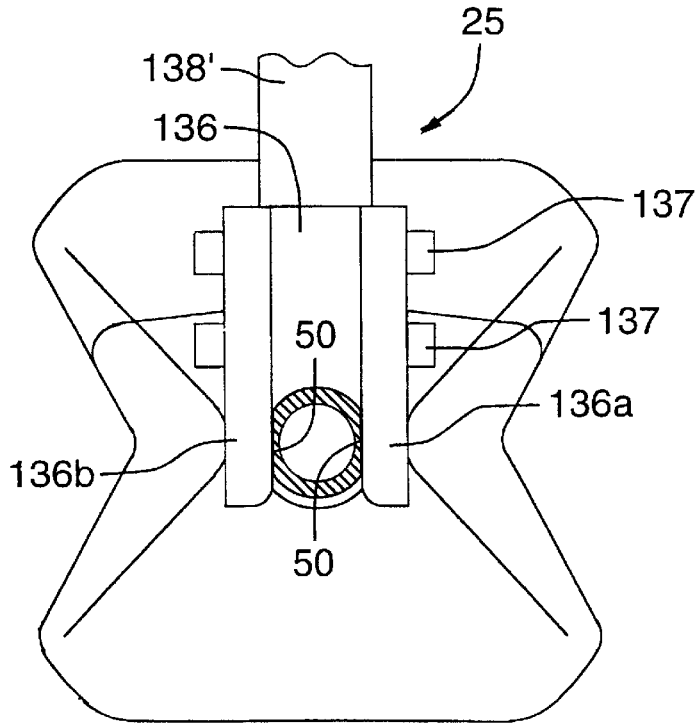
FIG. 3*f* is a top sectional view along sight line 3*f*—3*f* of FIG. 3*e;*
Figure 3G:
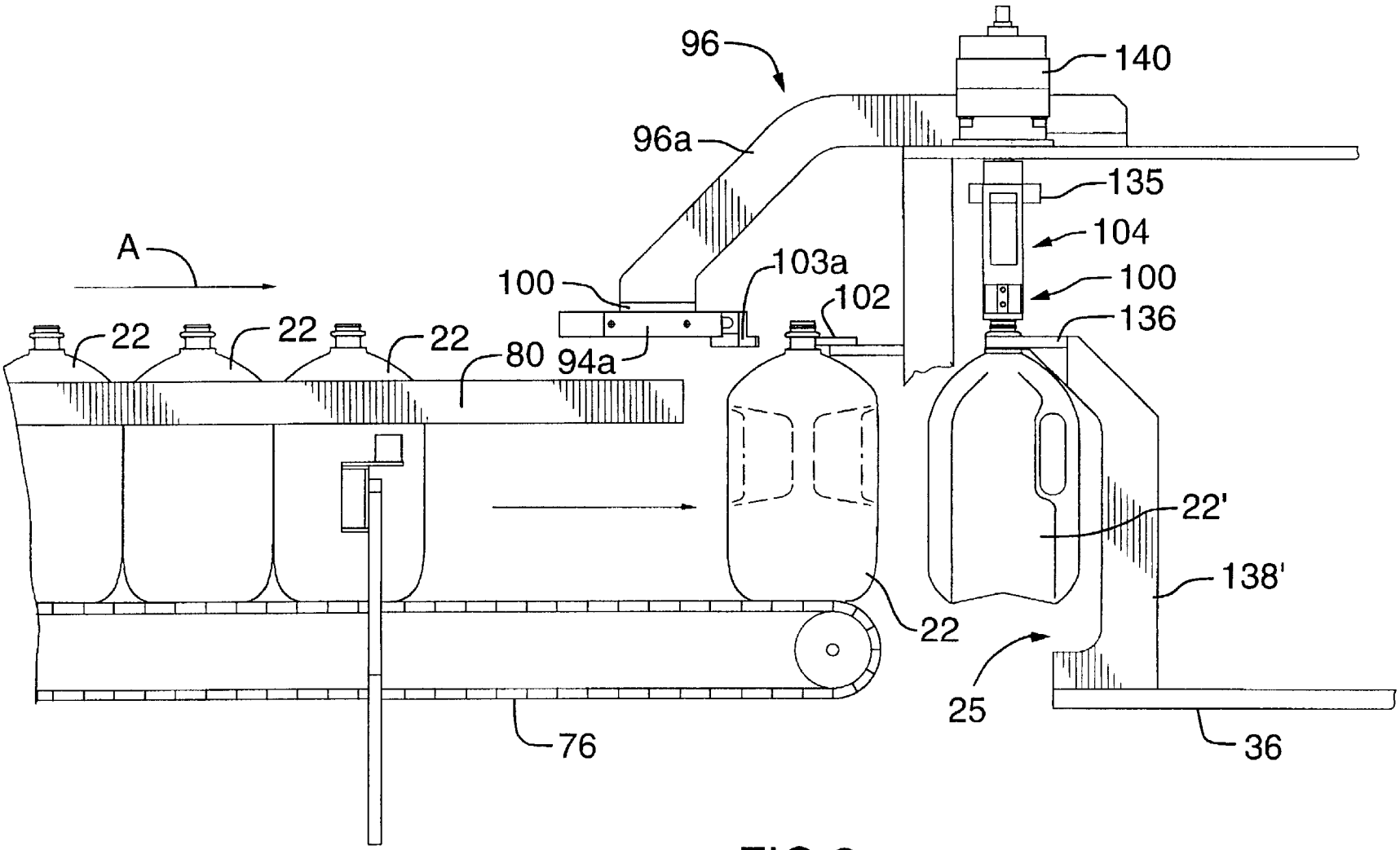
FIG. 3*g* is an elevational view similar to FIG. 2*a,* with the selection means having selected a collapsible plastic container and having transferred said container to a transfer station of the apparatus.

The selection means 38 further comprises a generally rectangular, laterally movable, loading arm 134, which loading arm is secured to the upper end of the second cylinder 110 of the first pneumatically controlled ram assembly 104, and is rotatably mounted to a spindle assembly 135, so as to be rotatable through 90 degrees of horizontal rotating motion from a selection position centred over the opening 44 of the non-collapsible neck portion 42 of the selected container 22' (as seen in FIGS. 2*a*, 3 (in phantom outlines), 3*c* and 3*d*) to a transfer position (as seen in FIGS. 3*e*, 3*f* and 3*g*). During this 90 degrees of horizontal rotary motion of the loading arm 134, the selected collapsible plastic container 22' has thus been translated form the pick-up zone previously described to the transfer station 25, whilst maintaining the non-collapsible neck portion 47 in the same axially indexed orientation achieved at the fixed stop means 102 with the aid of the axial orientation means 94, as previously described. The controlled 90 degrees of movement of the loading arm 134 just described is achieved by sequential actuation of a conventional motor 140, operatively mounted above and connected to the spindle 135, upon receipt of appropriate control signals received from the computer CPU means (not shown). It will be appreciated from FIGS. 3*g*, 3*e* and 3*f*, that, as the loading arm 134 swings into the transfer station 25, the two opposed flats 50 on the non-collapsible neck portion 42 of the selected collapsible plastic container 22' are accepted in retained indexed relation between two chamfered fingers 136*a* and 136*b* of a U-shaped holding bracket 136, which holding bracket 136 is in turn rigidly affixed by four bolts 137 to a generally C-shaped, vertical mounting plate 138', which mounting plate 138' is welded, or otherwise rigidly affixed at its lower end to a translation means, which, in the preferred embodiment illustrated, takes the form of a rotatable carousel means 36. Once transferred in this manner by the loading arm 134 to the fingers 136*a* and 136*b* at the transfer station 25, the selected collapsible plastic container 22' is released from gripping by the loading arm 134 by downward movement of the piston 118 of the second pneumatically controlled ram assembly 106, (which causes relaxation and consequent radial shrinkage at the two plunger halves 108*a* and 108*b*), followed by upward movement of the piston 112 of the first pneumatically controlled ram assembly 104, so as to withdraw the resilient plunger 108 form the opening 44 of the non-collapsible neck portion 42. The loading arm 134 is thereafter free to move under control of the motor 140 back through 90 degrees of horizontal rotary motion to its original position (shown in FIG. 2*a*) to pick up the next collapsible plastic container 22 which will, by the time of such return motion, have advanced to the stationary stop member 102.

In addition to the vertical mounting plate 138', five additional congruent mounting plates 138, each having a U-Shaped holding bracket 136, are provided at regularly pre-determined spaced intervals on the carousel means 36, whereupon, as stated earlier, one selected collapsible plastic container 22' is fully processed per revolution of the carousel means 36 at each successive station of the apparatus. In this manner, the carousel means 36 is adapted for accepting the selected collapsible plastic container 22' at the transfer station 25 in radially indexed, retained relation about its neck portion 42, and for translating the selected collapsible plastic container 22' in serially indexed rotary relation to each of the capping 39, collapsing 32 and magazine loading 34 stations, respectively. Moreover, it is to be noted that the selection means 38 comprises, in combination, said first 104 and second 106 plunger ram assemblies, the plunger 108, and the loading arm 134, with the associated parts and subassemblies associated therewith, as described above.

Figure 4:
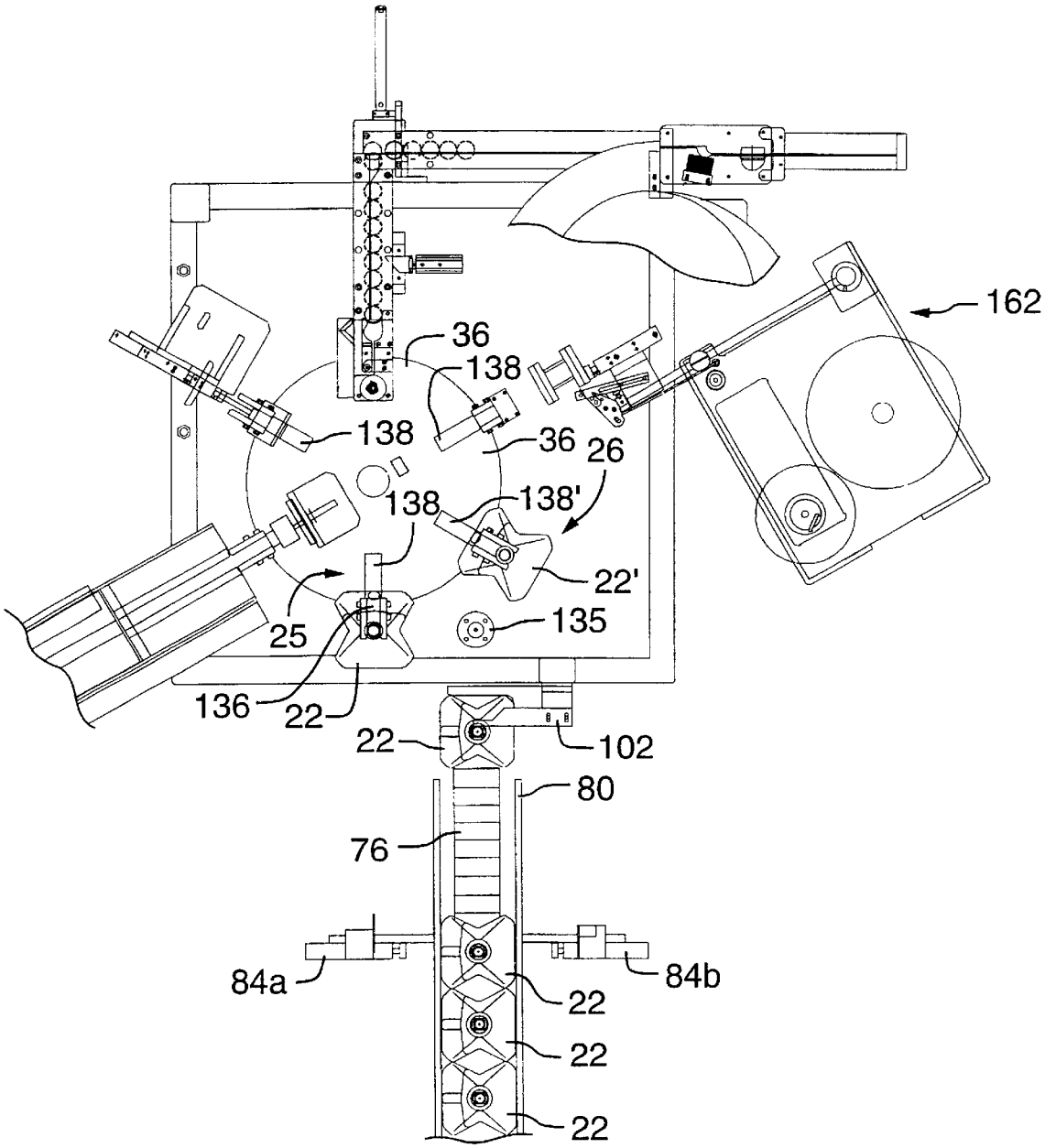
FIG. 4 is a partial top plan view similar to FIG. 1*c,* but on a larger scale, showing the selected collapsible plastic container translated by the translation means to a leak testing station of the apparatus.
Figure 4A:
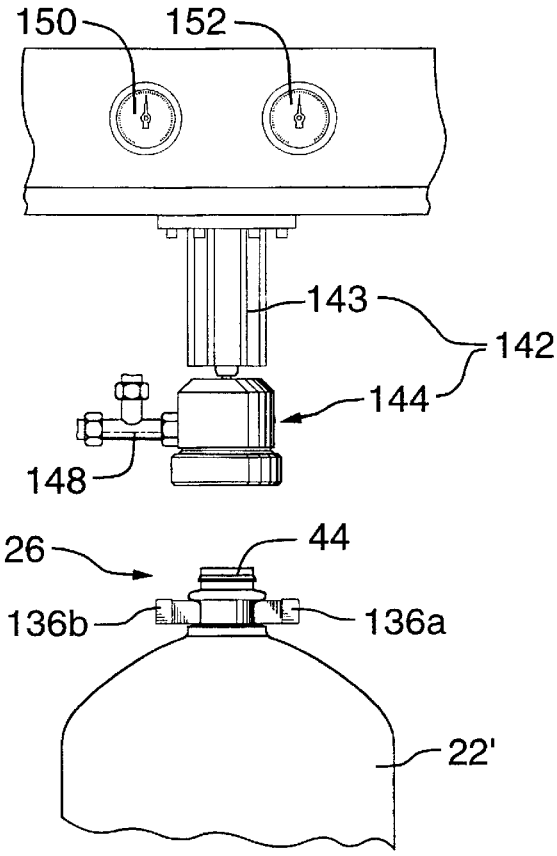
FIG. 4*a* is a partial side elevational view of the selected collapsible plastic container at the leak testing station of FIG. 4, with a first pressurizing means shown in a raised configuration above said collapsible plastic container.
Figure 4B:
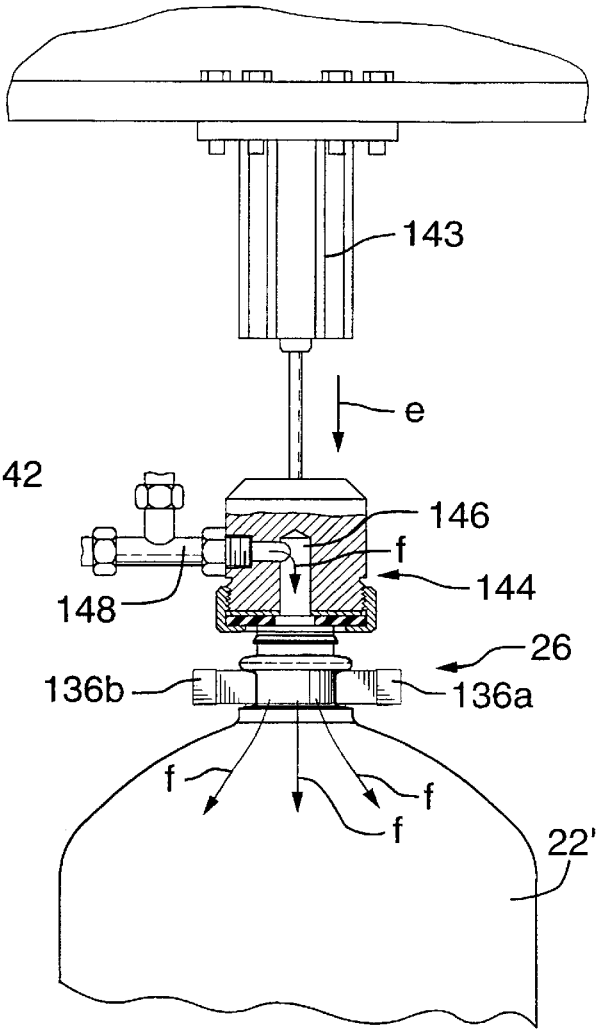
FIG. 4*b* is a view similar to FIG. 4*a,* with the first pressurizing means shown (partly in section) lowered into sealing relation with the opening defined by the neck portion of the selected collapsible plastic container.

From the transfer station 25, the selected collapsible plastic container 22' is preferably indexed, by rotation of the carousel means 36 under control of the computer CPU means (not shown), to a leak testing station 26 (see FIGS. 4, 4*a* and 4*b*). At the leak testing station 26, a first pressuring means 142 comprising a pneumatic ram assembly 143 and a pressure nozzle 144 is positioned in centred relation over the opening 44 of the non-collapsible neck portion 42. Upon receipt of an appropriate actuation signal from the computer CPU means (not shown), a pressure nozzle 144 is lowered in the direction of arrow "e" of FIG. 4*b* by means of the ram assembly 143 into sealing relation over the opening 44 of by the non-collapsible neck portion 42 of the selected collapsible plastic container 22', said nozzle 144 having an internal conduit 146 for passage of a pressurized fluid therethrough as indicated by arrows "f" of FIG. 4*b*. The fluid is introduced into the conduit 146 under control by the computer CPU means (not shown), via line 148 connected to any suitable pressurized fluid source, as is well known to one skilled in the art. Preferably, the pressurized fluid is air; however any suitable fluid may be utilized. Operatively connected to said nozzle 144, is a pressure gauge 150 having associated therewith a timer 152 for monitoring the retention time of the fluid at specified pressures within the selected non-collapsible plastic container 22'. The retention of pressure over a set time value is compared with a predetermined threshold value to thereby determine whether the selected collapsible plastic container 22' meets leak test specifications. Typically, the pressurized fluid is retained in the selected collapsible plastic container 22' at a pressure of about 0.5 p.s.i to about 3.0 psi for a test time of between about 2.0 to about 6.0 seconds. Selected containers 22' found not to meet the leak test specification are preferably ejected from the apparatus 20 prior to the indexing thereof into the magazine clip loading station 34 by means of a pneumatically controlled ejection cylinder (not shown) placed at a convenient location after the leak testing station 26. The computer CPU means (not shown) takes note of the empty position on the carousel means 36 following such ejection, and suspends subsequent operations (e.g. labelling) at the empty position until a fresh non-leaking collapsible plastic container 22 is inserted into the empty position upon a subsequent revolution of the carousel means 36.

Figure 5:
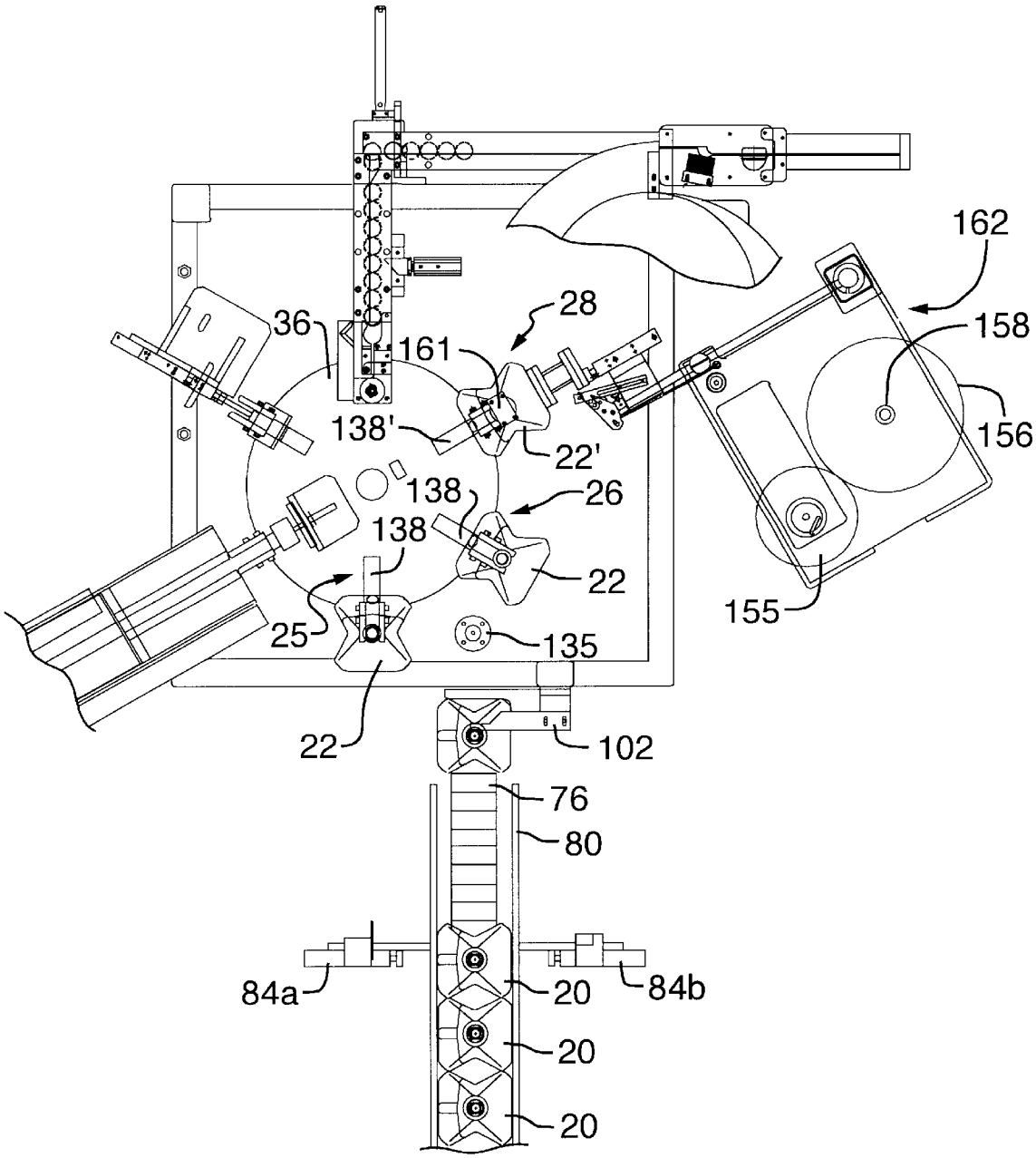
FIG. 5 is a top plan view similar to FIG. 4, showing the selected collapsible plastic container translated by the translation means to a labelling station of the apparatus.
Figure 5A:
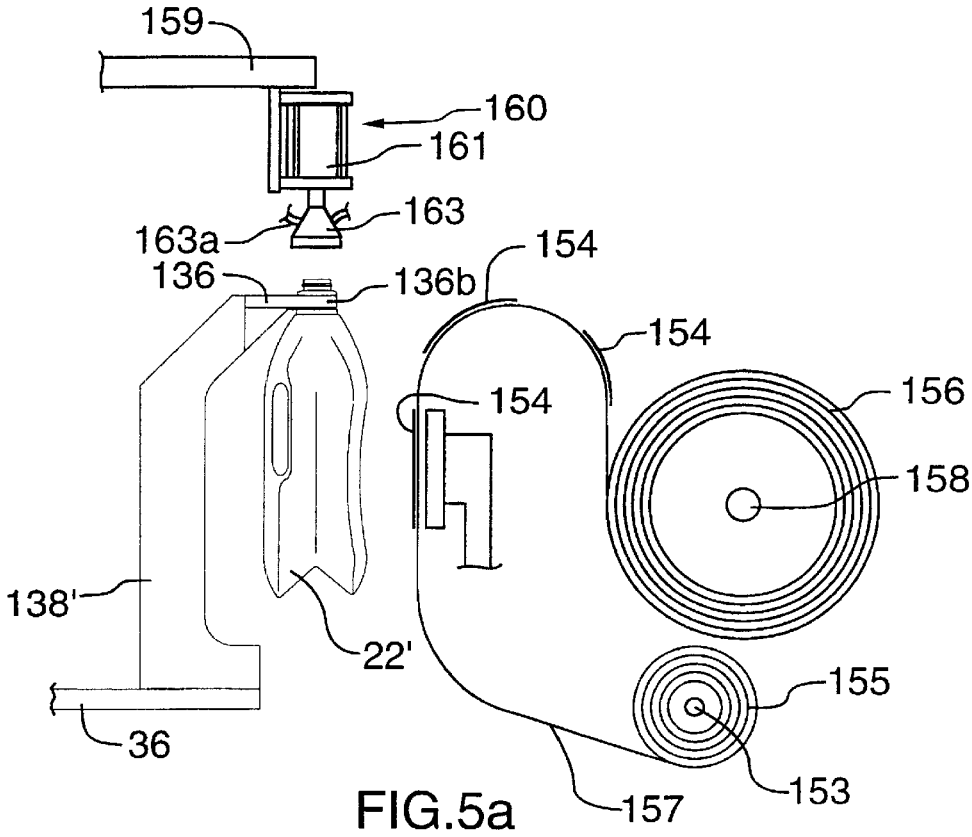
FIG. 5*a* is a partial side elevational view of the selected collapsible plastic container at the labelling station, with a second pressurizing means shown in a raised configuration above said selected collapsible plastic container, and with a label applicator means shown in a retracted configuration.
Figure 5B:
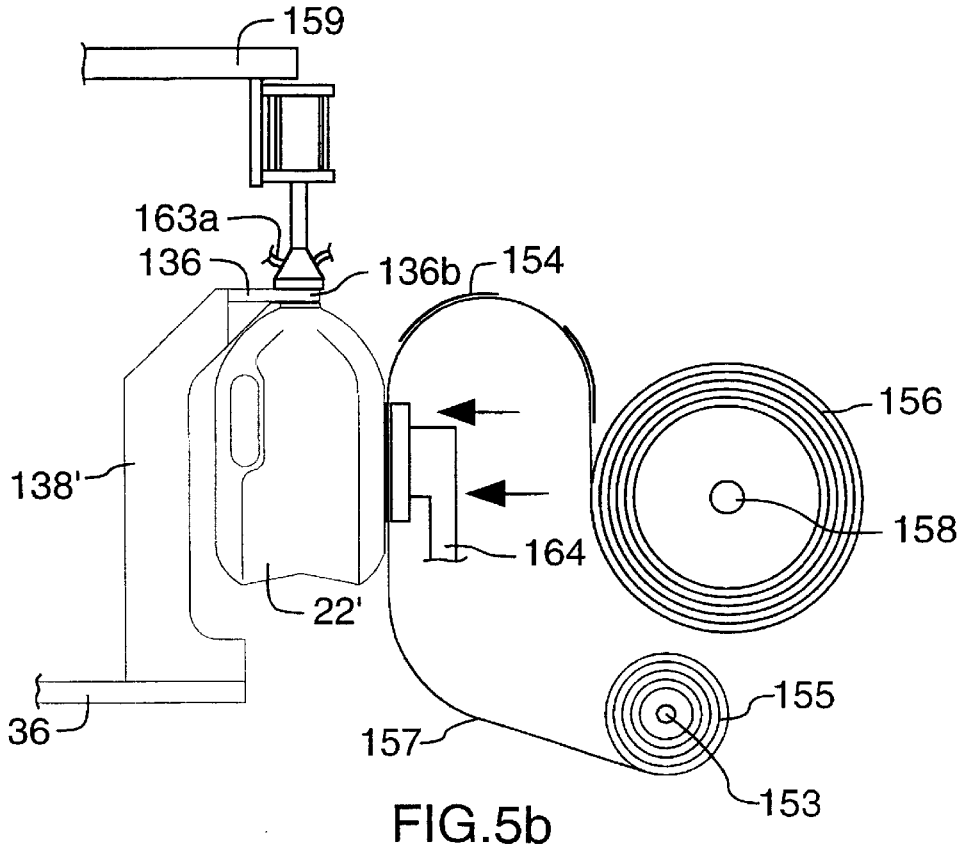
FIG. 5*b* is a view similar to FIG. 5*a,* with the second pressurizing means lowered into sealing relation with the opening defined by the neck portion of the selected container to pressurize said selected collapsible plastic container, and with the label applicator means in an extended configuration applying a self adhesive label to the selected container so pressurized.
Figure 5C:
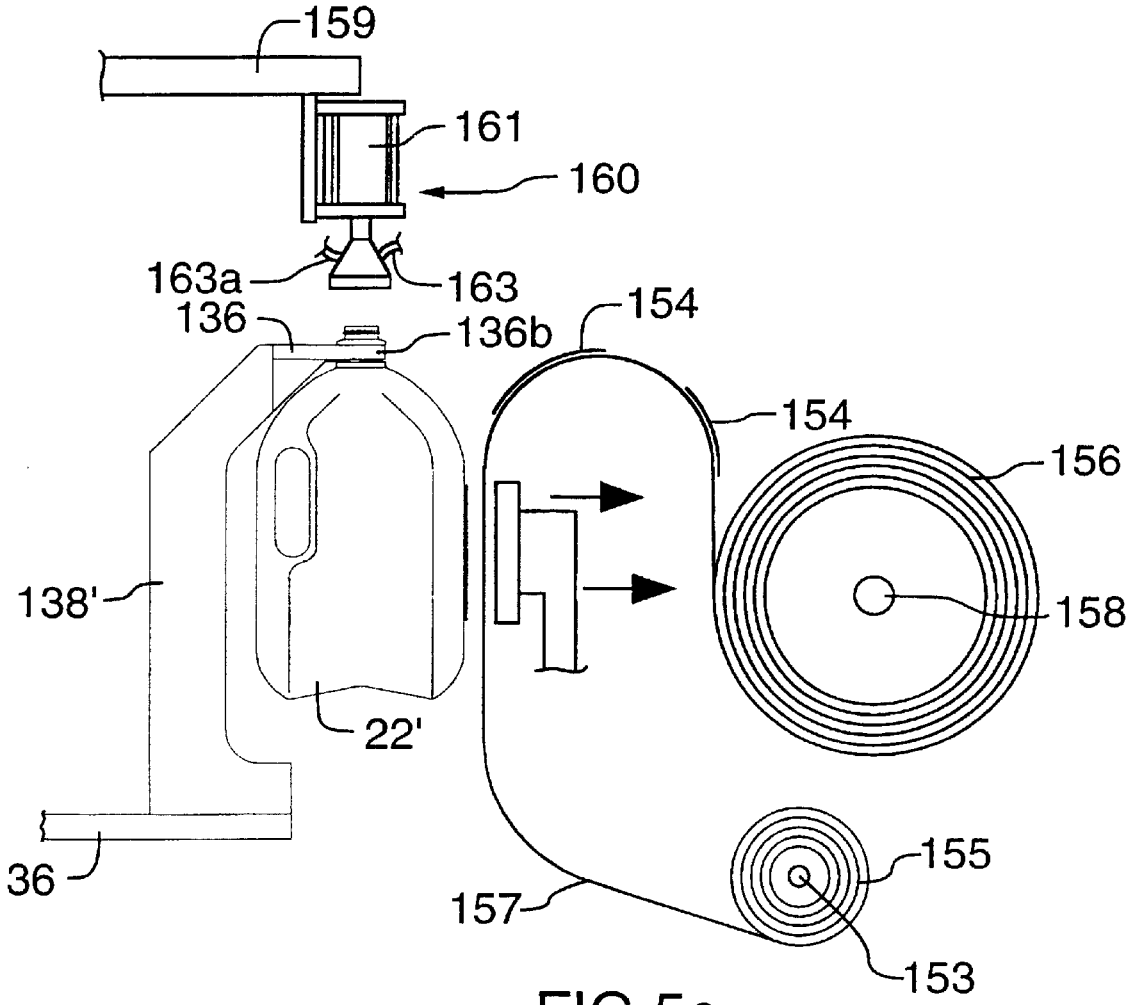
FIG. 5*c* is a view similar to FIG. 5*b,* with the second pressurizing means raised from sealing relation with the opening of the selected container, thereby releasing pressure from the selected container, and with the self-adhesive label applied.

From the leak testing station 26, the selected collapsible plastic container 22' is translated by serially indexed rotation of the carousel means 36 under control of the computer CPU means (not shown) to, optionally, the labelling station 28. FIGS. 5, 5*a*, 5*b* and 5*c* all pertain to the labelling station 28. Initially, prior to application of the commercially available adhesive labels 154, which are provided on a supply roll 156, which poll in turn is rotatably mounted on a spindle 158, the selected collapsible plastic container 22' must be once again subjected to a mechanical pressurization step to distend the collapsible body portion 40 of the selected collapsible plastic container 221, to thereby provide a substantially rigid, smooth outer surface for application of adhesive labels thereto. For this purpose, a second pressurization means 160 is provided, which means 160 essentially comprises a pneumatic ram assembly 161 and Pd pressure head assembly 163 which assembly 163 is lowered by the ram assembly 161 under computer control into sealing relation with the opening 44 defined by the non-collapsible neck portion 42, in a manner generally analogous to the first pressurization of the selected collapsible plastic container 22', which has been described supra in connection with the first pressuring means 142 positioned over the leak testing station 26. Once lowered from its initial raised configuration (as seen in FIG. 5*a*), to its lowered operative configuration (as seen in FIG. 5*b*), a pressurized fluid (preferably air) is pumped into the selected plastic collapsible container 22' by way of air supply line 163*a*. Once the collapsible body portion 40 is fully distended (as seen in FIG. 5*b*), the label 154 is pressed onto said container 22' by means of a conventional tamp pad label applicator means having the general reference number 162, which means can be, for example, an Avery™ ALS 330L label applicator available from CCL Labelling Equipment of 3070 Mainway Drive, Burlington, Ontario, Canada. More specifically, the label applicator means comprises a tamping member 164 movable between a retracted configuration, when the selected collapsible plastic container 22' is in the collapsed state (as shown in FIG. 5*a*)and an extended configuration, when the selected collapsible plastic container 22' is in the distended state (as shown in FIG. 5*b*). Following adhesion of the label 154, the tamping member 164 is again retracted using the provided means, and the pressurizing means 160 is raised and is released from sealing relation with the opening 44 of the neck portion 42 of the selected collapsible plastic container 22' (as shown in FIG. 5*c*). The label applicator means 162 also comprises a take-up roll 155 rotatably mounted upon spindle 153, upon which spindle 153 backing sheet 157 for the adhesive labels 154 is wound up upon after transfer of each adhesive label 154 to a respective one of the selected collapsible plastic containers 22' in the manner just described.

Following labelling, or alternatively, if either or both of the leak testing or labelling steps have been omitted from the apparatus 20, the selected collapsible plastic container 22' is indexed by means of computer control rotary motion of the carousel means 36 to the capping station 30.

Figure 6:
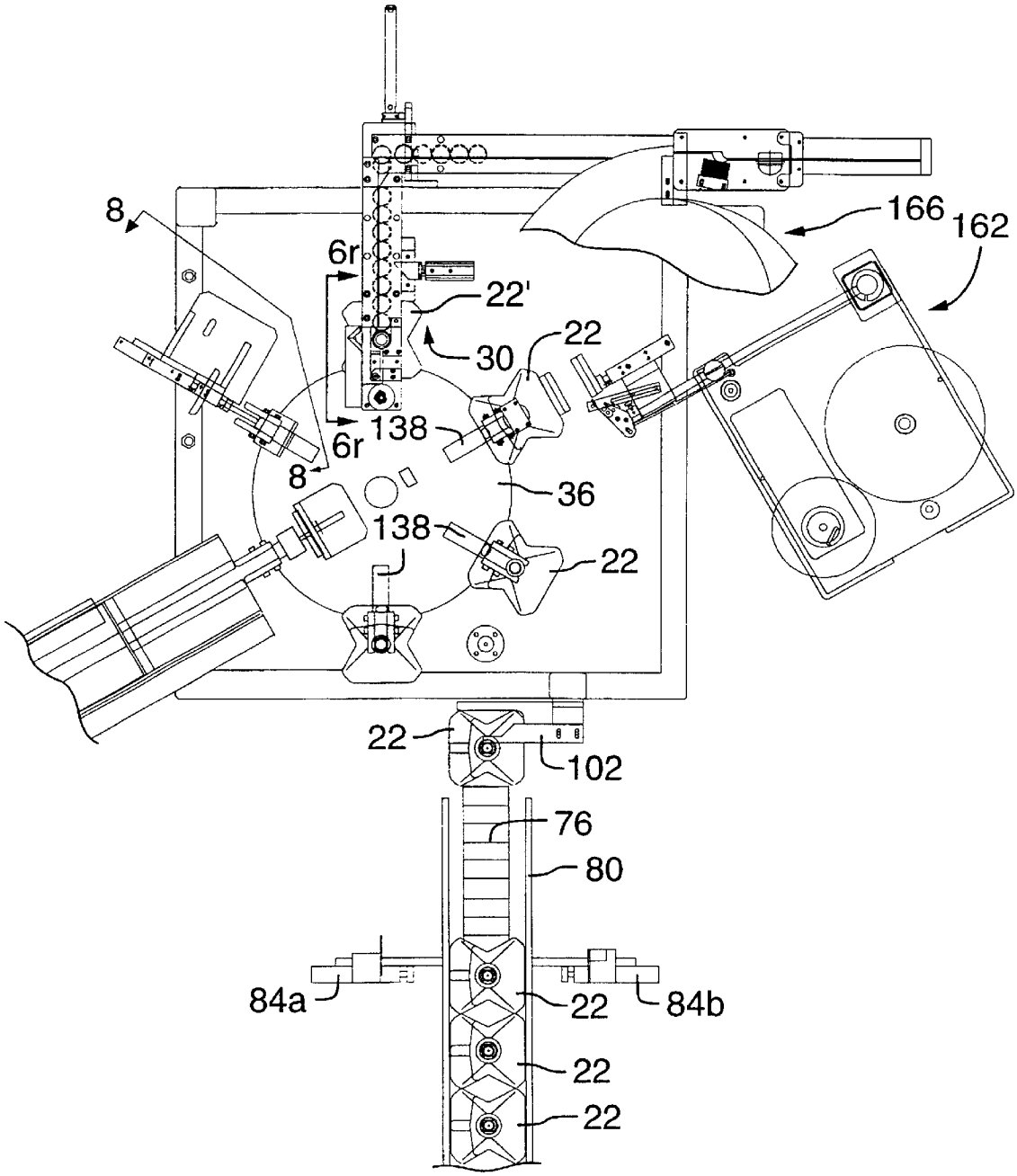
FIG. 6 is a partial top plan view similar to FIG. 5, showing the selected collapsible plastic container translated by the translation means to the capping station, with the capping means partially omitted for ease of illustration.
Figure 6A:
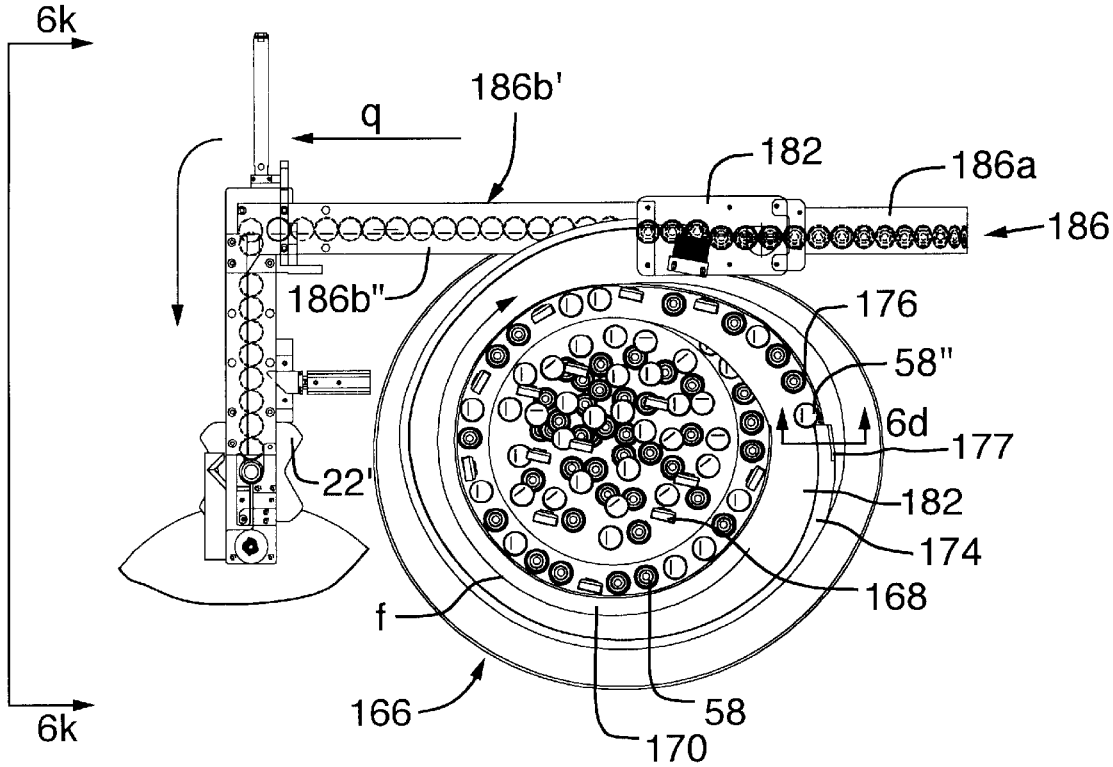
FIG. 6*a* is an enlarged top plan view of the capping means shown in FIG. 6 showing a closure cap entering a cap orientation area of the hopper of the capping means, with the closure cap being in an upside down orientation.
Figure 6B:
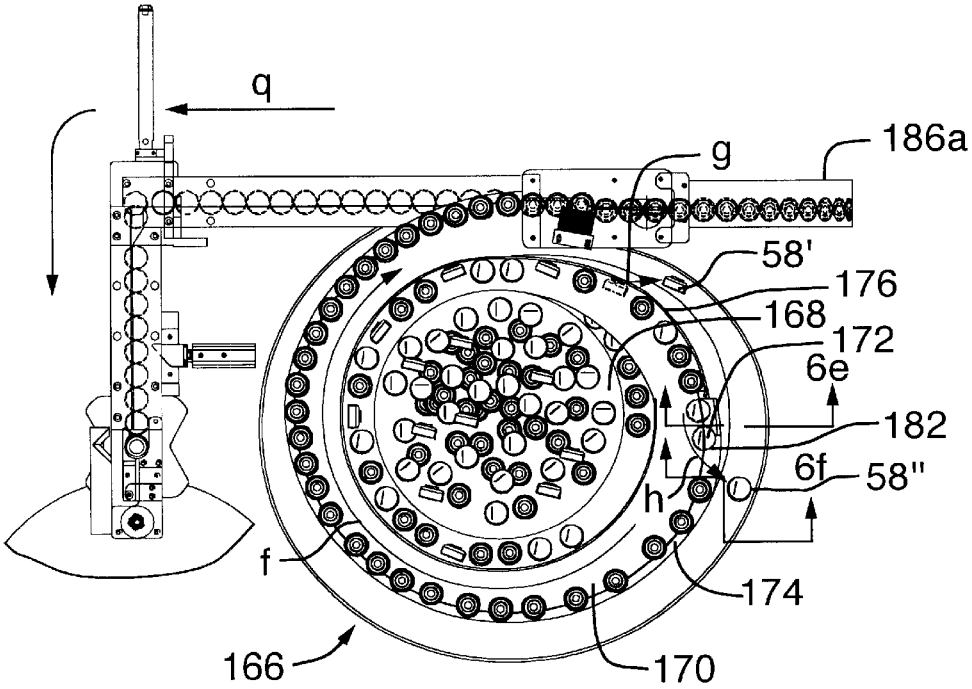
FIG. 6*b* is a view similar to FIG. 6*a,* sequentially showing (partly in phantom outline) the upside down closure cap in the cap orientation area being ejected at an ejection zone from an upper level of the hopper back down to a lower level of the hopper.
Figure 6C:
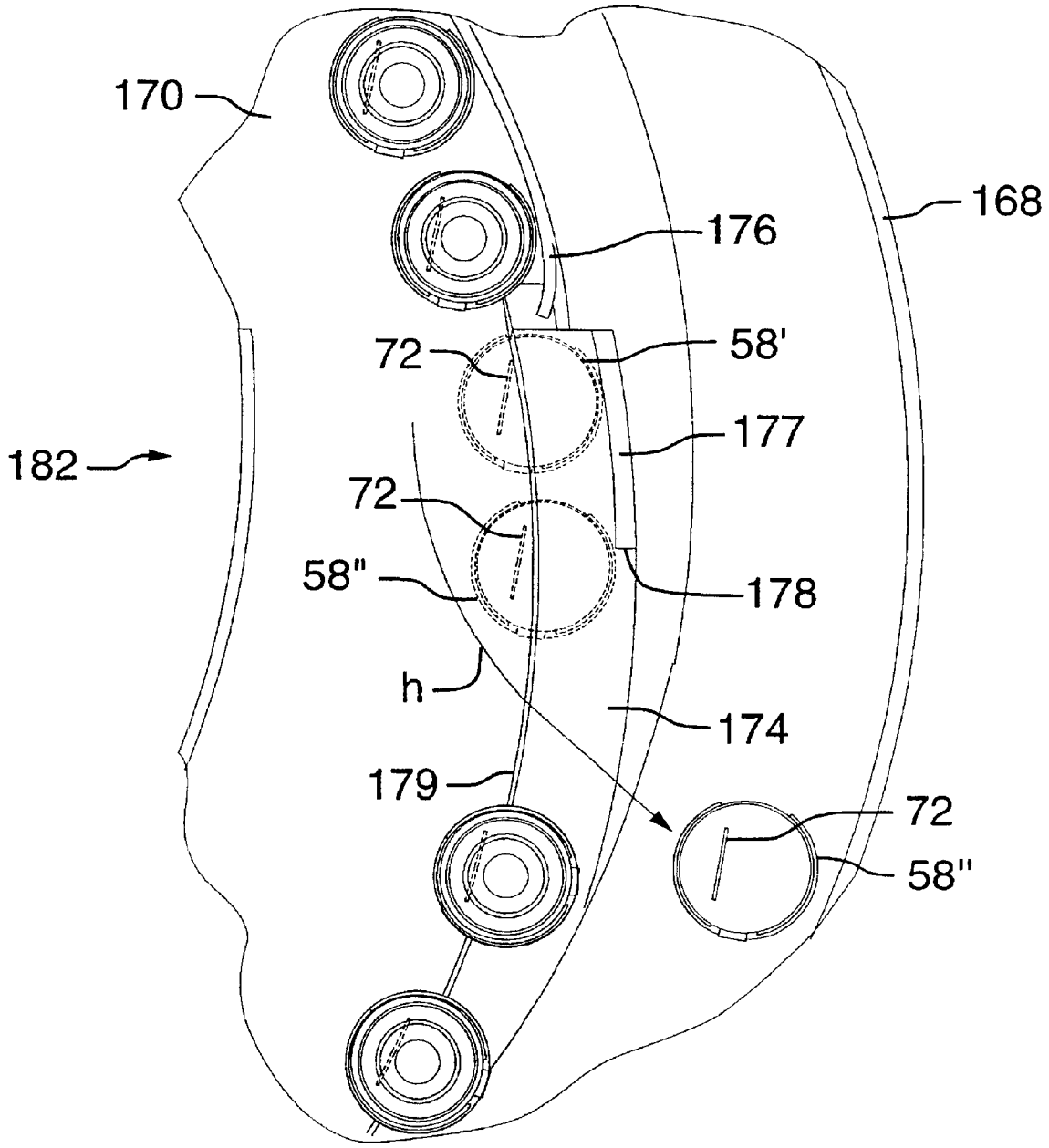
FIG. 6*c* is an enlarged scale view of ejection zone of FIG. 6*b;*
Figure 6D:
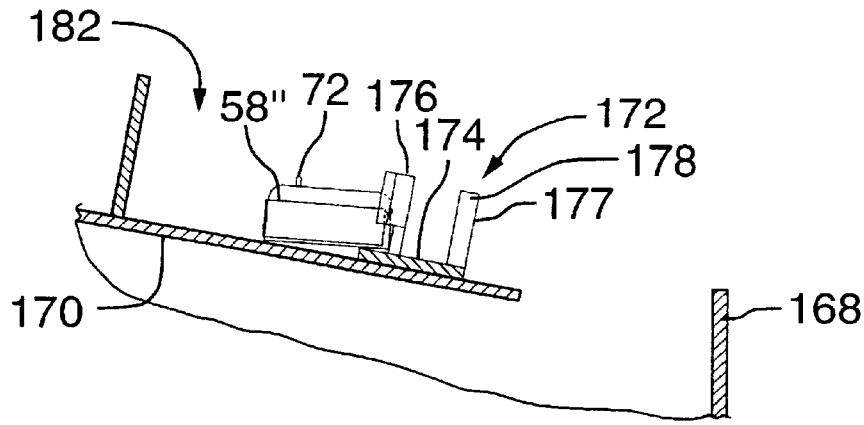
FIG. 6*d* is a sectional view along sight line 6*d* of FIG. 6*a;*
Figure 6E:
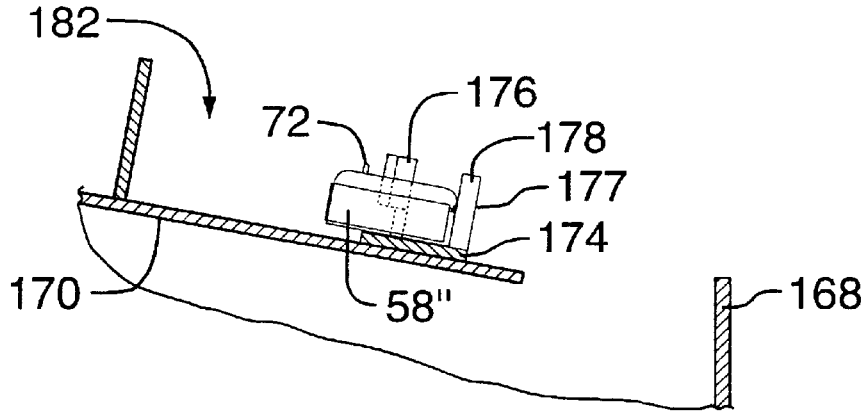
FIG. 6*e* is a sectional view along sight line 6*e* of FIG. 6*b;*
Figure 6F:
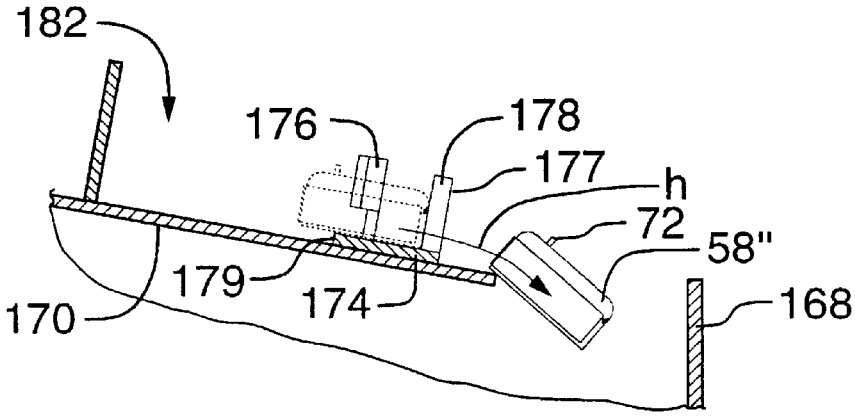
FIG. 6*f* is a sectional view along sight line 6*f* of FIG. 6*b;*
Figure 6G:
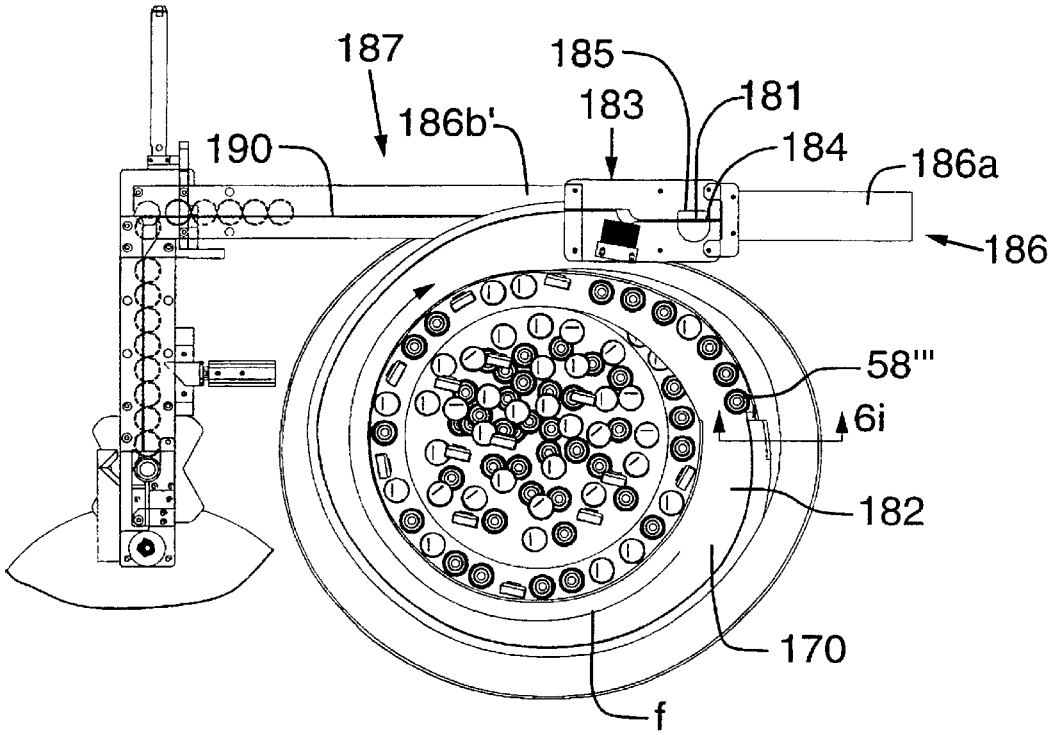
FIG. 6*g* is an enlarged top plan view of the capping means shown in FIG. 6 illustrating a closure cap entering the cap orientation area of the hopper of the capping means, with the closure cap being in a right side up orientation.
Figure 6H:
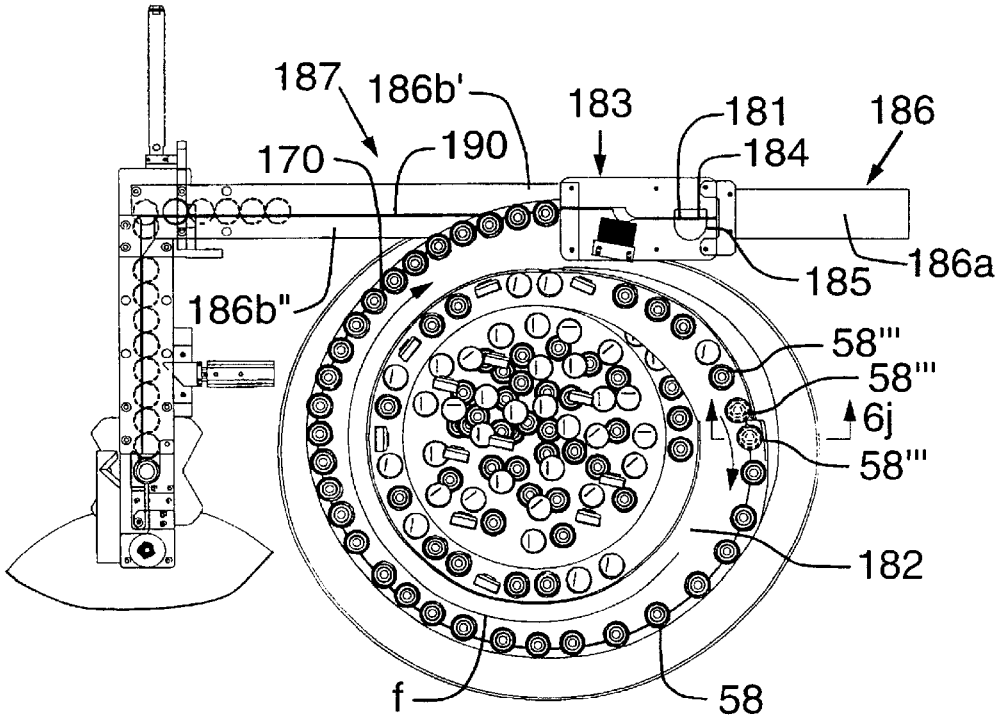
FIG. 6*h* is a view similar to FIG. 6*g,* illustrating (partly in phantom outline) the right side up closure cap in the cap orientation area bypassing the ejection zone of the hopper.
Figure 6I:
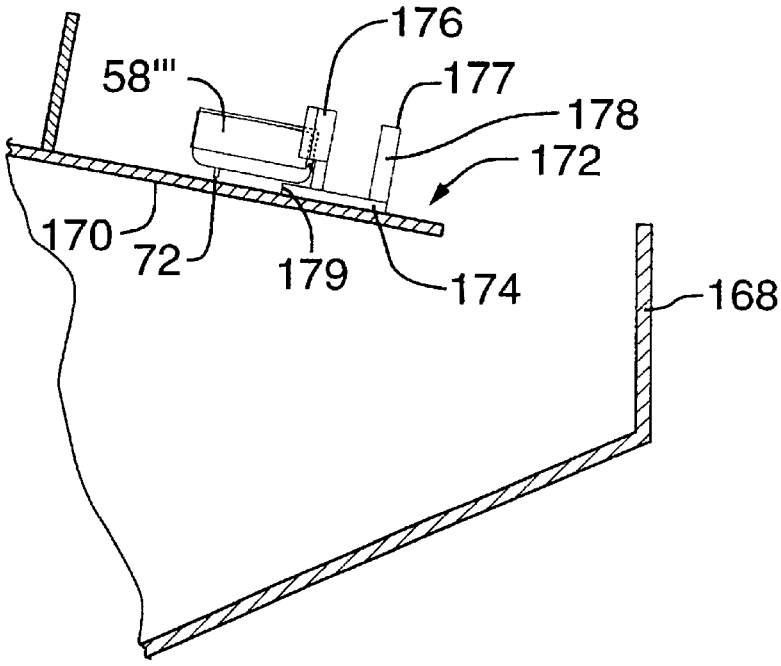
FIG. 6*i* is a sectional view along sight 6*i* of FIG. 6*g;*
Figure 6J:
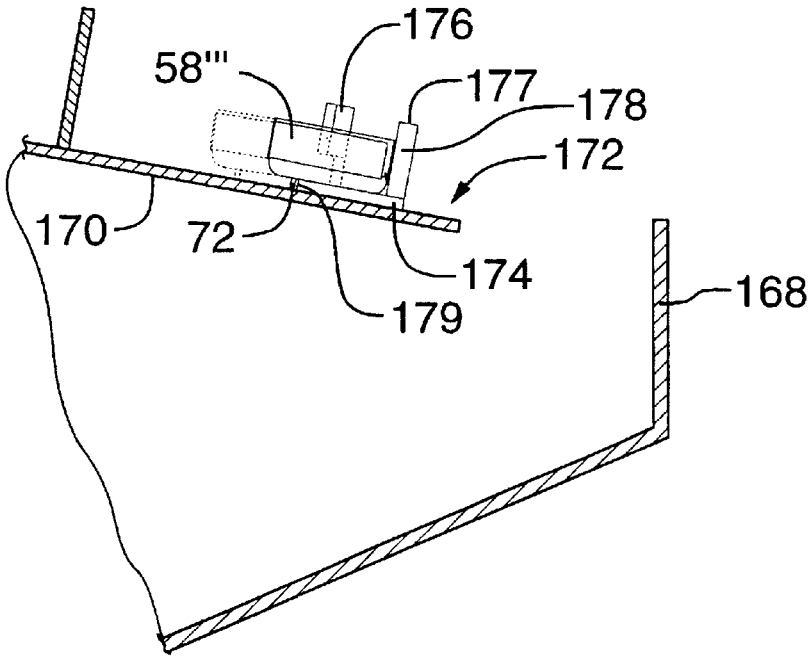
FIG. 6*j* is a sectional view along sight line 6*j* of FIG. 6*g;*
Figure 6K:
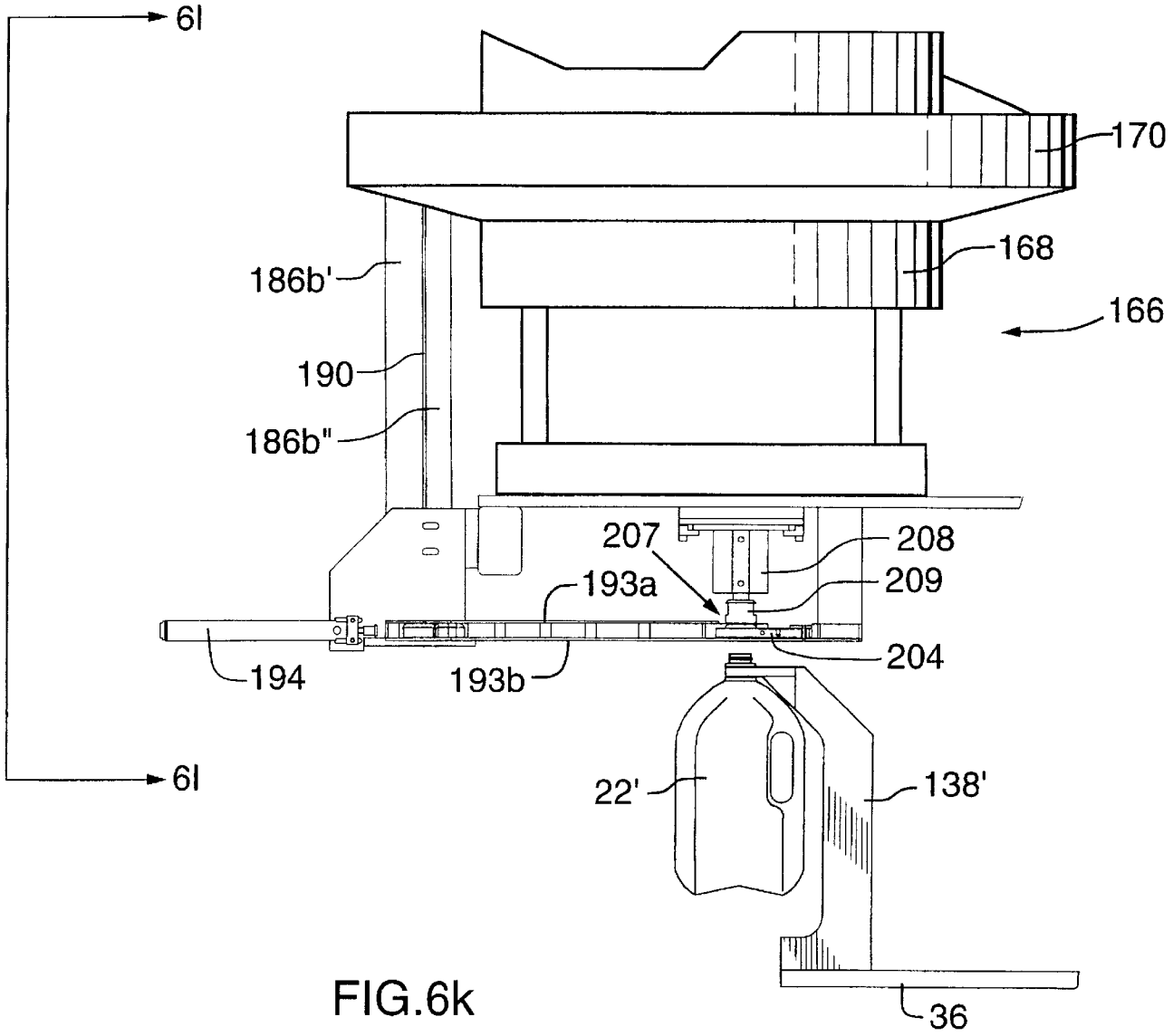
FIG. 6*k* is a side elevation view, partly in phantom outline, along sight line 6*k*—6*k* of FIG. 6*a;*
Figure 6I:
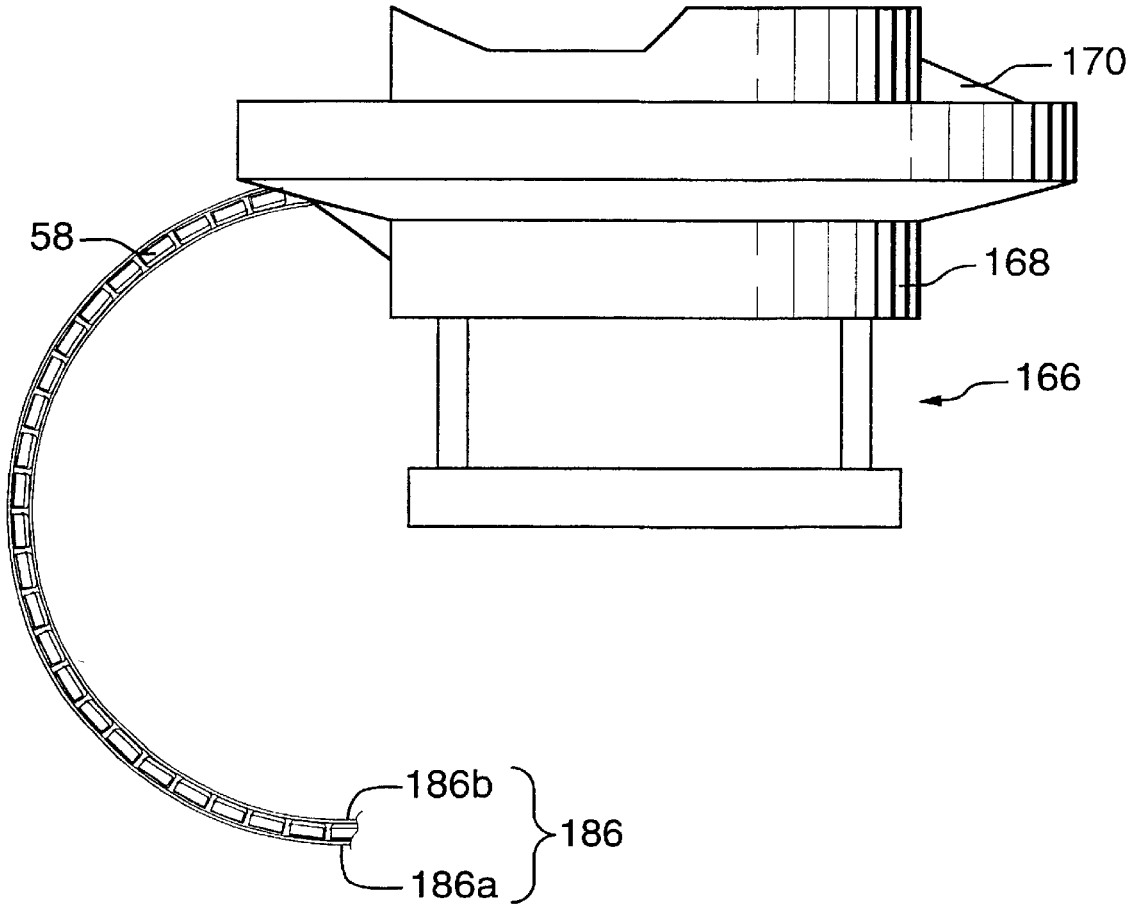
Figure 6M:
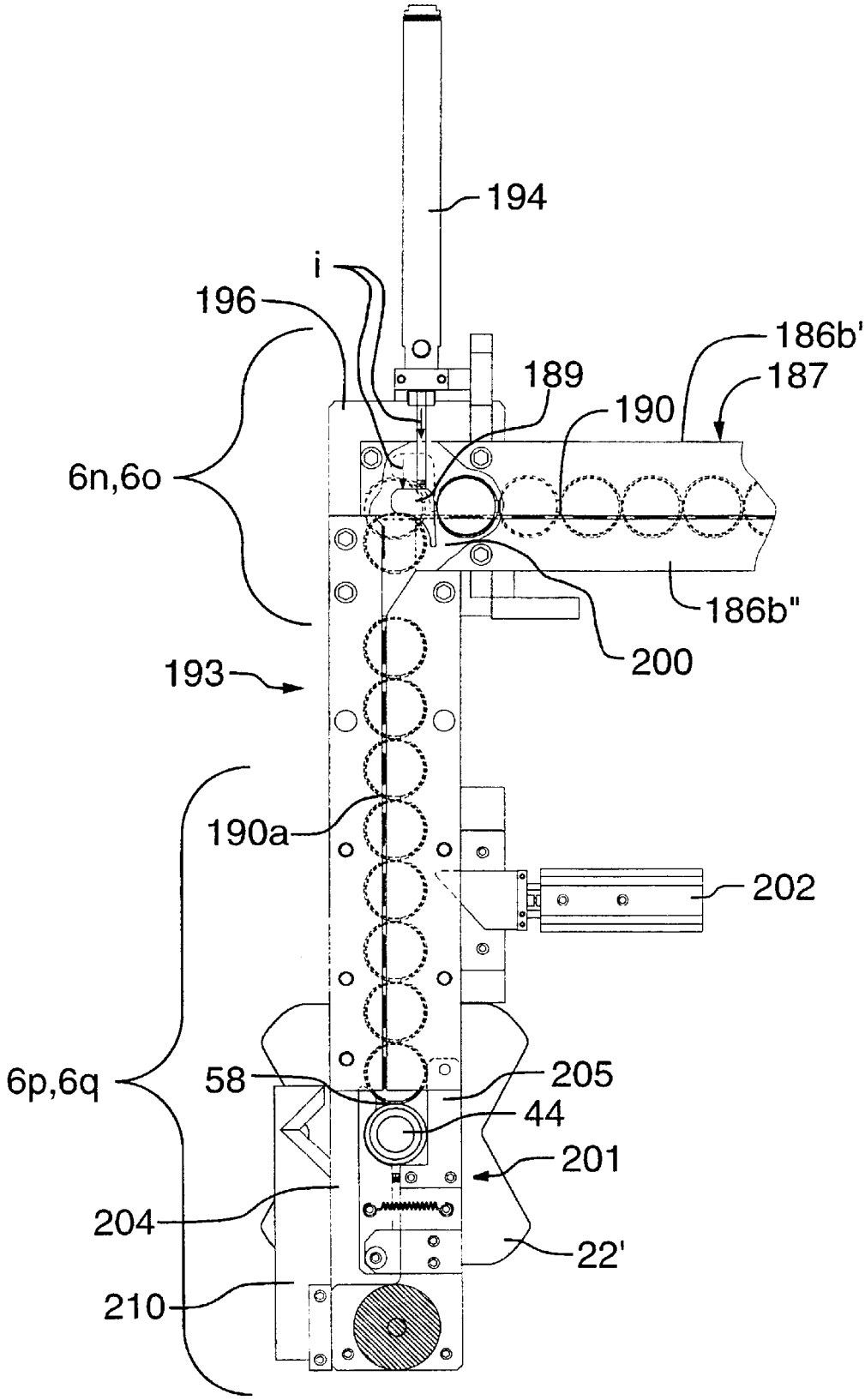
FIG. 6*m* is a top plan view on an enlarged scale, of a left portion of FIG. 6*g,* with a portion of the apparatus cutaway for purposes of illustration.
Figure 6O:
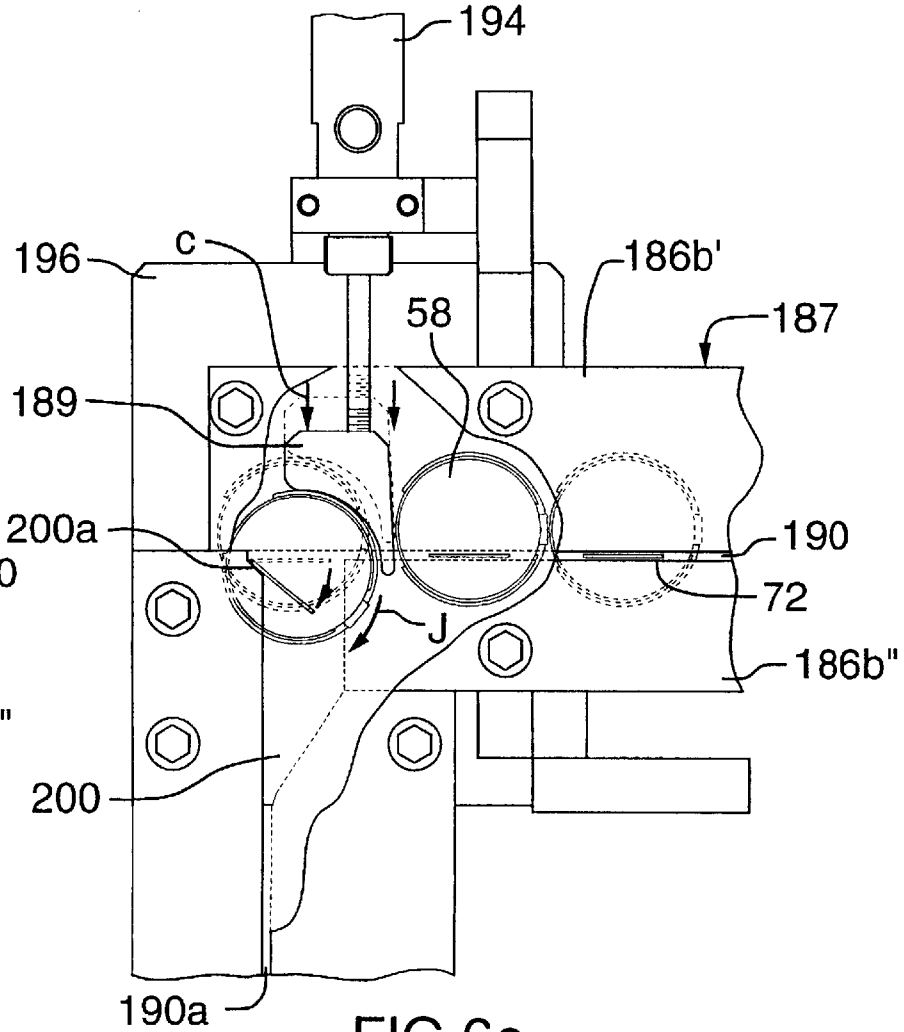
FIG. 6*o* is a view similar to FIG. 6*n;*
Figure 6N:
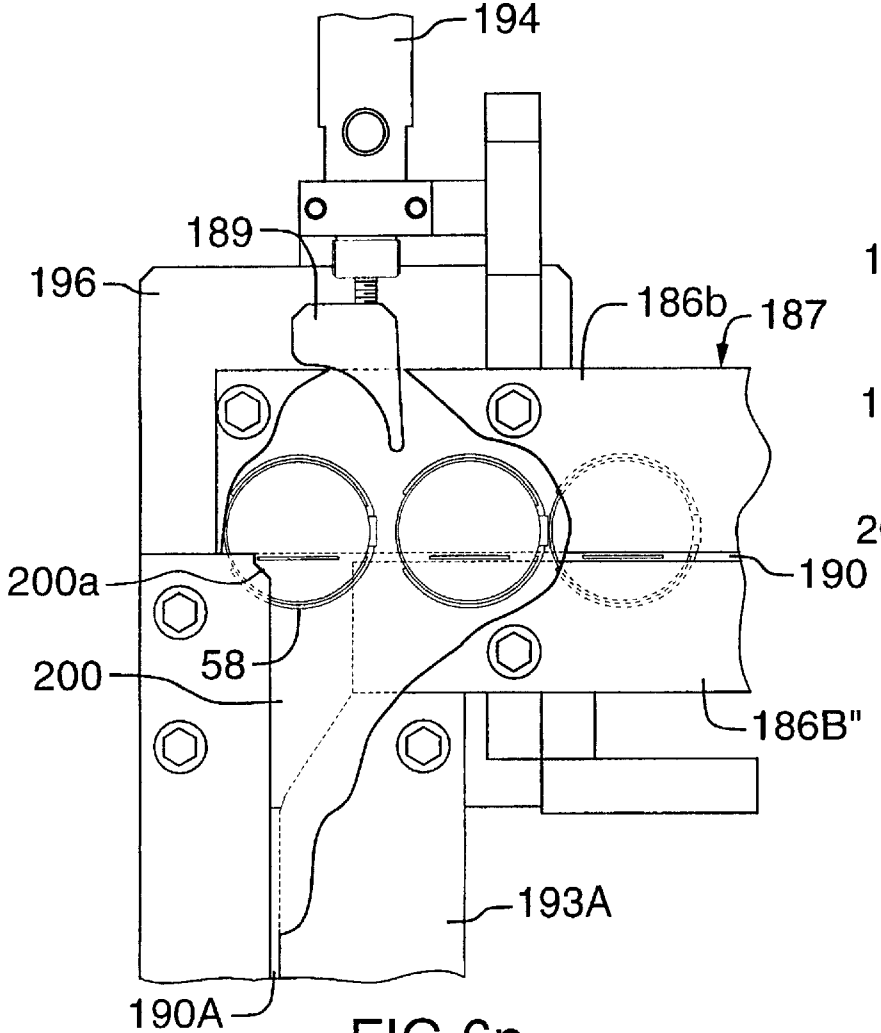
FIG. 6*n* is an enlarged view of the area contained within the brackets designated 6*n,* and 6*o* of FIG. 6*m;*
Figure 6Q:
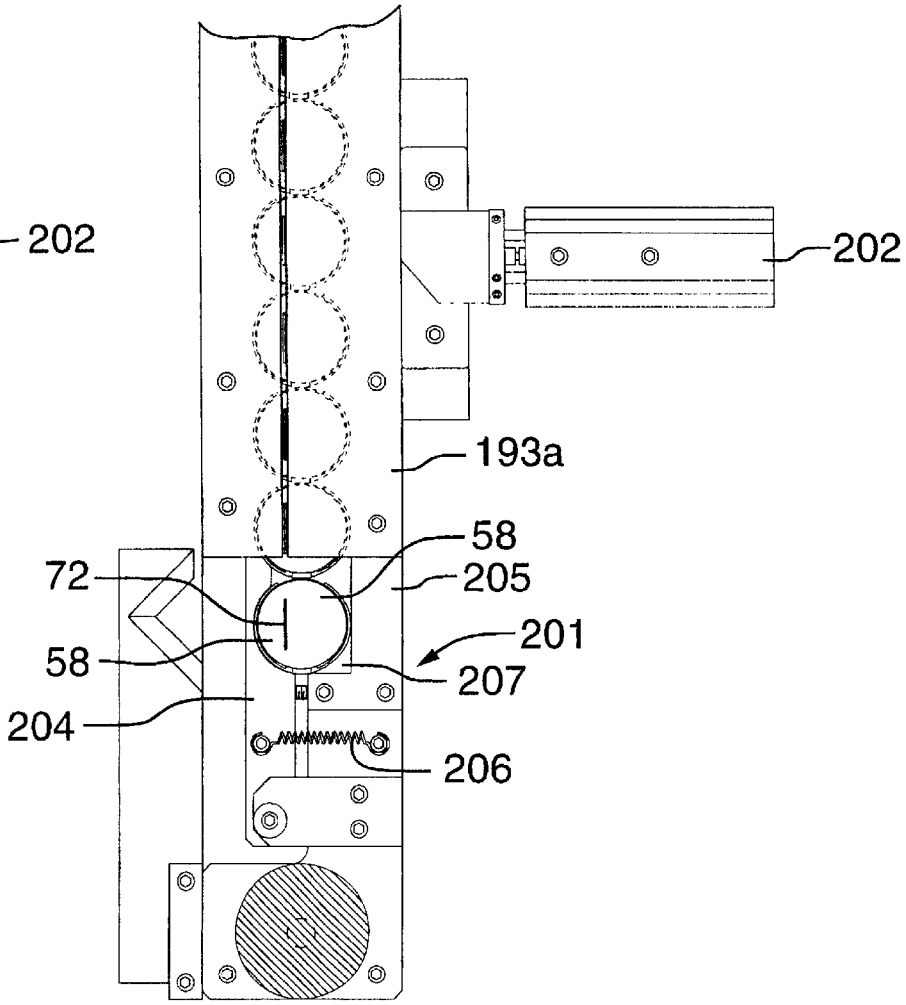
FIG. 6*q* is a view similar to FIG. 6*p;*
Figure 6P:
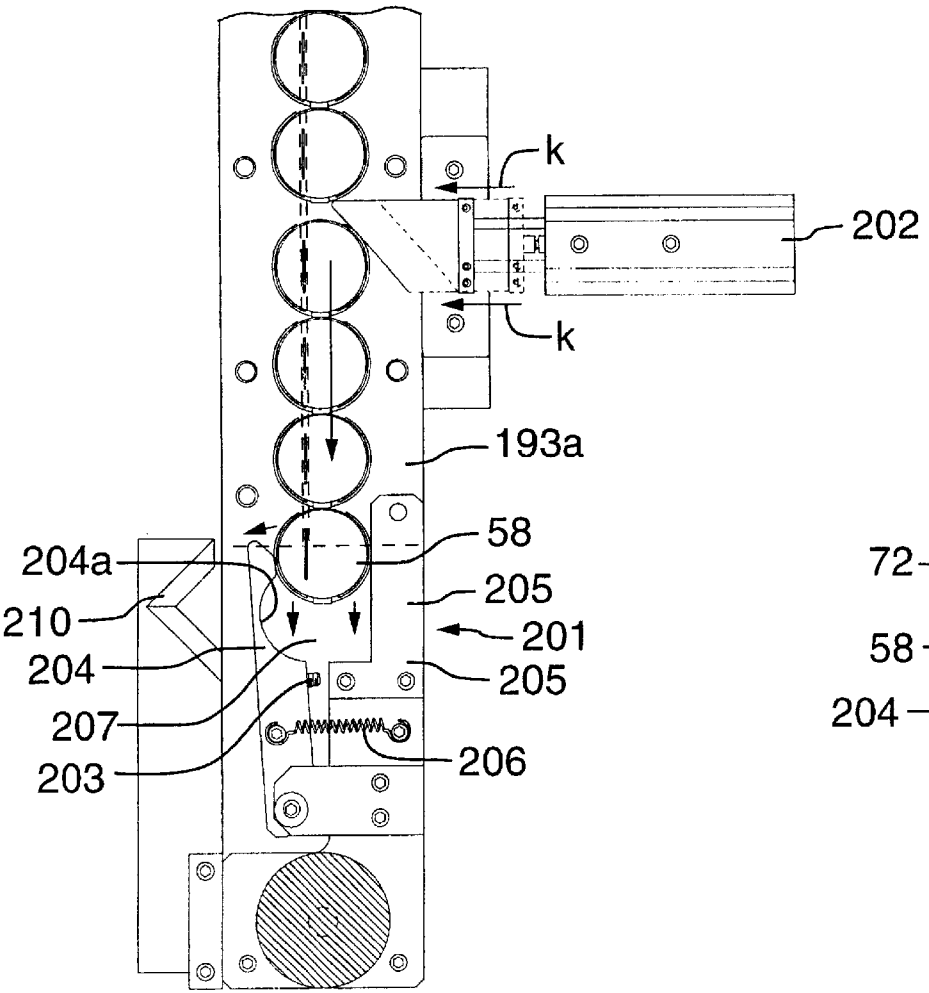
FIG. 6*p* is an enlarged view of the area contained within the brackets designated 6*p* and 6*q* of FIG. 6*m;*
Figure 6R:
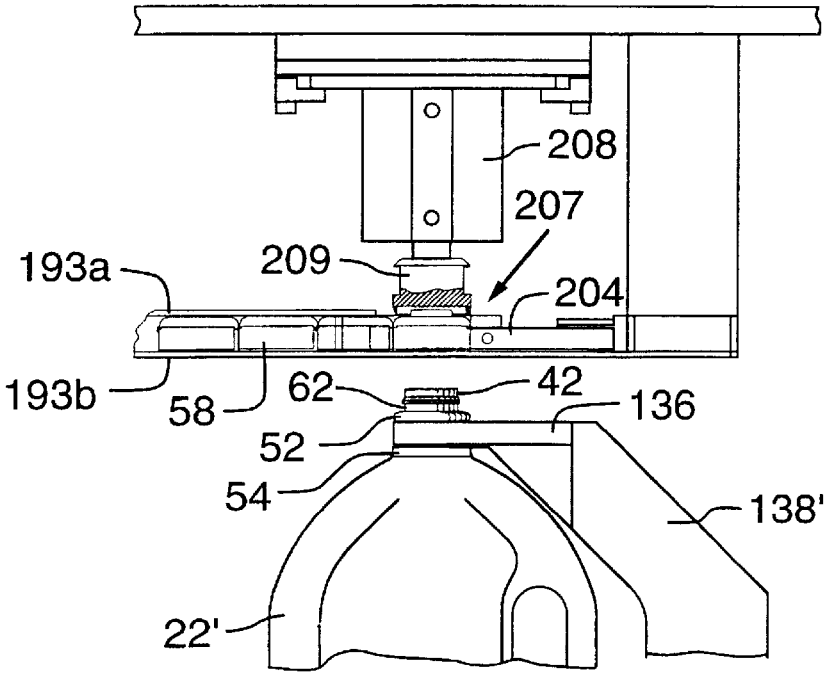
FIG. 6*r* is a side elevational view of the selected collapsible plastic container at the capping station, as viewed along sight line 6*r*–*r* of FIG. 6~ with the capping plunger shown in a raised configuration.
Figure 6S:
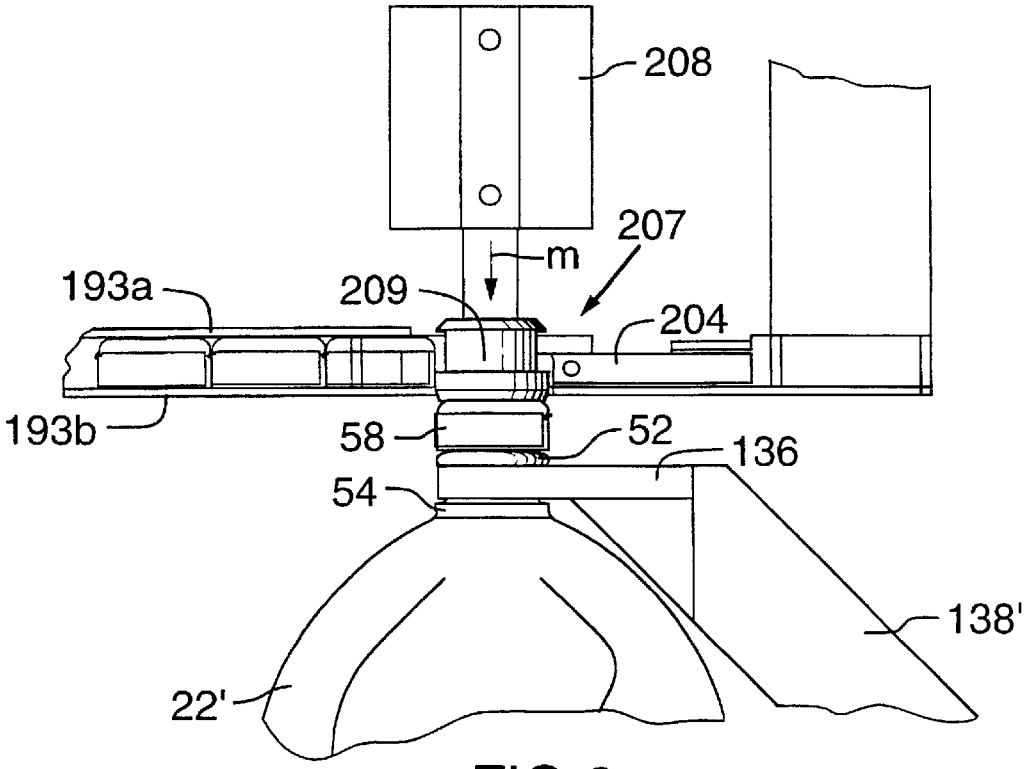
FIG. 6*s* is a view similar to FIG. 6*r,* with the capping plunger shown in a lowered configuration.
Figure 6T:
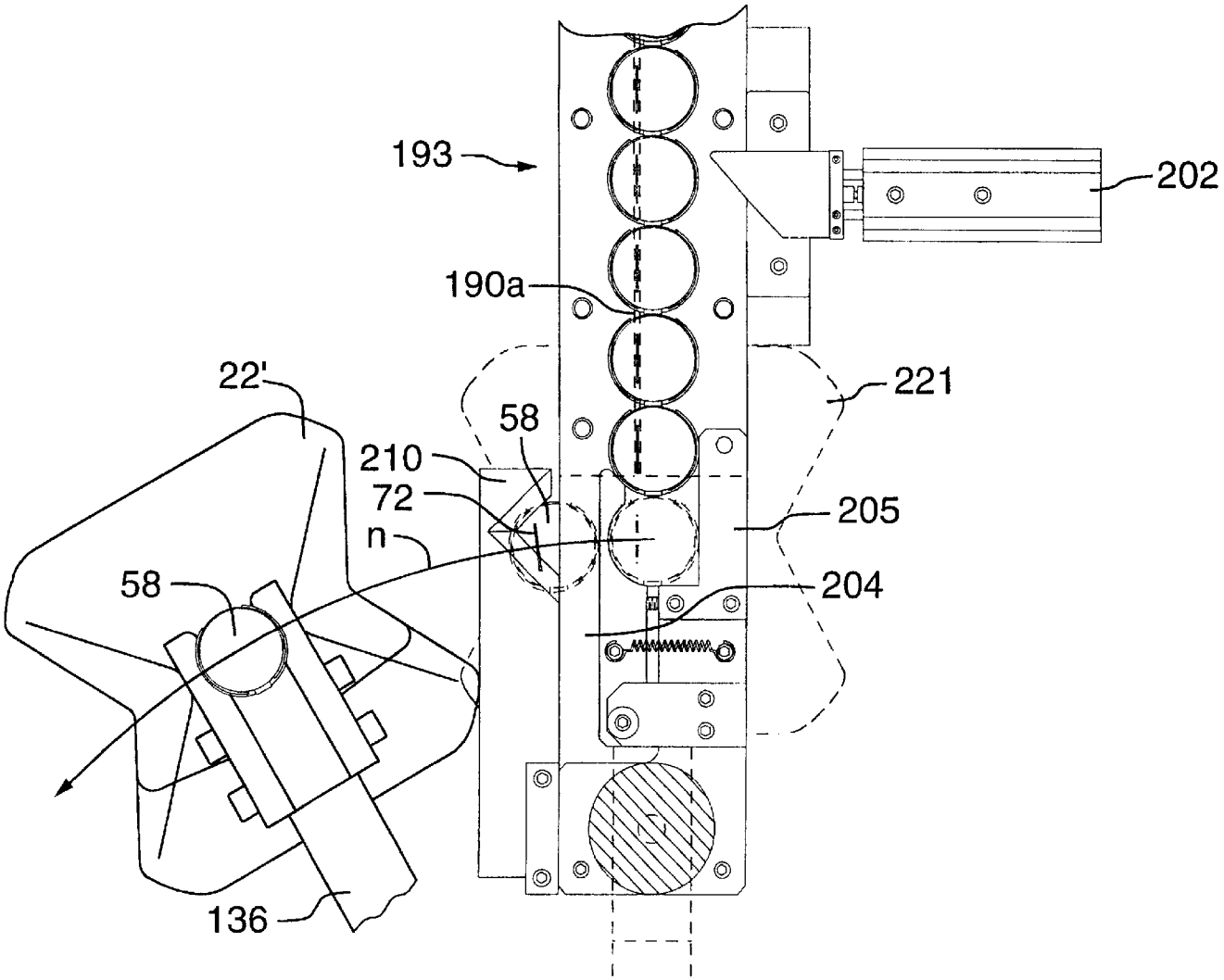
FIG. 6*t* is a top plan view of the selected collapsible plastic container, with closure cap applied, during initial translation by the translation means from the capping station toward the collapsing station.

The capping station 30, which fits the non-collapsible neck portion 42 of the selected collapsible plastic container 221 with a closure cap member 58, is detailed more fully in FIGS. 6 through 6*t*, inclusive. The capping station 30 comprises a modified cap vibrator 166, an unmodified version being comprised of, for example, a Syntron™ cap vibrator hopper Model No. B10090 and a Feeder™ spiral track portion Model No. EB172, both available from Food Machinery Corporation of Chicago, Ill., U.S.A. Closure caps 58 as previously described are introduced into the cap vibrator hopper 168. Vibrational forces transport the closure cap members 58 in a conventional manner along an upwardly climbing spiral track portion 170 of the vibrator 166 into a cap orientation area 182, as indicated by arrows "q" in FIGS. 6*a* and 6*b*. The spiral track portion 170 is angled downwardly, toward the outside of the cap vibrator 166, as best seen in FIGS. 6*d*–6*f*, 6*i* and 6*j*.

As shown in greater detail in FIGS. 6*c* through 6*f* and 6*i* and 6*j*, ejection means, designated by the general reference 172, are provided for discarding closure caps 58 which are aligned in the incorrect, that is to say, in the upside down orientation, said discarded closure caps 58 being redirected downwardly back into the cap vibrator hopper portion 168.

More specifically, said ejection means 172 comprises a tapered ramp insert strip 174 which is tapered, at its approach upwardly in thickness, becoming thicker with height and tapering downwardly at its outermost periphery, a curved wall portion 176, and a straight wall portion 177. The tapered ramp insert strip 174 functions as a ramp compensation means to modify the cap vibrator 166 to enable handling of the particular closure caps 58 utilized in the present method and apparatus. To understand the operation of the ejection means 172 more fully, it must be considered that any particular closure cap 58 vibrating its way up the spiral track portion 170 can have any one of three general orientations; that is, it may be oriented on the side edge of the rim portion 63, as exemplified by the closure cap 58' in FIG. 6*b*; it may be oriented with its upstanding elongate rib 72 facing upwardly, as exemplified by the closure cap 581" in FIGS. 6*a* through 6*f*, inclusively; or, it may be oriented with its upstanding elongate rib 72 facing downwardly, as exemplified by the closure cap 58'" in FIGS. 6*g* through 6*j*, inclusive. It is only those closure caps 58 that have this latter downwardly facing orientation that will pass through the cap orientation area 182 and pass by the ejection means 172 so as to thereafter be press-fitted onto the neck portion 42 of a selected collapsible plastic container 22'. Closure caps 58 having the aforementioned side edge or the upwardly facing orientations will be ejected back into the cap receiving hopper 168 of the cap vibrator means 166, in a manner now to be described.

Referring specifically to FIG. 6*b*, there will be seen the aforesaid closure cap 58' entering into the cap orientation area 182. As the closure cap 58' is on its side edge, its vertical height is higher than the vertical height of the curved wall portion 176 (which extends backwardly down the spiral track portion 170 to the cap receiving hopper 168), such that the random vibratory motion generated by the cap vibrator means 166 causes closure caps 58' having this orientation to flip over the curved wall portion 176 back into the cap receiving hopper 168, as indicated by the phantom outline of cap 58' and arrow "g" in FIG. 6*b*.

Referring specifically to FIGS. 6*a* through 6*f*, there will be seen a closure cap 58" oriented with its upstanding elongate rib 72 facing upwardly. As the closure cap 58" moves up the spiral track portion 170, its leading edge rides up over the tapered strip 174, as shown in FIG. 6*d*. Continued movement causes the closure cap 58" to clear the curved wall portion 176 so as to come into contact with the straight wall portion 177, as sequentially shown in phantom outline in FIGS. 6*b* and 6*c*, and in solid outline in FIGS. 6*d* and 6*e*. The closure cap 58" continues to move along the straight wall portion 177 to its end face 178, whereat it slides back into the cap receiving hopper 168, as indicated by arrow "h" in each of FIGS. 6*b*, 6*b*, 6*c*, and 6*f*.

Referring specifically to FIGS. 6*g* through 6*j*, there will be seen a closure cap 58'" oriented with its elongate rib 72 facing downwardly. As the closure cap 58'" moves up the spiral track portion 170, its leading edge rides up over the tapered strip 174, as shown in FIG. 6*i*. Continued movement causes the closure cap 58'" to clear the curved wall portion 176 so as to come into contact with the straight wall portion 177, as sequentially shown in phantom outline in FIGS. 6*j*, and in solid outline in FIGS. 6*i* and 6*j*. However, it will be noted, as best seen in FIG. 6*j*, that when the closure cap 58'" is in contact with the straight wall portion 177, the elongate rib 72 is also in retaining contact with a lateral edge 179 of the tapered strip 174. This retaining contact allows the closure cap 58'" to continue moving up the spiral track portion 170, even after the closure cap 58'" clears the end face 178 of the straight wall portion 177, thereby preventing closure caps 58 having the proper orientation (ie. Similar to that of 58'") from falling back into the cap receiving hopper 168. Thus, it will be noted in, for example, in FIG. 6*h*, that all of the closure caps 58 shown upstream of the cap orientation area 182 have the same general orientation on the spiral track portion 170 as the closure cap 58'", i.e, their elongate indexing rib 72 is facing downwardly relative to the spiral track portion 170.

From the cap orientation area 182, the closure caps 58 continue upwardly along the spiral track portion 170 in the direction of arrow "q" to a second ejection means 183. It will be appreciated that, of the closure caps 58 approaching the second ejection means 183, some may be in the correct orientation (i.e., with their elongate indexing rib 72 facing downwardly), but still be 180 degrees out of the correct circumferential orientation shown in FIGS. 6*i* and 6*j*. This is possible because of the eccentric placement of the elongate indexing rib 72 on each closure cap 58 as previously described, and is significant for subsequent mechanized handling of the closure cap 58 at the capping station 30. Accordingly, the purpose of the second ejection means 183, is to eject back to the cap receiving hopper 168 those of the closure caps 58 entering the second ejection means 183 with the correct top to bottom orientation previously described, but without the proper circumferential orientation shown in FIGS. 6*i* and 6*j*. A secondary purpose of the second ejection means 183 is to begin the descent, in fully indexed relation, of the closure caps 58 from their position atop the cap vibrator 166 down to the level of the capping station 30, where they will be applied in seriatim to the non-collapsible neck portion 42 of an awaiting selected collapsible plastic container 22'. To this end, each closure cap 58 enters the second ejection means 183 with its elongate indexing ridge 72 in frictional aligned contact with the edge 179 of the tapered strip 174. The edge 179 is aligned to continue within the second ejection means 183 as an edge 184, which edge 184 guides the closure cap through the second ejection means 183 to an enlarged open area 185, which area 185 is shown as opening to above and to below. In this open area 185, a support ledge 181 supports only those closure caps 58 which are correctly oriented in the circumferential sense. Those closure caps 58 that are 180 degrees out of circumferential orientation are eccentrically positioned on the ledge, with the result that they are not fully supported by the ledge. Accordingly, the improperly oriented closure caps 58 fall from the ledge 181, through the open area 185 and back returned to the cap vibrating hopper 168.

Those of the closure caps 58 having a completely correct orientation for capping, proceed from the second ejection means 183 into a first cap track section 186 which is C-shaped in elevation, as best seen from FIG. 6*l*. The first cap track section 186 is comprised of an upper 186*a* and a lower 186*b* track plate, which plates together define a curved channel in which the closure caps 58 move from the second ejection means 183 into a second cap track section 187 positioned in a lower horizontal plane. The lower track plate 186*b* is, in actuality, made up of two mirror image plates 186*b*', 186*b*", separated one from the other by a slot 190, which slot 190 is linearly aligned with the edge 184 of the second ejection means 183, so as to provide an indexing pathway for the elongate indexing ribs 72 of the closure caps 58 as they make their way from the second ejection means 183 to the capping station 30. In making the transition from the second ejection means 183 to the second cap track section 187, it will be appreciated that the closure caps 58 have been inverted in orientation, so that the elongate indexing rib 72 of each closure cap in the second cap track section 187 is facing upwardly.

The closure caps 58 travel horizontally along the second cap track section 187 to a right-angled bend 196, (see especially FIGS. 6*m,* 6*n* and 6*o*), whereupon they enter into a third cap track section 193, which third section 193 is also generally horizontally oriented. The third cap track section 193 is constructed similarly to the second cap track section 187 of upper 193*a* and lower 193*b* track plates and to define a continuation 190*a* of the slot 190, which slot 190 is widened in the proximity of the bend 196 to define a turning vestibule 200. A horizontally disposed, pneumatically actuated and computer controlled ram 194 is provided to assist movement of the closure caps 58 around the right-angled portion 196. The ram 194 defines at the outermost end thereof, a precisely toleranced head 189 which, in cooperation with an angle edge 200*a* of the vestibule 200, is functional upon actuation thereof (as indicated by the arrows "i" of FIGS. 6*m* and 6*o*) to advance and rotate each closure cap 58 (as indicated by arrows "j" of FIG. 6*o*) to the desired orientation whereat the elongate indexing rib 72 is maintained in the continuation 190*a* of slot 190 which is defined as aforesaid in the third cap track section 193.

After making their way around the right-angled bend 196, the closure caps 58 make their way along the third cap track section 193 toward the capping station 30. A horizontally disposed pneumatically actuated and computer controlled ram assembly 202, positioned between upper 193*a* and lower 193*b* track plates, is provided for interacting with the final four cap members 58 (as indicated by arrows "k" in FIG. 6*p*) aligned in the continuation slot 190*a* as they approach the capping station 30. (See FIGS. 6*m,* 6*p* and 6*q*.) This interaction provides the drive energy for a cap positioning means 201, which means 201 acts to effect a precise positioning of each closure cap 58 at a capping site 207 located above the neck portion 42 of the selected collapsible plastic container 22' when such container is positioned in the capping station 30, as shown in FIG. 6*k*. The cap positioning means 201, in the present embodiment, takes the mechanical equivalency of a pivotally mounted swing arm 204, having an arcuately curved gripping surface 204*a*. The swing arm 204 cooperates with a gripping block 205, and is biased toward the block 205 by a spring means 206, which assembly is operative to firmly secure the closure member 58 between the gripping surface 204*a* and the gripping block 205 when a closure cap 58 is pushed therebetween upon advancement urged by movement as aforesaid of the ram assembly 202. A set screw 203 on the swing arm 204 can be advantageously provided to adjust the degree of closure of the swing arm 204 against the closure cap 58.

As seen in FIGS. 6*k*, 6*r* and 6*s,* once a closure cap 58 is firmly held in indexed, clamped relation in the cap positioning means 201 at the capping site 207, a pneumatic capping ram 208 lowers a capping plunger 209, under timed control of the CPU computer means (not shown), from its raised configuration shown in FIG. 6*n* into urging contact with the closure cap 58, in its lowered configuration, as indicated by arrow "m" in FIG. 6*s*. This movement applies a downwardly directed compression force to the closure cap 58, thereby causing a firm interference fit between the lower annular edge 60 of the closure cap 58 and the annular rib 62 of the non-collapsible neck portion 42 of the selected collapsible plastic container 22' in the manner previously described. The pneumatic capping ram 208 is then retracted upwardly in preparation for entry of the next closure cap 58 being urged into the capping site by sequential activation of the ram 202 by the computer CPU means (not shown). The selected collapsible plastic container 22' is now capped, and ready for translation to the collapsing station 32 of the apparatus 20, the closure cap 58 having been mechanically applied at the capping station 30 to the non-collapsible neck portion 42 in closed sealing relation to the opening 44 of the selected collapsible plastic container 22.

Before translating the selected collapsible plastic container 221 to the collapsing station 32, it is desirable to trim the elongate indexing rib 72 from the closure cap 58 that has been applied as aforesaid to the non-collapsible neck portion 42 of the selected collapsible plastic container 22', as it no longer serves a useful function within the confines of the present process and apparatus. For this purpose, a stationary V-shaped blade 210 is rigidly mounted adjacent the capping site 207, as best seen in FIG. 6*t,* which blade 210 is vertically positioned to sever the elongate indexing rib 72 from the uppermost surface of the hinged lid portion 64 of the closure cap 58 as it is translated by the carousel means 36 from the capping station 30 to the collapsing station 32, such motion being indicated by arrow "n" in FIG. 6*t*. The sequential positioning of the closure cap 58 as it passes toward and under the blade 210 is also shown in phantom outline in FIG. 6*t*. The severed elongate rib 72 passages over the top of the blade 210 and falls into a collection bin or similar disposal means (not shown), such disposal means forming no part of the present invention.

Figure 7:
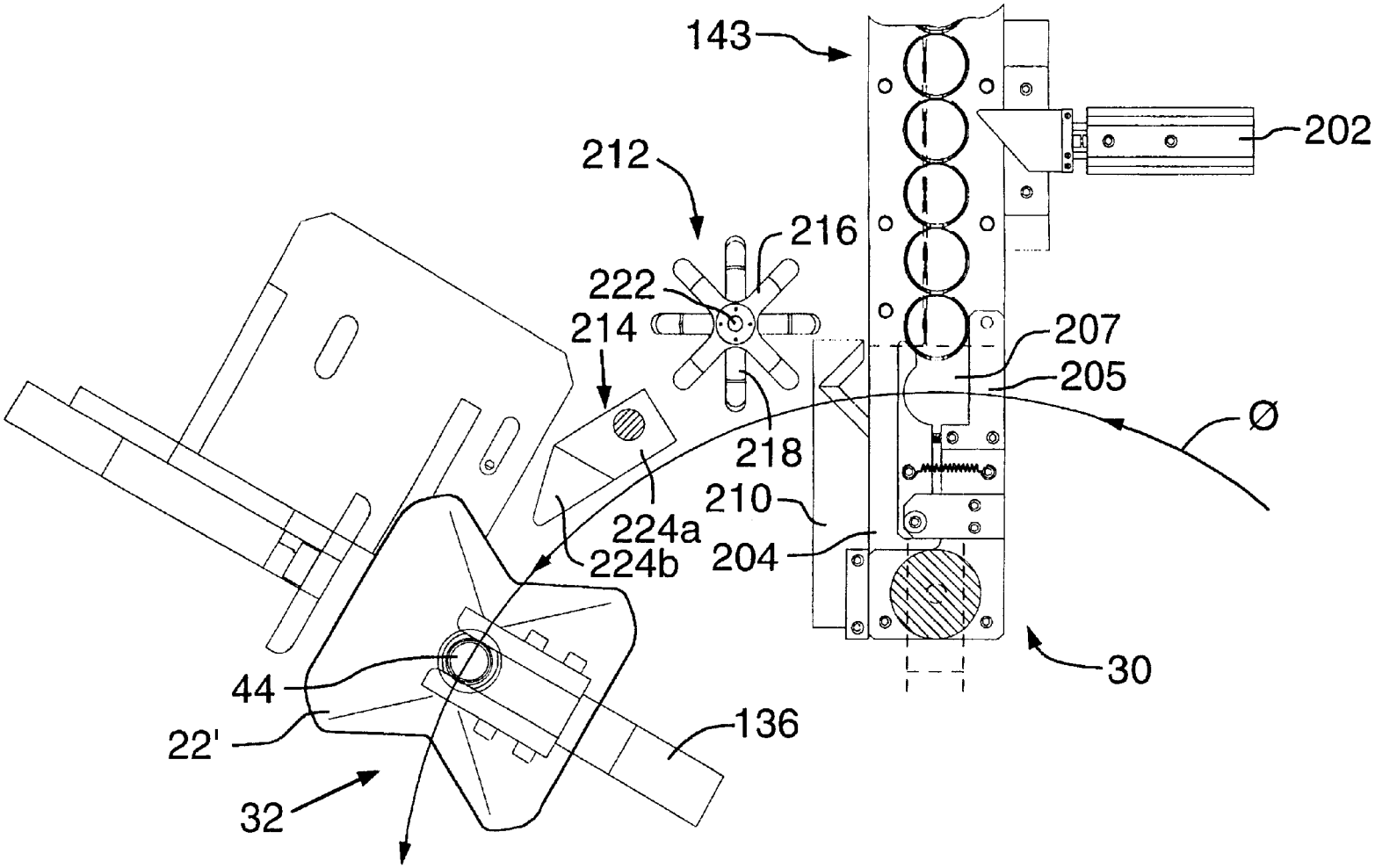
FIG. 7 is a top plan view of the radial sector of the apparatus defined by arced sight line 7—7 of FIG. 1*c,* showing the selected collapsible plastic container at the collapsing station.

As shown in FIG. 7, the selected collapsible plastic container 22' is translated in the direction of arrow "o" utilizing indexed rotation of the computer controlled carousel means 36 from the capping station 30 to the collapsing station 32, having advanced past a first portion 212 of a cap opening means and thence past a second portion 214 of a cap opening means. The first portion 212 of the cap opening means cooperates to initiate opening of the closure cap 58 applied to the selected collapsible plastic container 22' at the capping station 30 through interaction between the first portion 212 with the translation/carousel means 36 and with the closure cap 58 upon rotary indexing of the selected collapsible plastic container 22' from the capping station 30 to the collapsing station 32. Similarly, the second portion 214 of the cap opening means is functional to complete opening of the hinged lid portion 64 relative to the fixed rim portion 63, as the selected plastic container 22', with the closure cap 58 applied, passes by en route to the collapsing station 32.

Figure 7A:
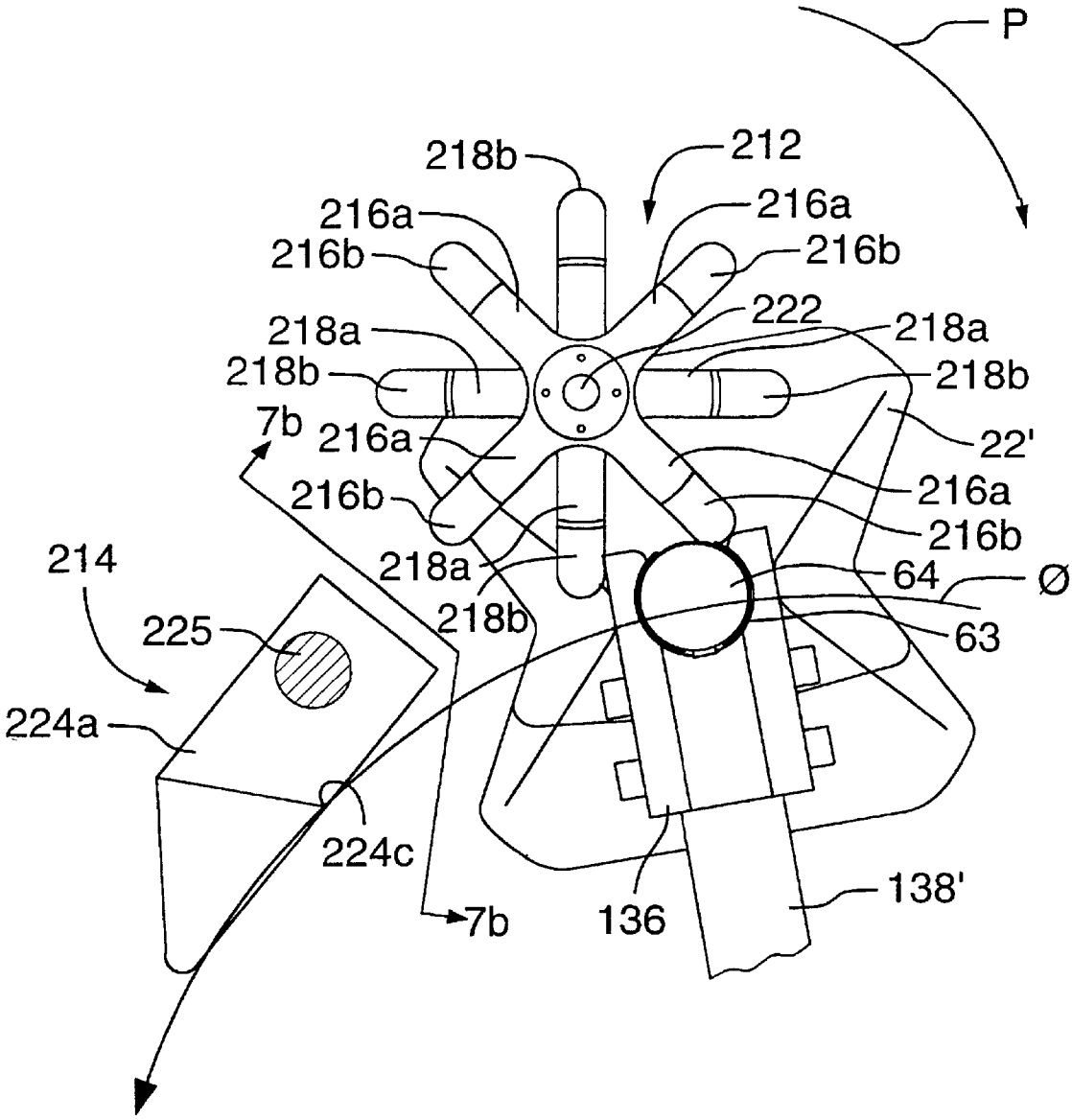
FIG. 7*a* is a top plan view of a portion of FIG. 7, on an enlarged scale, showing a first portion of the cap opening means initiating opening of the closure cap applied to the selected collapsible plastic container at the capping station through interaction of the cap opening means with the translation means and the cap closure upon rotary indexing of the selected container from the capping station to the collapsing station.
Figure 7B:
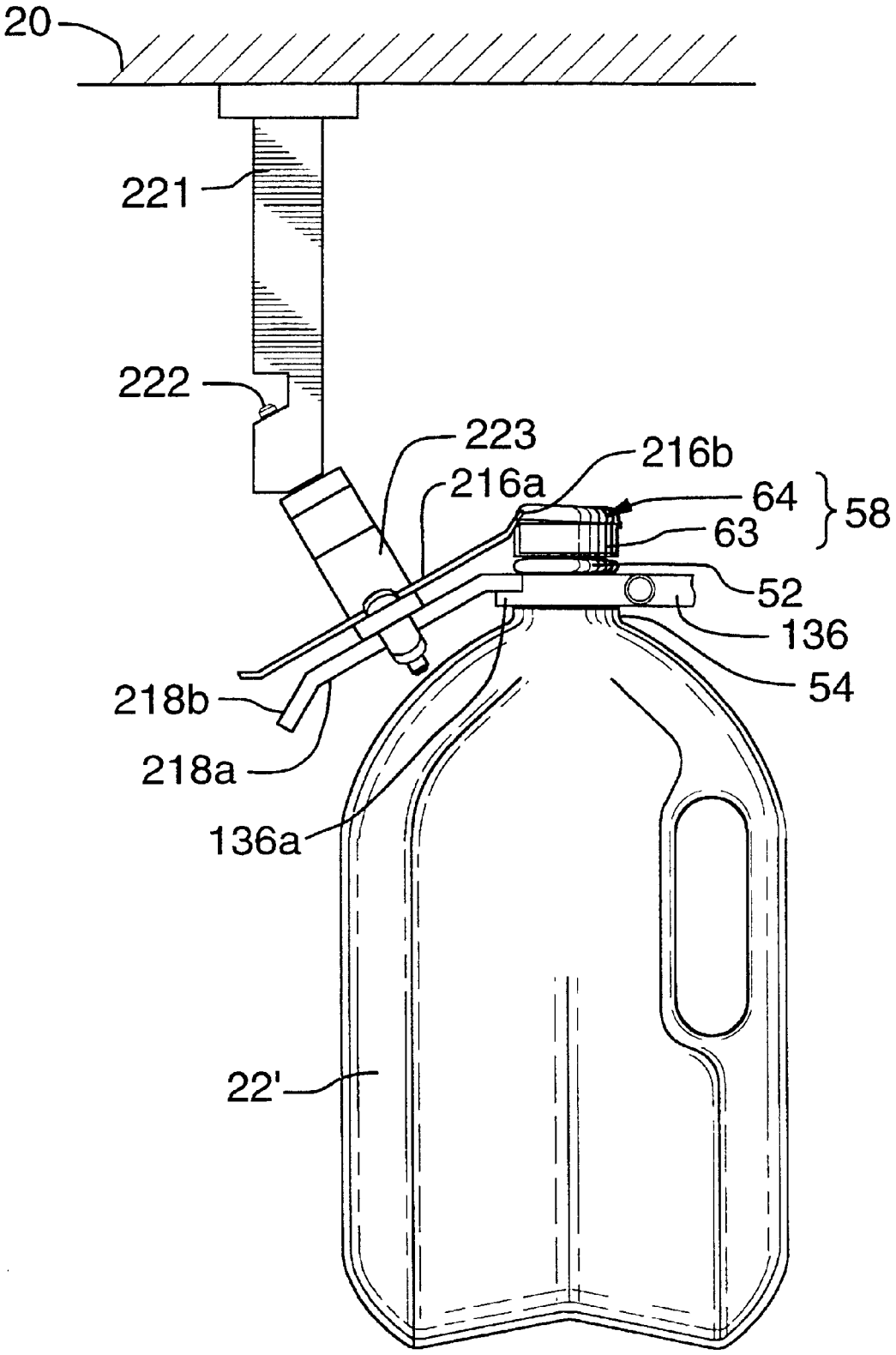
FIG. 7*b* is a side elevational view along broken sight line 7*b*—7*b* of FIG. 7*a;*
Figure 7C:
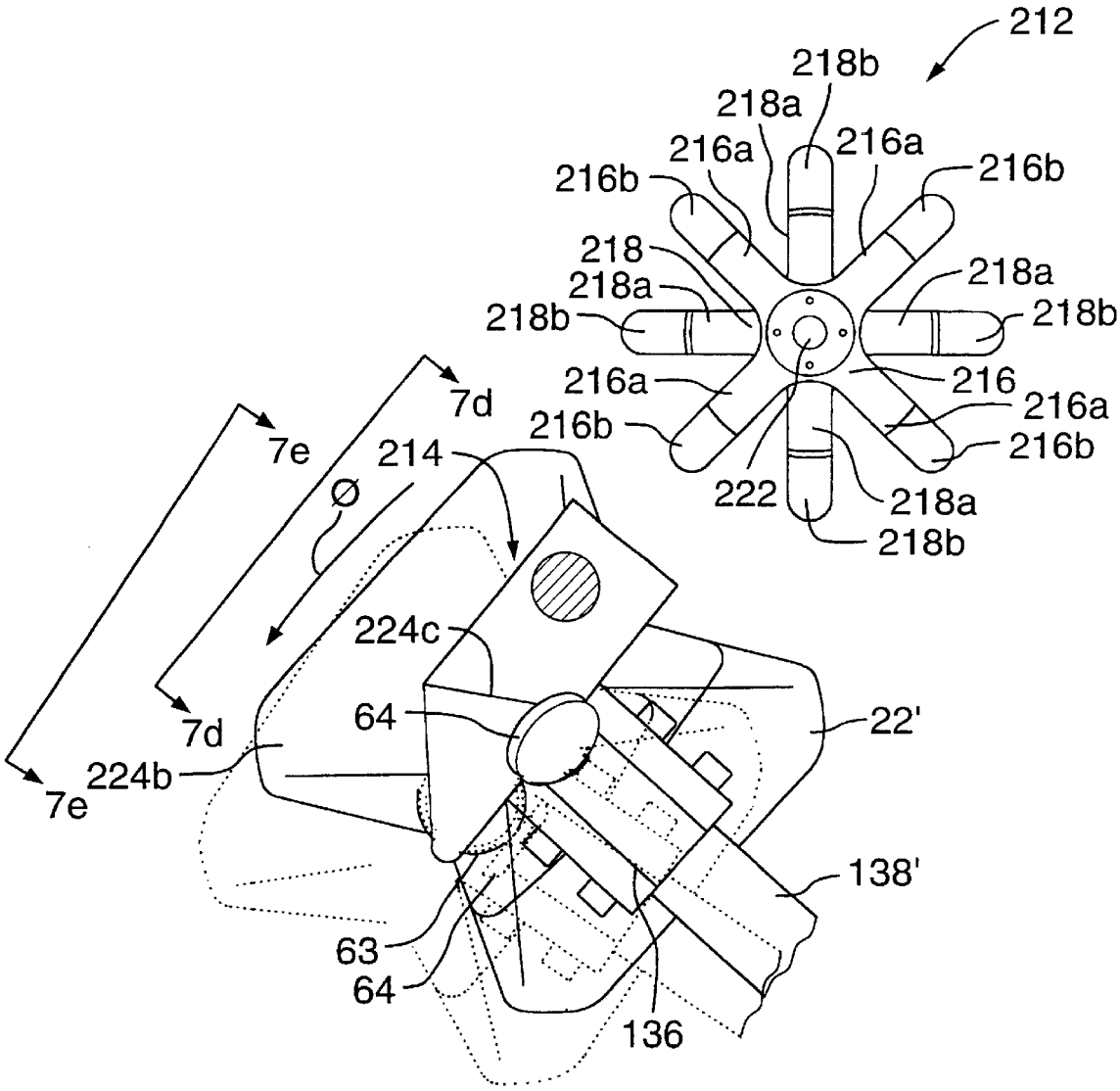
FIG. 7*c* is a top plan view similar to FIG. 7*a,* showing a second portion of the cap opening means carrying out further opening of the closure cap during rotary indexing of the selected collapsible plastic container from the capping station to the collapsing station.
Figure 7D:
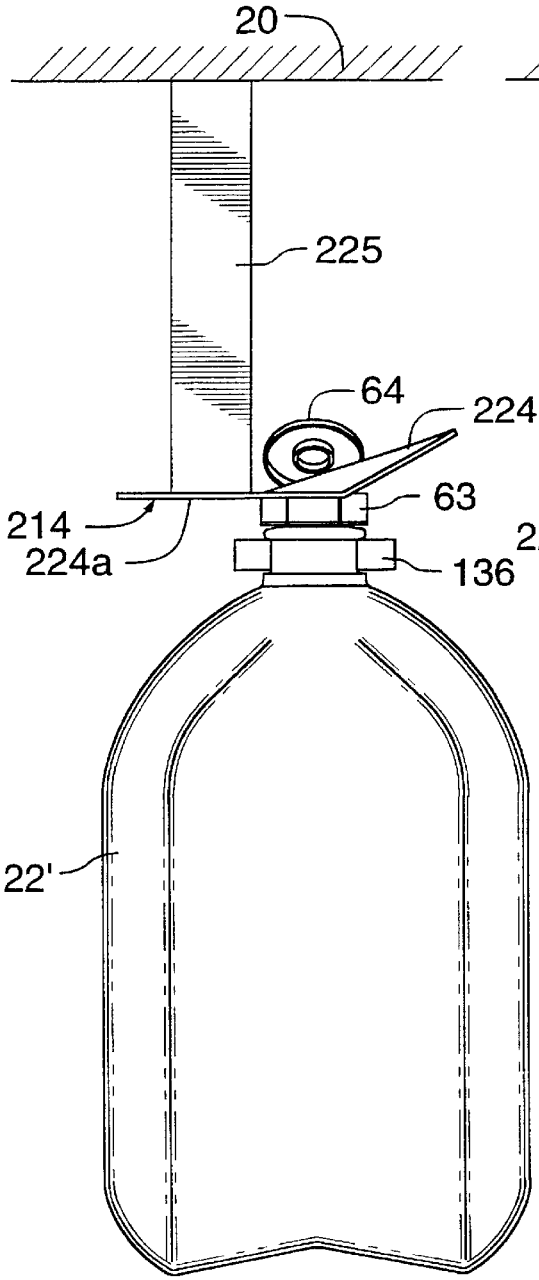
FIG. 7*d* is a side elevational view along sight line 7*d* of FIG. 7*c;*
Figure 7E:
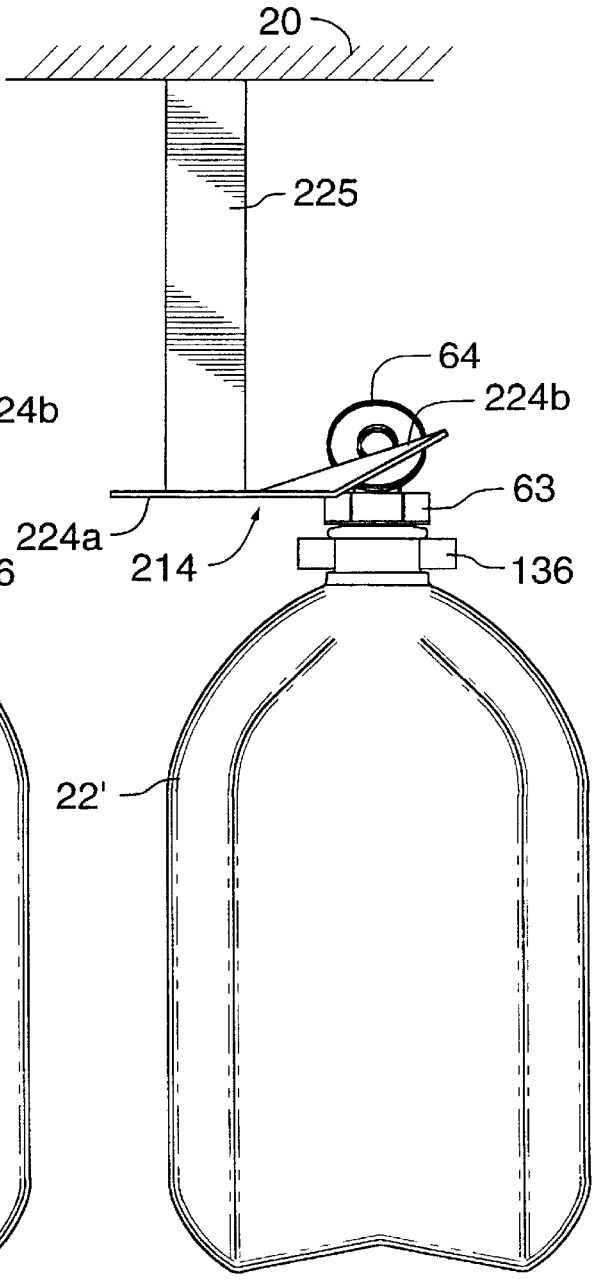
FIG. 7*e* is a side elevational view along sight line is 7*e*—7*e* of FIG. 7*c,* with the rotary indexing of the indexing of the selected collapsible plastic container having progressed to the point where the second portion of the cap opening means is completing opening of the closure cap.

More specifically, and with particular reference to FIGS. 7 through 7*e*, the first portion 212 of the cap opening means comprises two four point spurs 216, 218, with each spur being commonly and rigidly mounted on a central axle 222 for rotation therewith. The axle 222 freewheels in an axle mount 223, which axle mount 223 is rigidly mounted on a frame support 221, which support is itself rigidly mounted to the apparatus 20. (See FIG. 7*b*.) The first spur 216 is mounted on the axle 222 above the second spur 218, and the four blades 216*a* of the first spur 216 are staggered with respect to the four blades 218*a* of the second spur 218 approximately 45 degrees of rotation, for reasons which will become apparent as this description proceeds. The upper four blades 216*a* are curved slightly upwardly at each of their tips 216*b*, and the tips 218*b* of the lower four blades 218*a*, which blades 218*a* are somewhat more robust than the upper blades 216*a*, are curved slightly downwardly, as best seen in FIG. 7*b*. The second spur 218 acts as a driving spur for the first spur 216 located above, acting through the common axis 222. That is, as the selected collapsible plastic container 22' is carried past the first portion of the cap opening means 212, along the path defined by arrow "o", a leading edge 136*a* of the U-shaped holding bracket 136 of the mount 138' gripping the non-collapsible neck portion 42, impinges upon the adjacent blade 218*a* of the second spur 218, to rotate same in the direction of arrow "p" of FIG. 7*a*. This rotation causes a concurrent rotation in the same direction of the next-following blade 216*a* of the first spur 216, whose tip 216*b* rides up under the hinged lid portion 64 of the closure cap 58(as best seen in FIGS. 7*a* and 7*b*), thus initiating opening of the lid portion 64 by hinged movement of the lid portion 64 in a first direction. The axle mount 223 contains a spring-loaded detent mechanisms (not shown), which mechanism ensures that a threshold degree of rotation of the second spur 218 occurs during each passage of a U-shaped holding bracket 136 by the first cap opening means 212, which threshold degree of rotation brings the next-following blade 218*a* of the second spur into position to repeat the initial opening step.

From its position of interacting with the first portion 212 of the cap opening means (as shown in FIGS. 7*a* and 7*b*), the selected collapsible plastic container 221 continues to be translated by the carousel means 36 along the path defined by arrow "o" to interact with the second cap opening portion 214 (as seen in FIGS. 7*c*, 7*d* and 7*e*). The second portion 214 of the cap opening means comprises a lifting blade 224 having a generally rectangular first section 224*a* lying in a horizontal plane, and an upwardly angled, generally triangular shaped second section 224*b*. It will be seen from FIG. 7*a* that the path defined by arrow "o" just intersects the line of convergence 224*c* of the first 224*a* and second 224*b* sections of the lifting blade 224. Moreover, as will be best appreciated from reviewing FIGS. 7*c* and 7*d*, the first section 224*a* is supported by support member 225 (which support member 225 is rigidly suspended from the device 20) in a horizontal plane which is generally level with the opening defined between the lid portion 64 and the underlying rim portion 63 of the closure cap 58, which opening has just been initiated by the first portion 212 of the cap opening means. Accordingly, the second section 224*b* is able to slide into said opening created between the lid portion 64 and the rim portion 63, such that progressive rotation of the selected collapsible plastic container 22' (and attached closure cap 58) in the direction of arrow "a" causes the underside of the lid portion 64 to ride up the incline of the upwardly angled second section 224*b* until the lid portion 64 reaches its fully open position, as depicted in FIG. 7*e* and in phantom outline in FIG. 7*c*. In this manner, and as stated earlier, the first and second cap opening means cooperate in combination to thereby fully open the closure cap 58.

Figure 8:
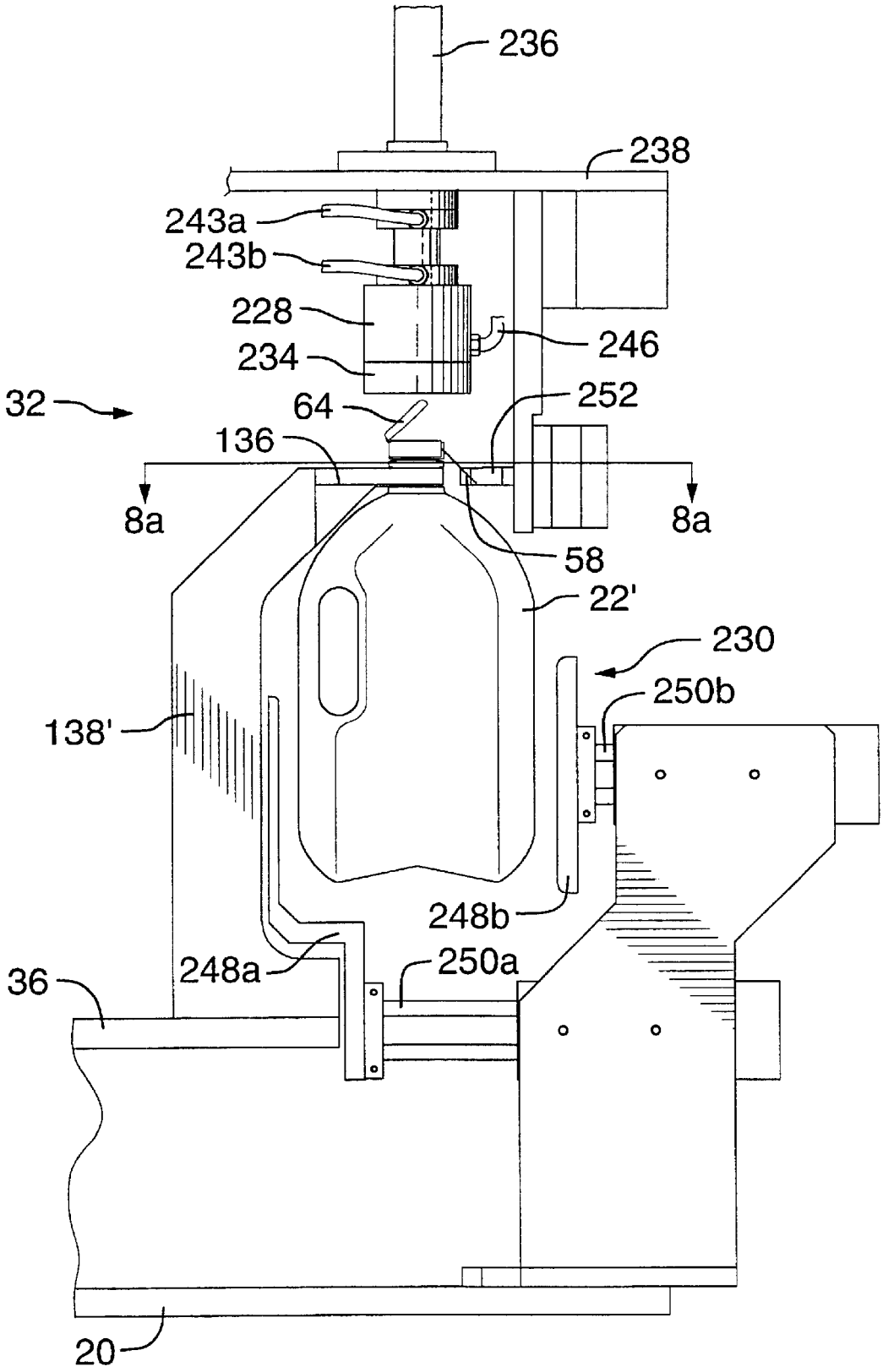
FIG. 8 is a side elevational view of the selected plastic container at the collapsing station as viewed along sight line 8—8 of FIG. 6.

The selected collapsible plastic container 22' is further translated by the carousel means 36 past the second cap opening portion 214 to momentarily stop in indexed relation for further mechanized handling at the collapsing station 32, as shown in FIG. 8. At the collapsing station 32, there is provided means for collapsing the selected collapsible plastic container 22' and for closing the lid portion 64 of the closure cap 58.

The collapsing and cap closing means 226 comprises, in combination, an evacuation head 228, a collapsing assembly, having the general reference number 230, and a cap closing means 232. The cap closing means 232 is integrated with the evacuation head 228 to function therewith in a sequenced manner, as described below.

Figure 8A:
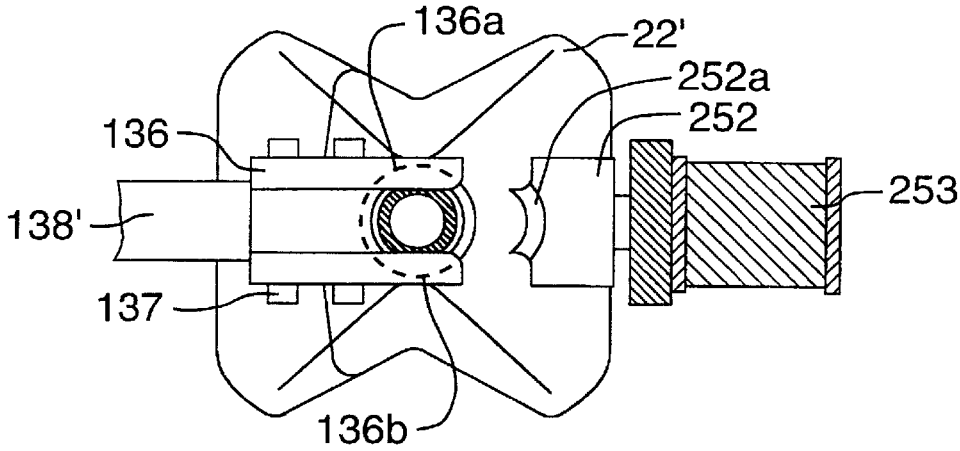
FIG. 8*a* is a top plan view (partly in section) along sight line 8*a*—8*a* of FIG. 8.
Figure 8C:
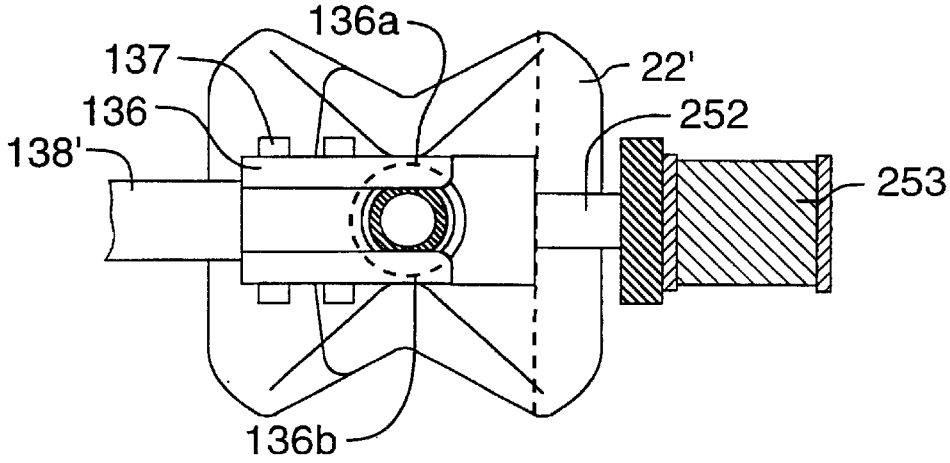
FIG. 8*c* is a top plan view(partly in section) along sight line 8*c*—8*c* of FIG. 8*b;*
Figure 8G:
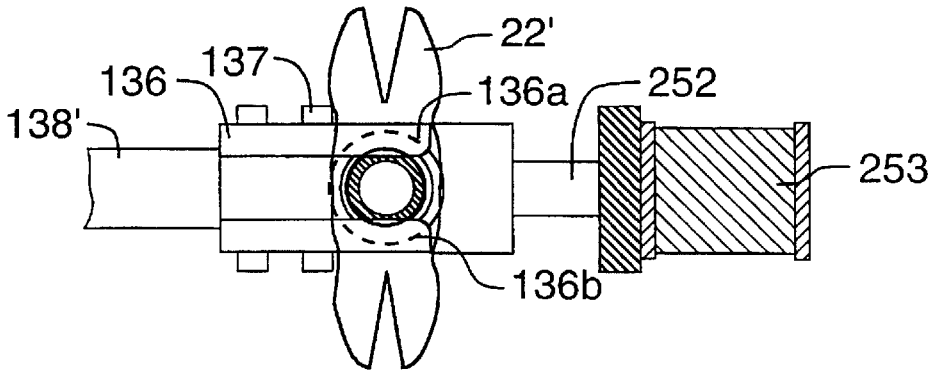
FIG. 8*g* is a top plan view(partly in section) along sight line 8*g*—8*g* of FIG. 8*f;*
Figure 8B:
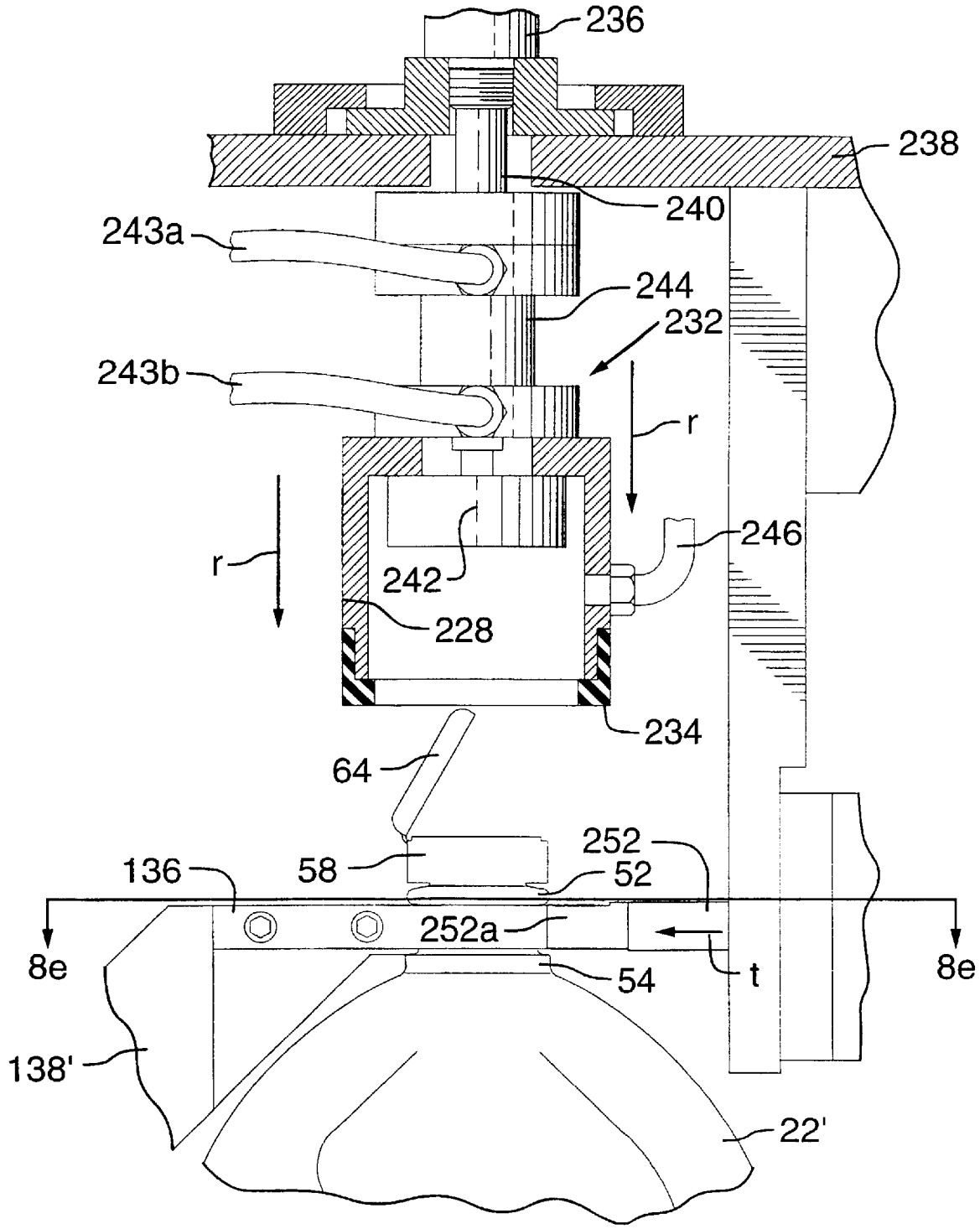
FIG. 8*b* is an enlarged top portion of FIG. 8.
Figure 8D:
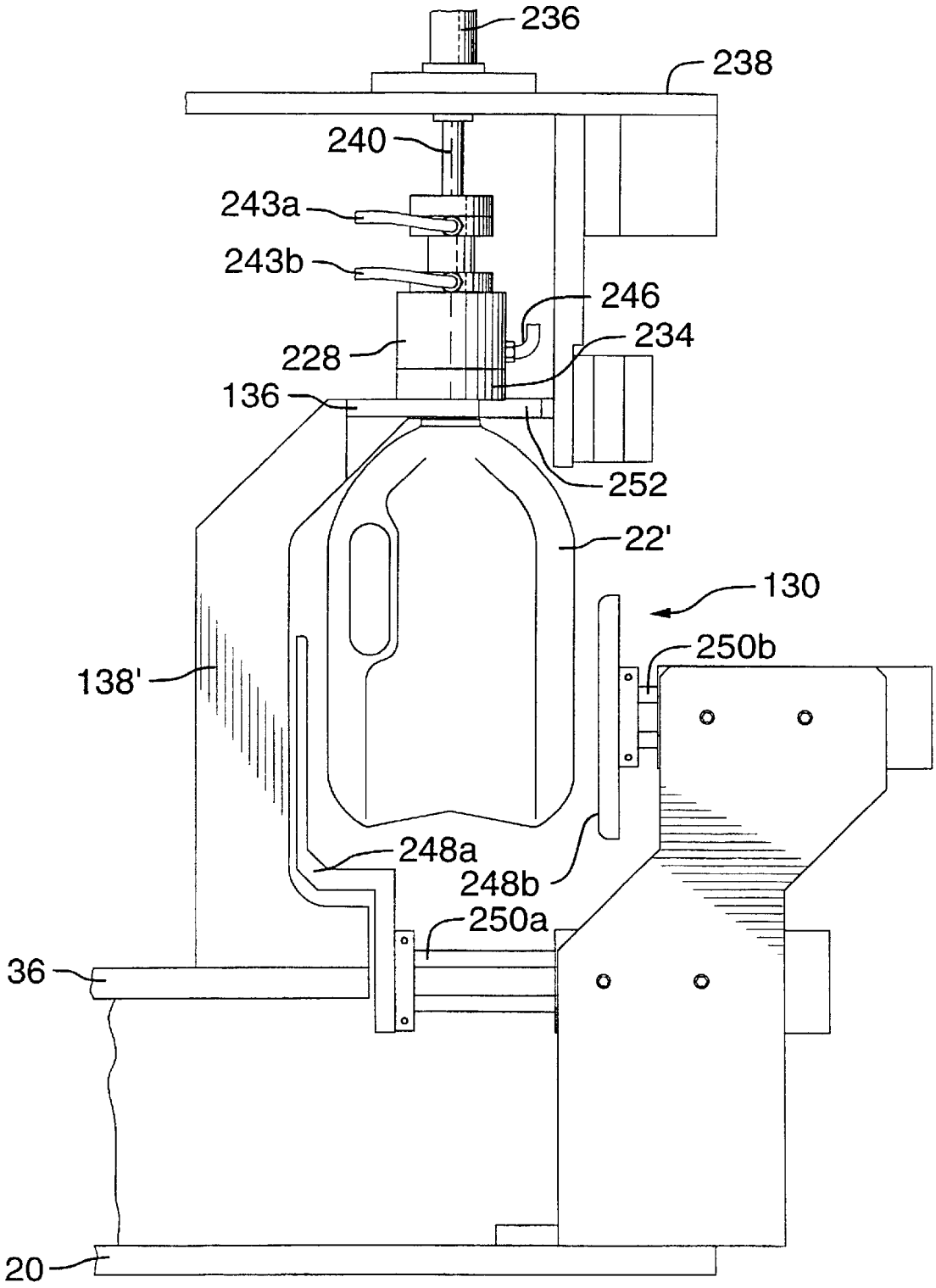
FIG. 8*d* is a side elevational view similar to FIG. 8, with an evacuated head, being part of the collapsing means, lowered into sealing relation with opening means, lowered into sealing relation with opening defined by the neck portion of the selected container.
Figure 8E:
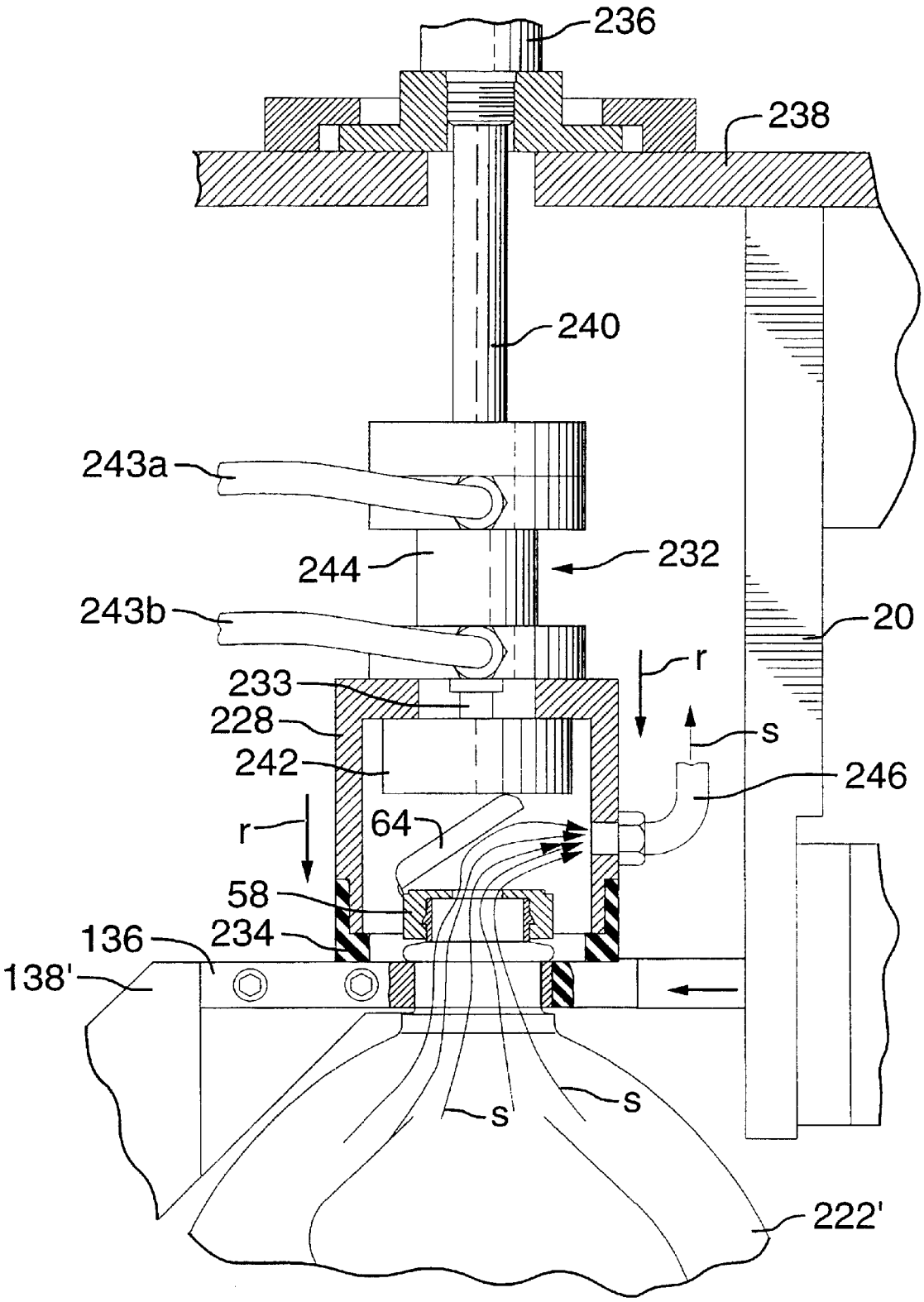
FIG. 8*e* is a cross-sectional view through the top portion of FIG. 8*d* showing evacuation of the selected collapsible plastic container by the evacuation head.
Figure 8F:
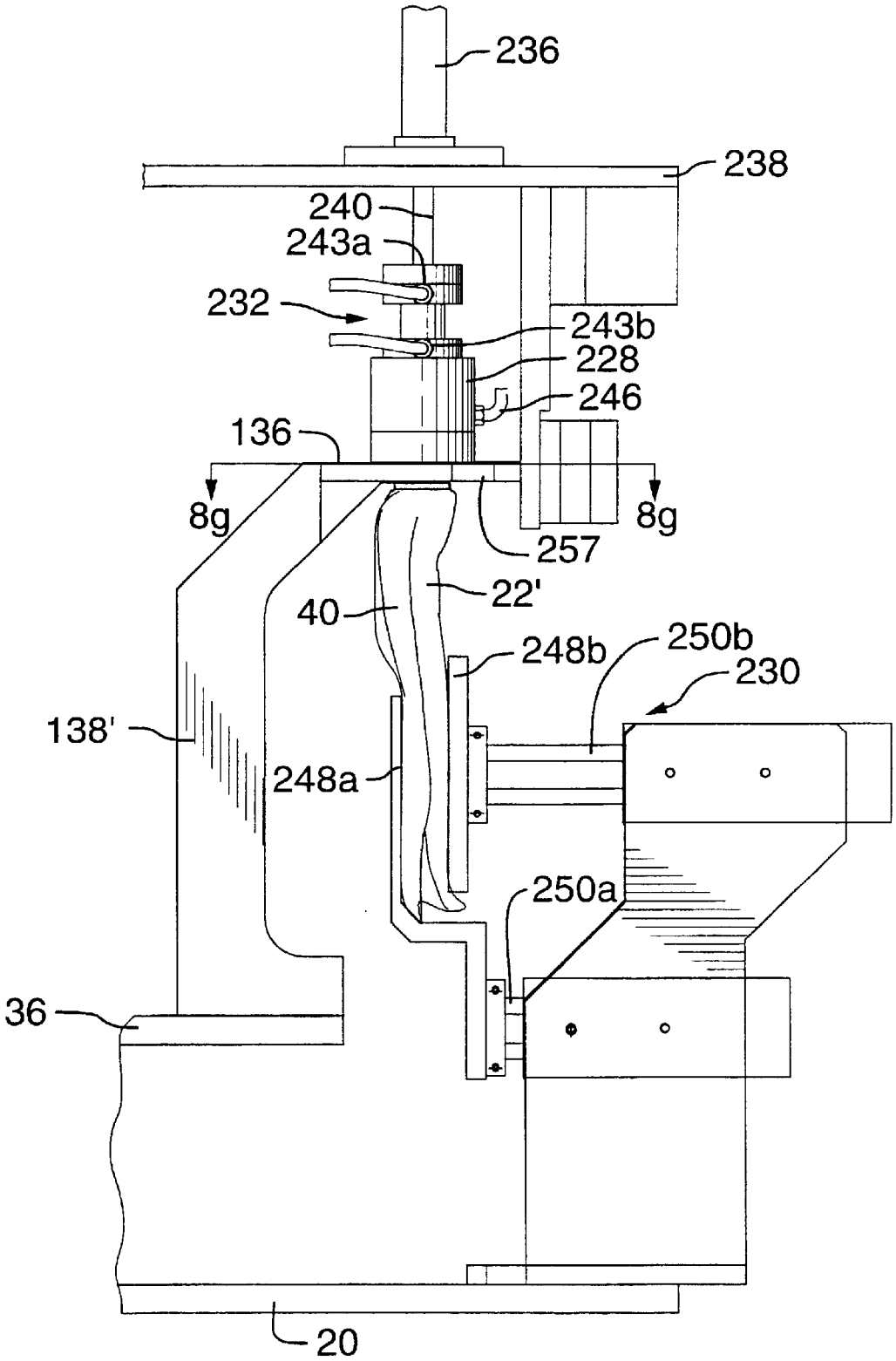
FIG. 8*f* is a side elevational view similar to FIG. 8*d,* showing collapsing of the collapsible body portion of the selected collapsible plastic container by physical compression of said body portion by two opposed compression plated, said compression plates being part of the collapsing means.

As seen in FIGS. 8, 8*b*, 8*d*, and 8*e*, once the selected collapsable plastic container 22' stops rotation at the collapsing station 32, a pneumatically actuated ram assembly 236 having a slidably movable piston ram 240 is energized by the computer CPU means (not shown) to lower the piston ram 240 and the attached evacuation head 228 (in the direction of arrow "r" of FIGS. 8*b* and 8*e*)into sealing relation with the opening 44 defined by the neck portion 42 of the selected collapsible plastic container 22'. To facilitate such sealing, the evacuation head 228 is fitted on its lower extremity with a soft pliable rubber head cover 234. The ram assembly 236 is mounted above the collapsing station 32 on a support structure 238. An evacuation pump unit (not shown, being any suitable commercially available evacuation pump) is then activated by the computer CPU means (not shown) to apply a vacuum to the evacuation head 228 via a vacuum application conduit 246, as indicated by arrows "s" in FIG. 8*e*. A clamp means 252, whose movement is controlled by a solenoid means 253, is preferably provided to firmly secure the non-collapsible neck portion 42 of the selected collapsible plastic container 22' in a fully indexed position at the evacuation station 32 prior to lowering of the evacuation head 228. The clamp means 252 presents a closely toleranced leading lip portion 252*a*, which lip portion 252*a* closely registers with the two chamfered fingers 136*a* and 136*b* of the U-shaped holding bracket 136 in interfitting relation with said fingers 136*a*, 136*b* to clamp the non-collapsible neck portion 42 in a fully indexed position at the collapsing station for the operations performed thereat as described herein. FIGS. 8*a*, 8*b* and 8*c* show the sequenced operation of the clamp means 252. FIG. 8*a* corresponds to the initial configuration of the relevant structures shown in FIG. 8. FIG. 8*c* corresponds to the configuration of the structures as shown in FIG. 8*b*, with the clamp means 252 advanced by the solenoid means 253, under sequenced control of the computer CPU means (not shown), in the direction of arrow "t" to firmly secure the non-collapsible neck portion 42, as aforesaid. FIG. 8*g* corresponds to the configuration of the structures as shown in FIG. 8*f*.

When the evacuation of the selected collapsible plastic container 22' is substantially complete, the computer CPU means (not shown) actuates the collapsing assembly 230 (see FIG. 8*f*), which assembly 230 comprises a pair of opposed compression plates 248*a* and 248*b* respectively actuated by pneumatic ram assemblies 250*a* and 250*b*. Such actuation of the collapsing assembly 230 causes the compression plates 250*a* and 250*b* to come together, thereby co-operating with the evacuation head 228 to substantially fully collapse the collapsible body portion 40 of the selected collapsible plastic container 22', as illustrated in FIG. 8*f*. The compression plate 248*a* is positioned on the carousel side of the apparatus 20, whereas the compression plate 248*b* is positioned on the opposite side. Both ram assemblies 250*a* and 250*b* are mounted on the opposite of the carousel side of said apparatus 20. As illustrated in FIG. 8*f*, when the compression plate 248*b* is extended outwardly in compressive engagement with the collapsible body portion 40 of the selected collapsible plastic container 22', the compression plate 248*a* is simultaneously retracted into compressive engagement with the collapsible body portion 40 of the selected collapsible plastic container 22'. In the present embodiment of the invention, both compressive plates are movable, although an alternative embodiment contemplates the use of one stationary compression plate and one movable plate.

Once a significant portion of the volume of air from within the selected collapsible plastic container 22' is removed, as aforesaid, so as to cause substantial collapse of the body portion 40 of the selected collapsible plastic container 22' at the collapsing station 32, it is then necessary to sealingly close the lid portion 64 of the closure cap 58, so as to maintain the vacuum, or partial vacuum, achieved within the collapsible body portion 40, thereby to retain the selected collapsible plastic container 22' in collapsed relation. To this end, the cap closing means 232 comprises a lid compression head 242 operatively connected by a slidable piston rod 233 to a lid closing hydraulically operated ram assembly 244 that is functional, under sequenced control of the computer CPU means (not shown), to lower said compression head 242, in the direction of arrows "u" of FIG. 8*h*, into compressive closing relation with said hinged lid portion 64 of the closure cap 58, thereby to mechanically re-establish sealing relation between the lid portion 64 and the opening 44 of the selected collapsible plastic container 22' by hinged movement of the lid portion 64 in a second direction opposed to said first direct about the hinge means 66. The lid compression head 242 and piston rod 233 are sized so as to fit inside the evacuation head 228, as is apparent from FIGS. 8*e* and 8*h*, and to conventionally operate under control of the computer CPU means (not shown) in the up and down directions independently of the ram assembly 236 upon appropriate inputs and outputs of pressurized hydraulic fluid through supply lines 243*a* and 243*b*.

Figure 8H:
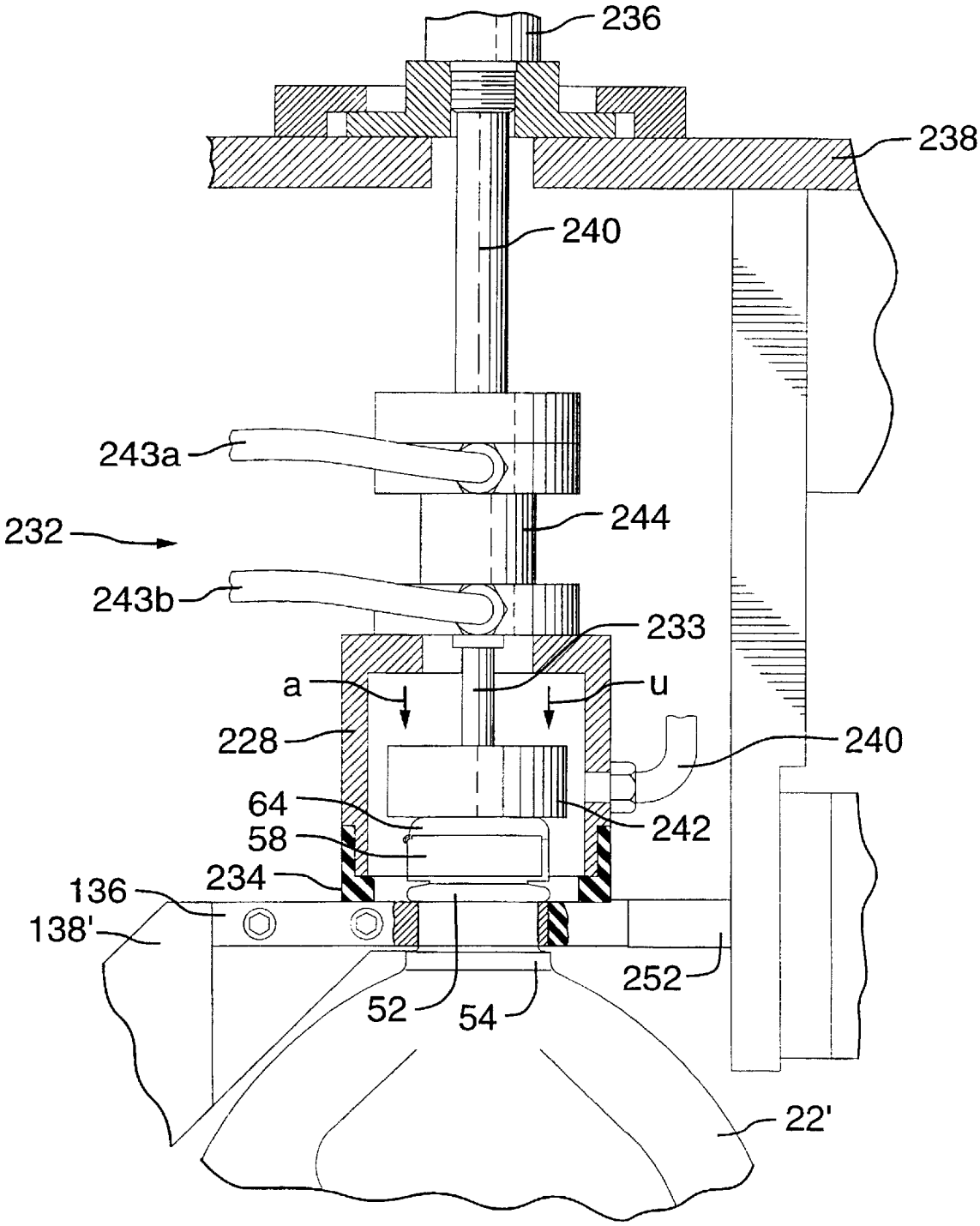
FIG. 8*h* is a cross-sectional view through the top portion of FIG. 8*f* showing operation of the cap closing means after collapsing of the collapsible body portion as depicted in FIGS. 8*e,* 8*f* and 8*g;*

As shown in FIG. 8*h*, when both ram assemblies 236 and 244, respectively, are in their lowered configurations, the base of the rubber head 234 nestles between the fingers 136*a* and 136*b* of the U-shaped holding bracket 136. It is to be noted, as shown in FIG. 8*e* that the compression head 242 is sized so as not to obstruct the vacuum application conduit 246. Once the lid portion 64 of the closure cap 58 is closed as aforesaid, the piston rod 233 and the piston ram 240 are both retracted upwardly by their respective ram assemblies 244, 236 under sequenced activation by the computer CPU means (not shown), so as to return to their original raised positrons, analogous to the raised positions illustrated in FIGS. 8 and 8*b*. The carousel means 36 is then indexed under control of the computer CPU means (not shown) so as to translate the selected collapsible plastic container 22' to the magazine loading station 34 for mechanical loading of the selected collapsible plastic container 22' into a magazine clip means 24, as will now be described with particular reference to FIGS. 9*a* through 9*i*.

Figure 9A:
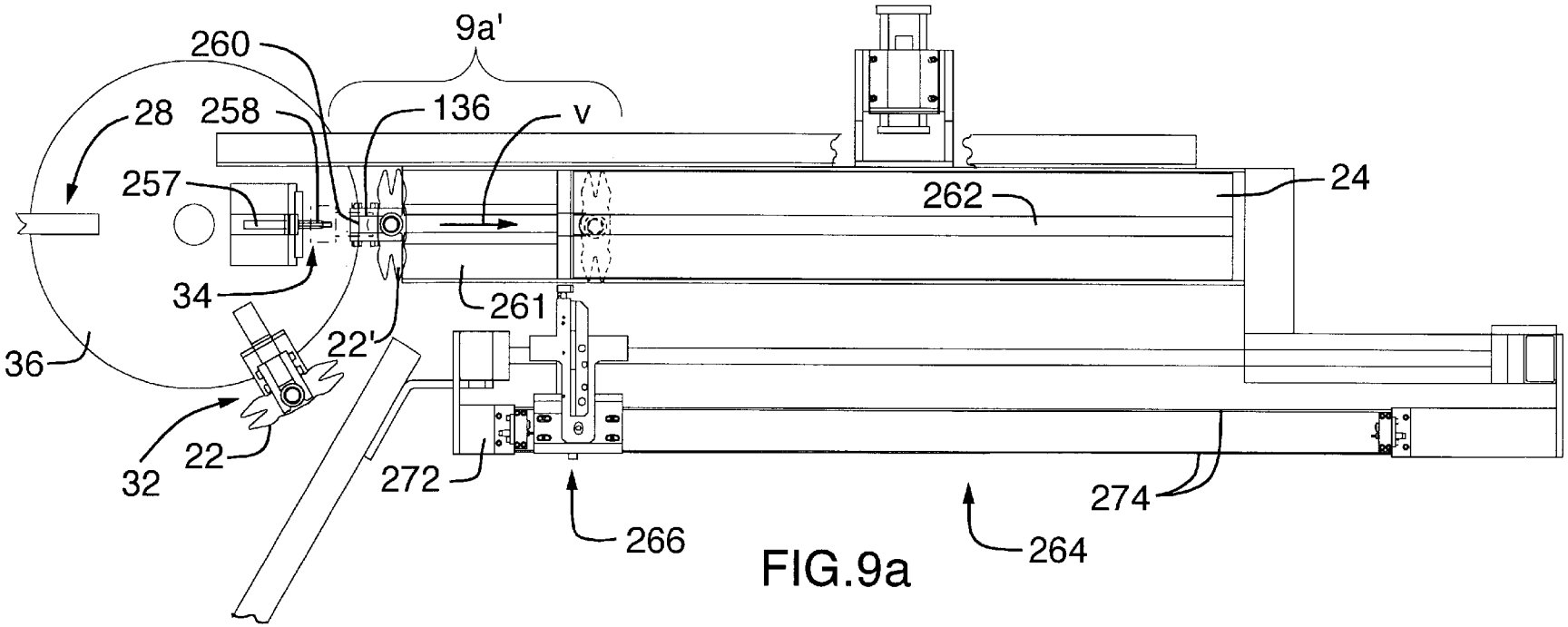
FIG. 9*a* is a top plan view of the radial sector of the apparatus defined by arced sight line 9*a*—9*a* of FIG. 2, showing the selected collapsible plastic container positioned at the magazine loading station (in solid outline), and within the magazine clip means, (in phantom outline) after translation by the loading means.
Figure 9A:
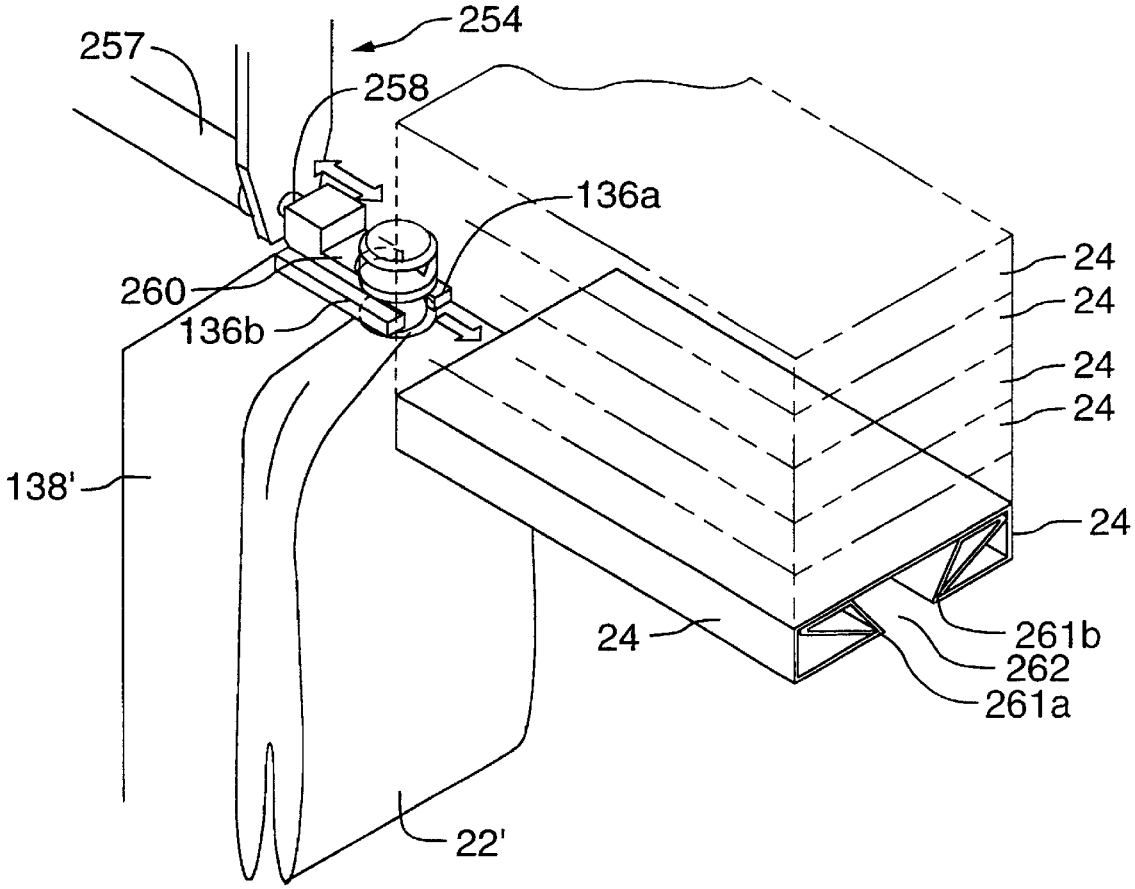
Figure 9B:
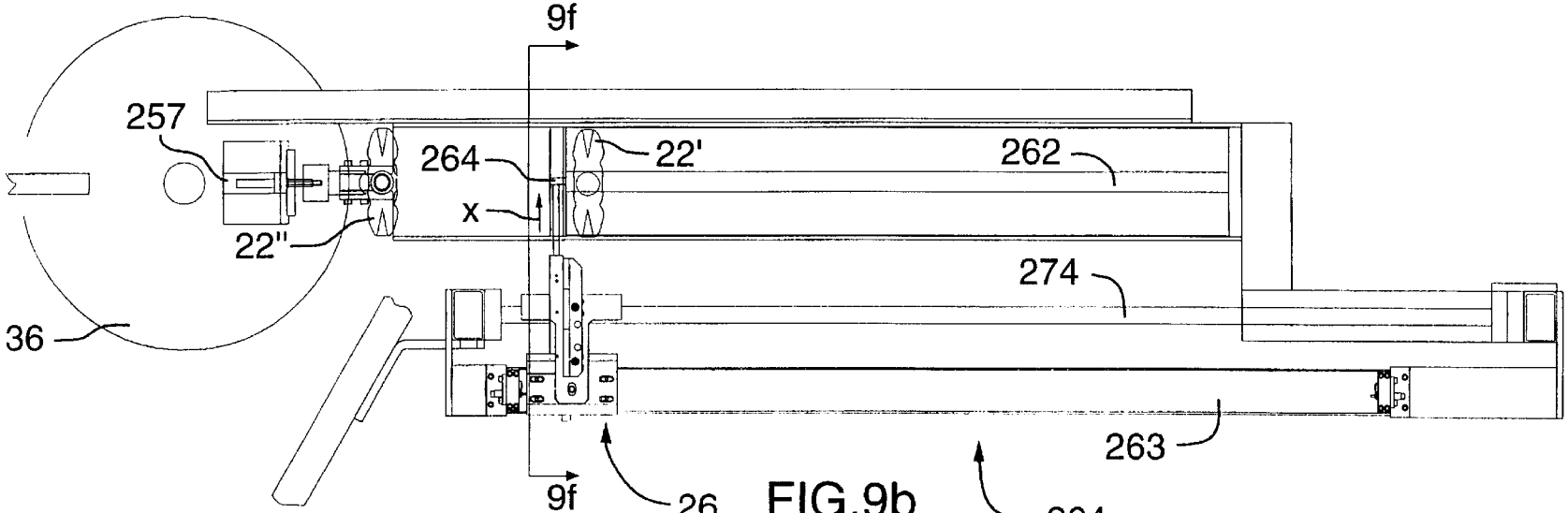
FIG. 9*b* is a top plan view similar to FIG. 9*a,* showing a transport means adjacent to the magazine loading station activated to commence transport of the selected collapsible plastic container from an initial loaded position is within the magazine clip.
Figure 9C:
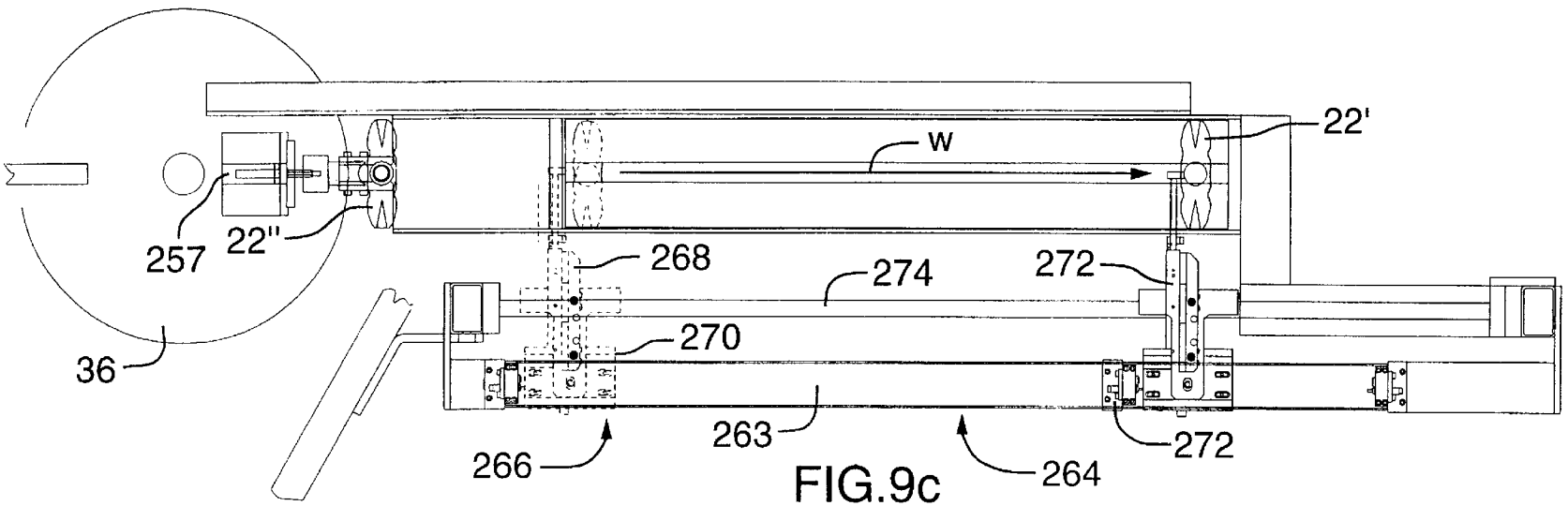
FIG. 9*c* is a top plan view similar to FIG. 9*b,* showing the transport means transporting the selected collapsible plastic container from its initial loaded position within the magazine clip (in phantom outline) to its final loaded position (in solid outline) within the magazine clip.
Figure 9D:
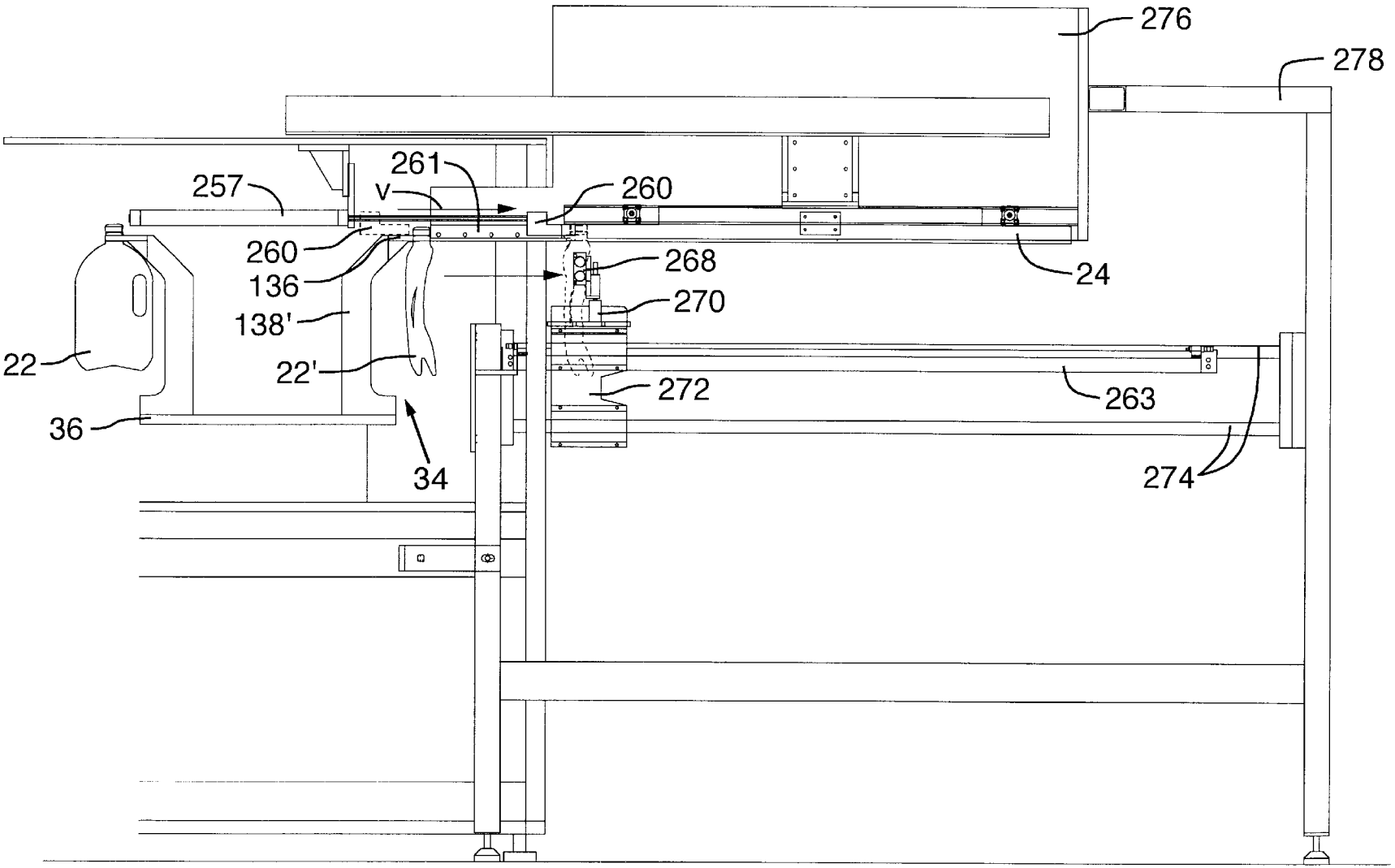
FIG. 9*d* is a side elevational view of the portion of the apparatus shown in FIG. 9*a;*

FIGS. 9*a* and 9*d* show, in solid outline, the selected collapsible plastic container 22' (in its collapsed configuration) positioned at the magazine loading station 34. As previously described, it is held on the carousel means 36 by positioning of the flats 50 of the non-collapsible neck portion 42 between the fingers 136*a* and 136*b* of the U-shaped holding bracket 136, and must be transferred therefrom into the magazine clip means 24. For this purpose, a loading means 254 is positioned at the magazine clip loading station 34 above the top level of the carousel means 36. In particular, said loading means 254 comprises a positioning, pneumatically actuated and computer controlled, ram assembly 257. The ram assembly 257 has is a sliding piston 258, which piston 258 terminates in an indexed fork member 260 (seen in phantom outline in FIG. 9*a*), which fork member 260 moves in a horizontal plane parallel to the U-shaped holding bracket member 136. Upon actuation of the driving ram 258 by receipt of an appropriate command from the computer CPU means (not shown), the fork member 260 impinges upon the closed closure cap 58 of the selected plastic container 22' to translate the selected collapsible plastic container 22' in the direction of arrow "v" of FIGS. 9*a* and 9*d* from the carousel means 36 through a transitional slide member 261, which member 261 is constructed of metal, plastic, or similar relatively low-friction materials, to have a cross-section substantially similar to that of the magazine clip means 24. The selected plastic container 22' is translated in this manner from its position at the magazine loading station 34 (shown in solid outline in FIGS. 9*a* and 9*d*) to its initial loaded position within the magazine clip means 24, which position is proximal to the magazine loading station (shown in phantom outline in FIGS. 9*a* and FIG. 9*d*). Each magazine clip means 24 is preferably constructed from cardboard material, and defines, by its opposed, longitudinally extending internal edges 261*a* and 261*b*, a longitudinal slot 262. The slot 262 is shaped and dimensioned so that the edges 261*a* and 261*b* each frictionally engage a respective one of the opposed flats 50,50 positioned on the non-collapsible neck portion 42 of the selected collapsible plastic container 22'. Accordingly, each of the selected collapsible plastic containers 22' is, in turn, received in radially indexed relation within the slot 262 of the magazine clip means 24, so as to be held therein by means of frictional interaction between the non-collapsible neck portion 42 and the magazine clip means 24.

Figure 9E:
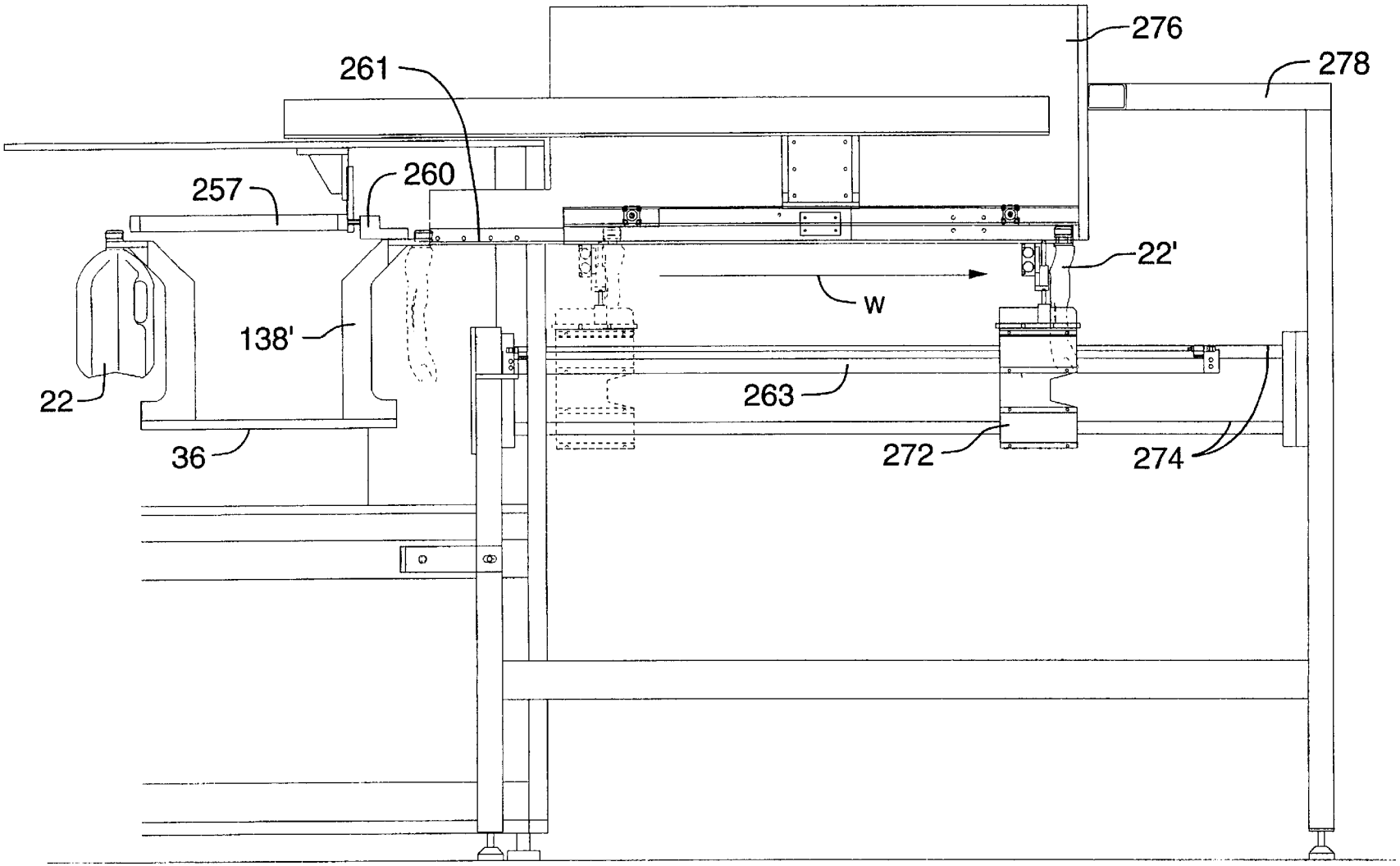
FIG. 9*e* is a side elevational view of the portion of the apparatus shown in FIG. 9*c;*

Means are also preferably provided for mechanically transporting the selected collapsible plastic container 22' held with the magazine clip means 24 from its initial loaded position within the magazine clip means 24 (which position is shown in phantom outline in FIG. 9*c*), in the direction of arrow "w" of FIGS. 9*c* and FIG. 9*e*, to a final loaded position within the magazine clip means, which final loaded position is distal to the magazine loading station 34 and is shown in solid outline FIG. 9*c*. This mechanical transporting means is denoted generally by the reference numeral 264, and comprises, in combination, a ram assembly 266 functional to provide a horizontally disposed driving ram 268 and a vertically disposed driving ram 270, a horizontally slidable carriage means 272, and a two rail track means 274 adapted for controlled sliding movement therealong of said carriage means 272 in a longitudinal horizontal direction (as indicated by arrow "w" of FIG. 9*e*) parallel to the longitudinal axis defined by the magazine slot 262, said carriage means 272 being positioned beneath said magazine clip means 24. In operation, the selected collapsible plastic container 22' is shown at its initial position within the magazine clip means 24 in FIGS. 9*b* and 9*f*. In this configuration, the horizontally disposed driving ram 268 is activated under control of the computer CPU means (not shown), so as to extend its leading plate 269 in the direction of arrow "x" of FIGS. 9*b* and 9*f*. Thereafter, the vertically disposed driving ram 270 is similarly activated by the computer CPU means (not shown) in the direction of arrows "y" of FIG. 9*g*, thereby to bring the leading plate 269 into aligned relation with the non-collapsible neck portion 42 of the selected collapsible plastic container 22'. The carriage means 272 is then caused to travel longitudinally down the track rails 274 in the direction of arrow "w" by means of any conventional drive means interacting between the carriage means 272 and the track rails 272. The preferred drive means shown is a toothed rack 263 which runs parallel to the upper one of the track rails 274, which operatively interacts with an electrically driven pinion (not shown) mounted on the carriage means 272. Selective energization of the pinon drives the carriage along the rack 263 in a manner that may accurately be controlled by the computer CPU means (not shown). Once the selected collapsible plastic container 22' arrives at its final position as shown in solid outline FIGS. 9*c* and 9*e*, the carriage means 272 returns, under computer control, in the reverse direction of arrow "w", to its commencement point to repeat the cycle with respect to the next collapsible plastic container 22 brought to the initial position within the magazine means 24. Any well known position indicator means (not shown) may advantageously be incorporated into the mechanical transporting means 264 to precisely register the position of the carriage means 272 relative to the track rails 274 at all relevant positions. Examples of such position indicator means include, without limitation, microswitches, contrasting colour bars with light reading sensors, and various other computer controlled numerical control systems, all of which are well known in the robotics field. Such incorporation allows the precise positioning by the carriage means 272, in seriatim, of each selected plastic container 22' at its respective position along the axial length of the magazine clip means 24 in close contacting relation with one another.

FIGS. 9*f*, 9*g* 9*h* and 9*i* are illustrative of the method and apparatus whereby the loaded collapsible plastic containers 22 are retained within the magazine clip means 24, and whereby the magazine clip 24, once fully loaded with such containers 22, is expelled from the apparatus 20, and whereby a replacement magazine clip means 24 is subsequently positioned to itself be loaded.

Figure 9F:
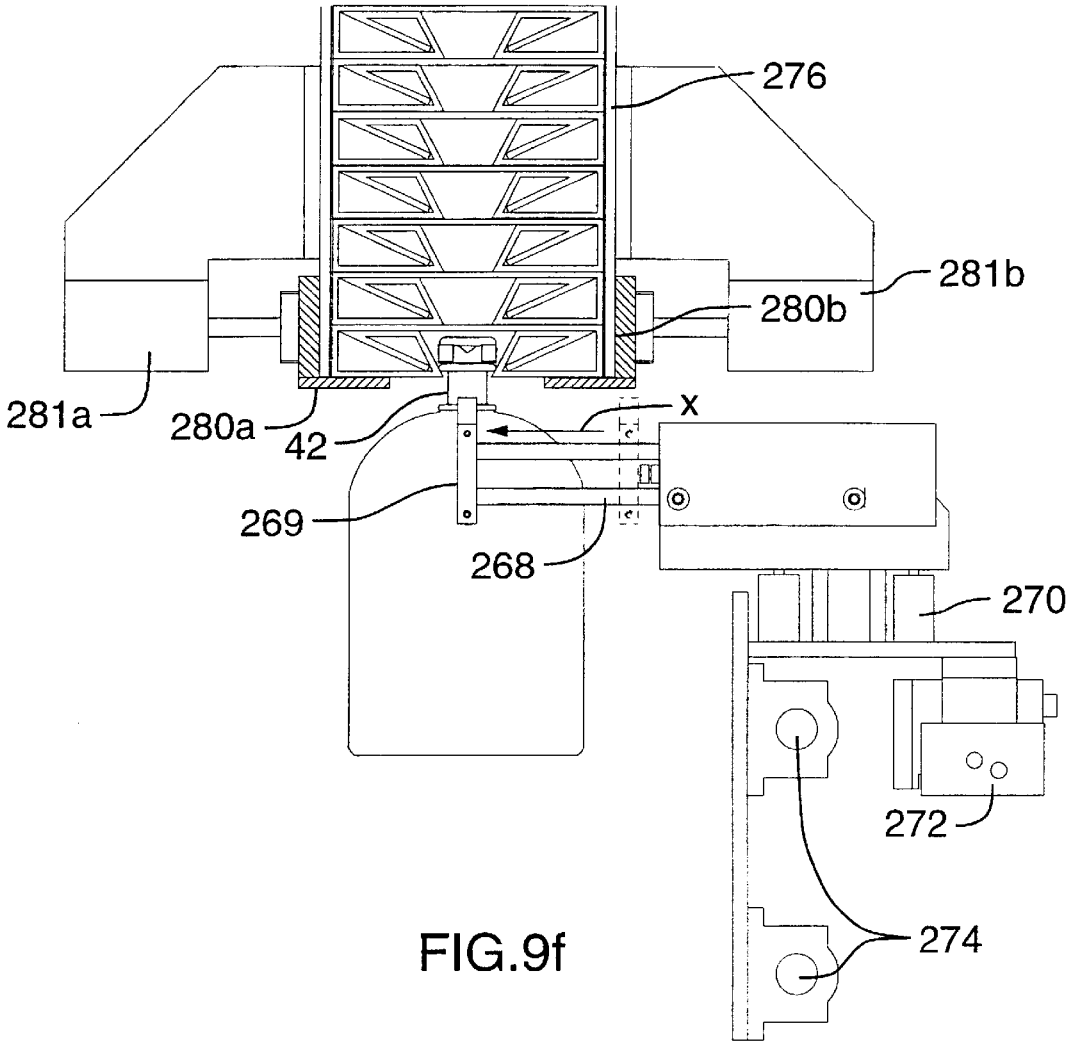
FIGS. 9*f* and 9*g* are end-on sectional views along sight line 9*f*—9*f* of FIG. 9*b,* with the head position of the transport means shown in its deactivated position in phantom outline in FIG. 9*f* (corresponding to the position depicted in FIG. 9*a*), and in its activated in solid outline in FIG. 9*g* (corresponding to the position depicted in FIG. 9*b*)
Figure 9G:
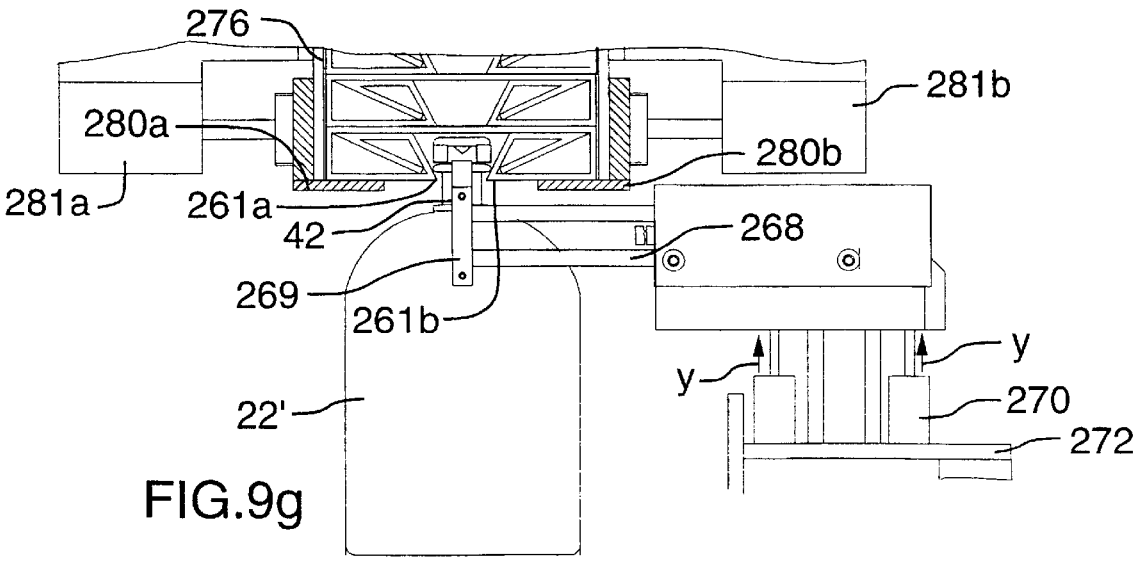

Turning now to FIG. 9*f*, there is diagrammatically depicted a plurality of magazine clip means 24 stacked one above the other in a storage housing 276, which housing 276 is supported by a frame 278. The magazine clip means 24 has, as previously described, a selected collapsible plastic container 22" being positioned therein by the ram assembly 266, specifically driving ram 268 (FIG. 9*f*) and driving ram 270 (FIG. 9*g*) in the drawing sequence shown. The magazine clip means 24 being loaded is retained in its initial loading position by means of a pair of opposed angle irons 280*a* and 280*b*, each respectively controlled by an opposed pneumatically controlled pneumatic ram assemblies 281*a*, 281*b*.

Figure 9H:
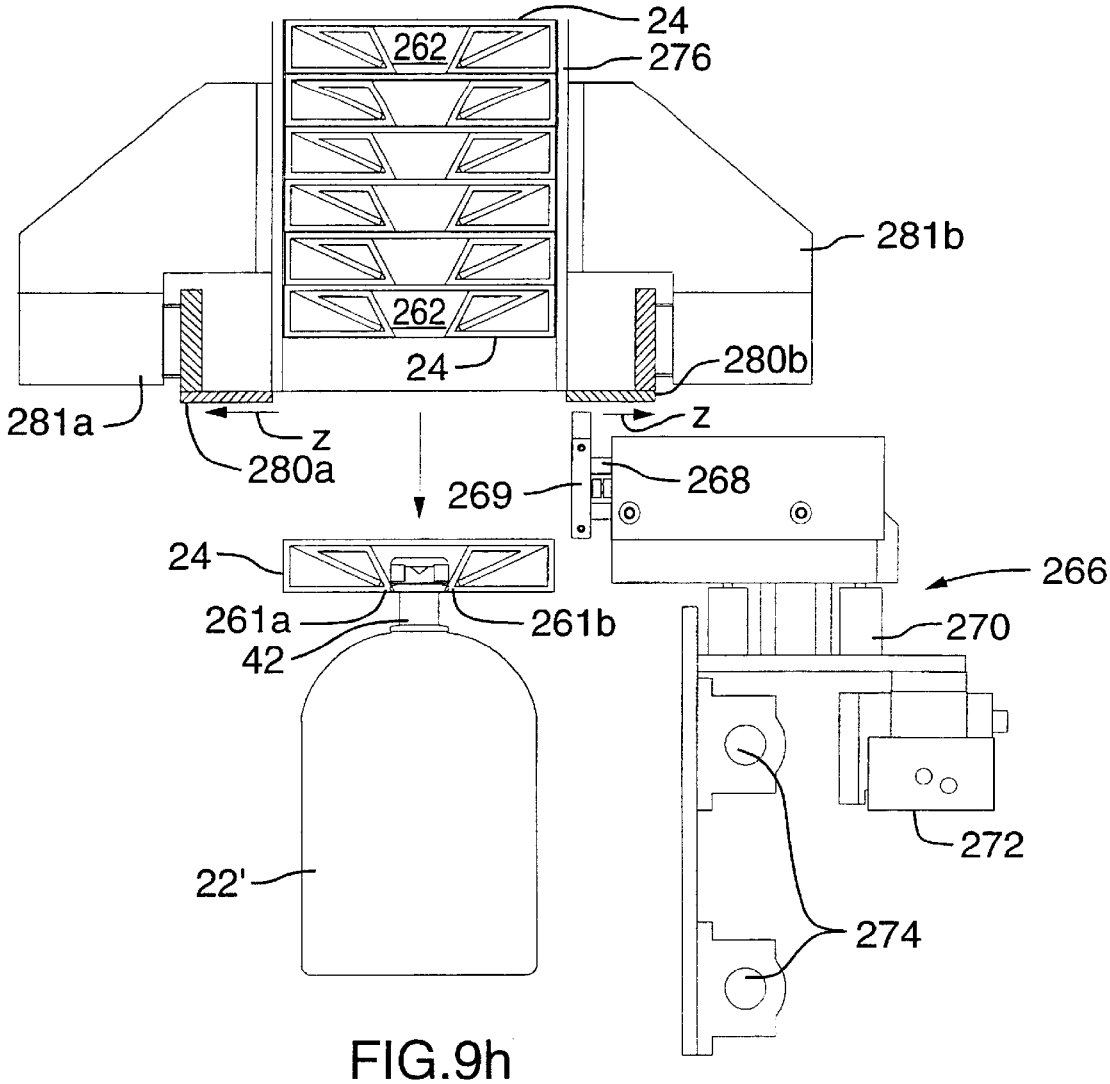
FIG. 9*h* is an end-on sectional view similar to FIG. 9*f,* showing a magazine clip filled with collapsible plastic containers being released from the clip holder of the loading means.

FIG. 9*h* illustrates the retraction of the angle irons 280*a* and 280*b* (in the direction of arrows "z") simultaneously to release the filled magazine clip means 24 (under the pull of gravity) upon appropriate actuation of the ram assemblies 281*a* and 281*b* under control of the computer CPU means (not shown). Note that the loading ram assembly 266 is in its inactivated mode, namely the driving rams 268 (including leading plate 269) and 270 are both fully retracted.

Upon release of the filled magazine clip means 24, the ram assemblies 281*a* and 281*b* are immediately returned to their respective starting positions (as indicated by arrows "aa" in FIG. 9*i*)to allow the next lowest magazine clip means 24 in the storage housing 276 to fall, under the influence of gravity, onto the horizontal flange portions of the respective angle irons 290*a* and 280*b*, to be retained thereon until a loading cycle of that magazine clip means 24 is completed.

Figure 10:
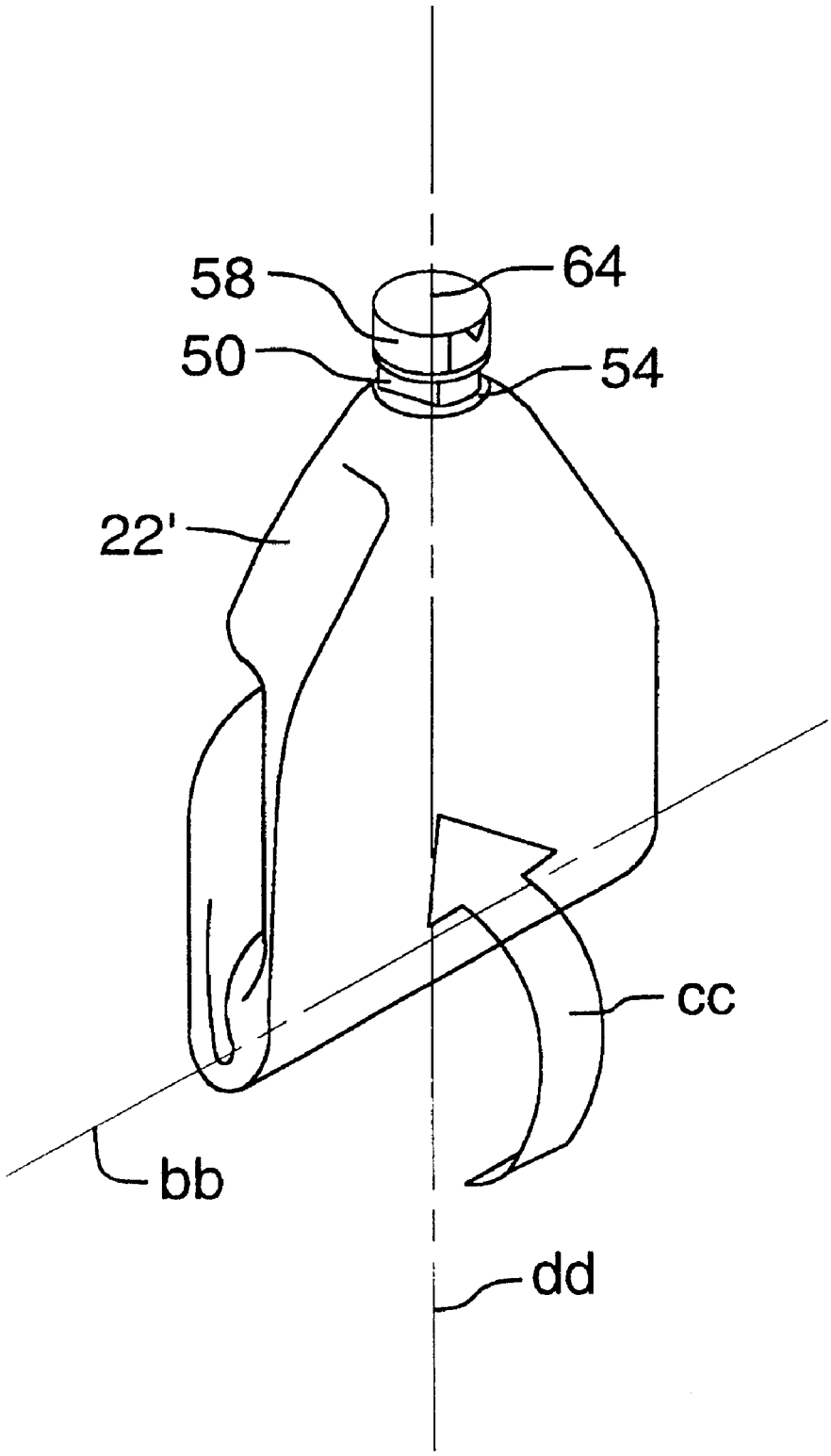
FIG. 10 is a simplified diagrammatic perspective view from the top and side of an exemplary collapsible plastic container showing it being folded according to an alternative embodiment of the invention about an axis transverse to the longitudinal axis of the container, so as to shorten the effective longitudinal length of the container projecting from the magazine clip.
Figure 10A:
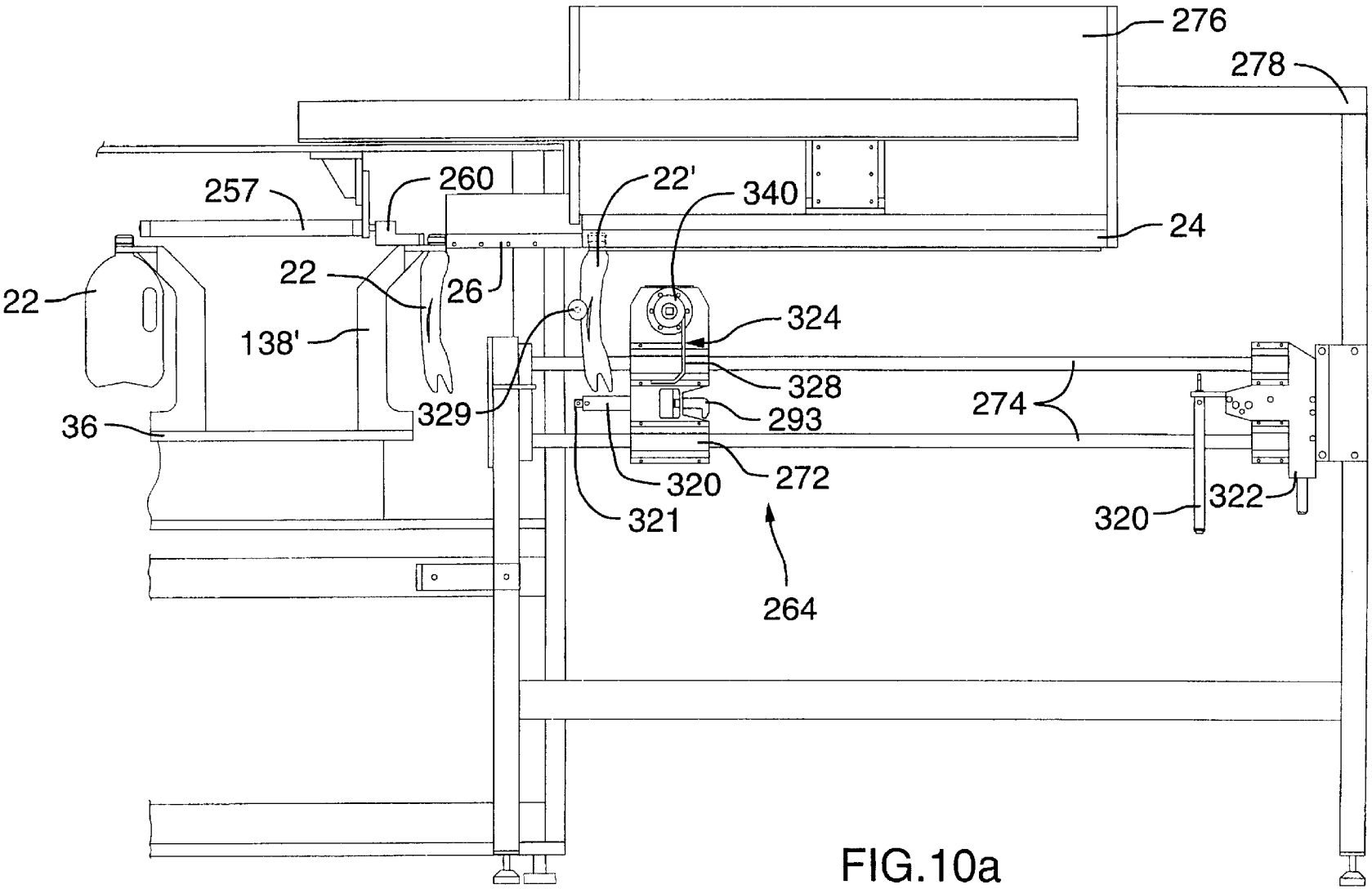
FIG. 10*a* is a side elevational view of an alternative embodiment of apparatus according to the invention (similar in view to the preferred embodiment of FIG. 9*d*), said alternative embodiment being functional to fold the collapsible plastic containers in the magazine clip means in the manner shown in FIG. 10.
Figure 10B:
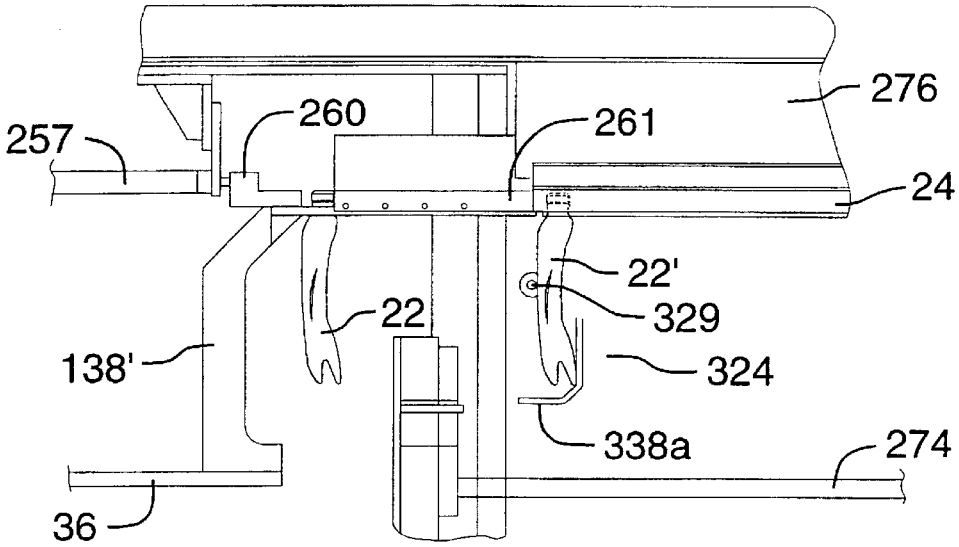
FIGS. 10*b,* 10*c* and 10*d* are sequential schematic end on views demonstrating, in operation, the means for folding the selected collapsible plastic container.
Figure 10C:
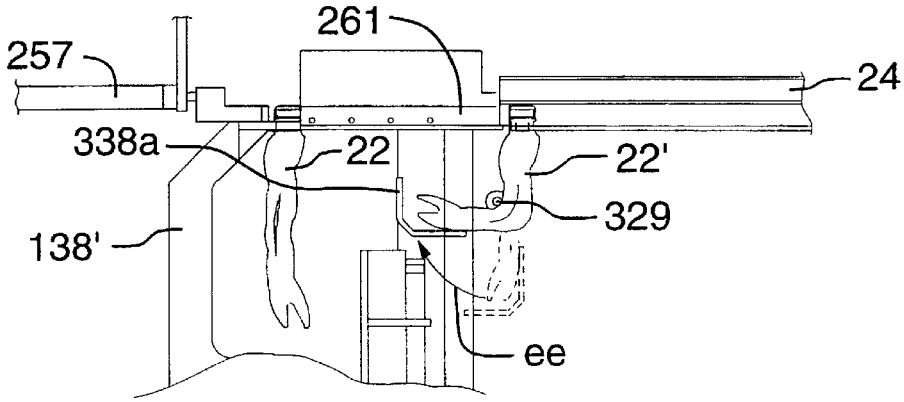
FIG. 10*e* is a side elevational view of the modified embodiment of FIG. 10*a,* depicting, in solid outline, a secondary carriage means interacting with a modified carriage means to hold a selected collapsible plastic container in its folded position, and in phantom outline, transport means associated with the magazine clip loading station activated to commence transport of the folded collapsible plastic container from an initial loaded position within the magazine clip.
FIG. 10*f* is a side elevational view of the apparatus of FIG. 10*c* similar to that of FIG. 10*e* showing the transport of a plurality of folded collapsible plastic containers within the magazine clip means.
FIG. 10*g* depicts the schematic movement of the means for retaining the loaded collapsible plastic containers within the magazine clip means.
FIG. 10*h* is an end sectional view of the alternative embodiment of the apparatus diagrammed in FIG. 10*a.*
Figure 10D:
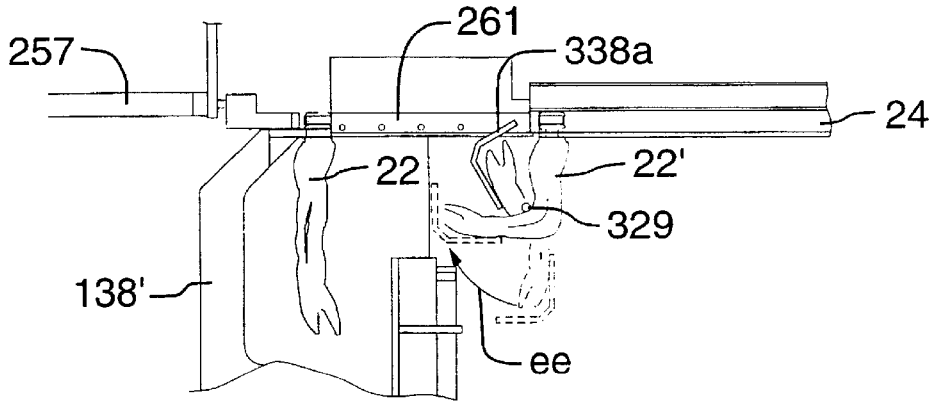
Figure 10E:
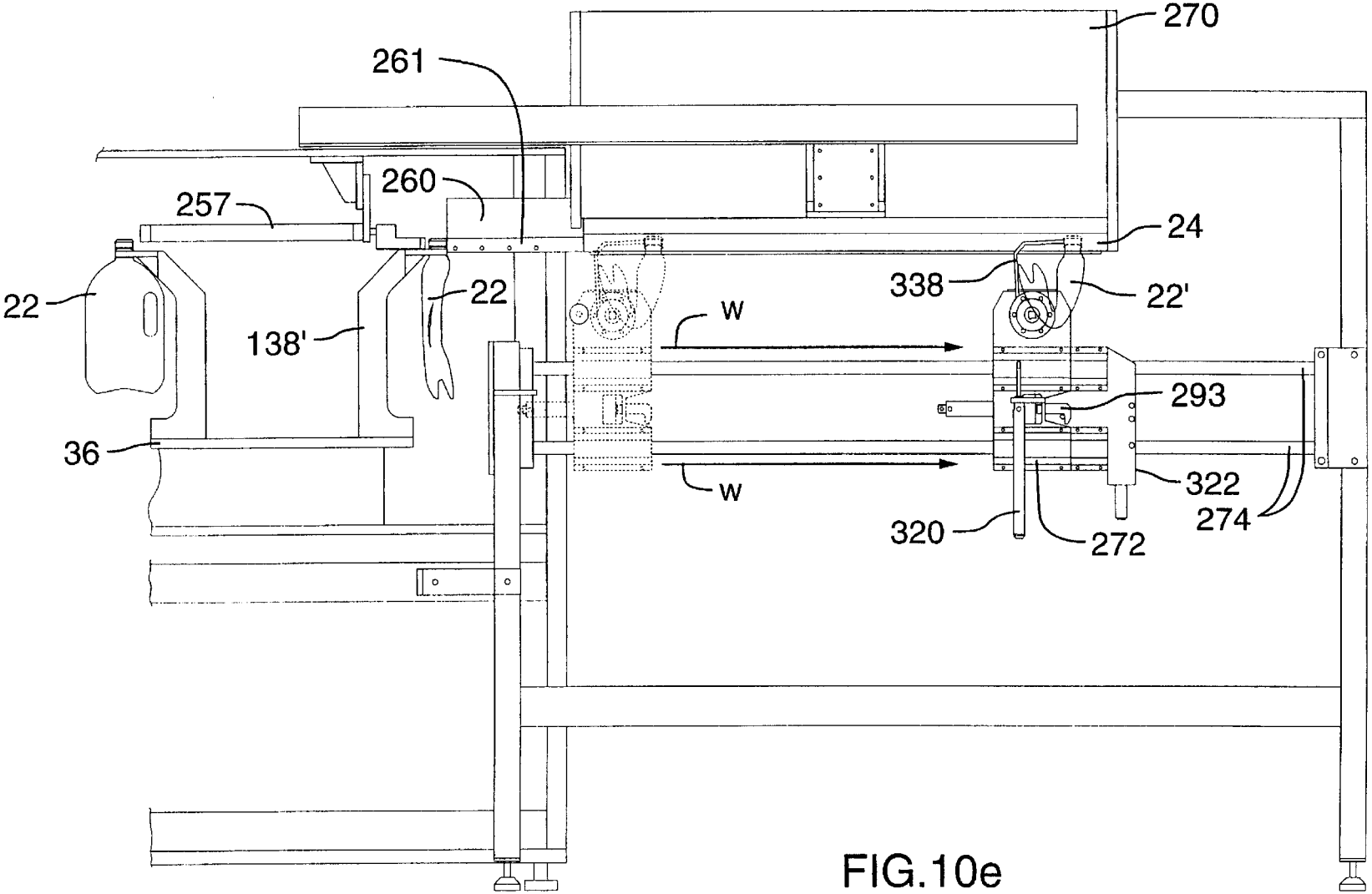
Figure 10F:
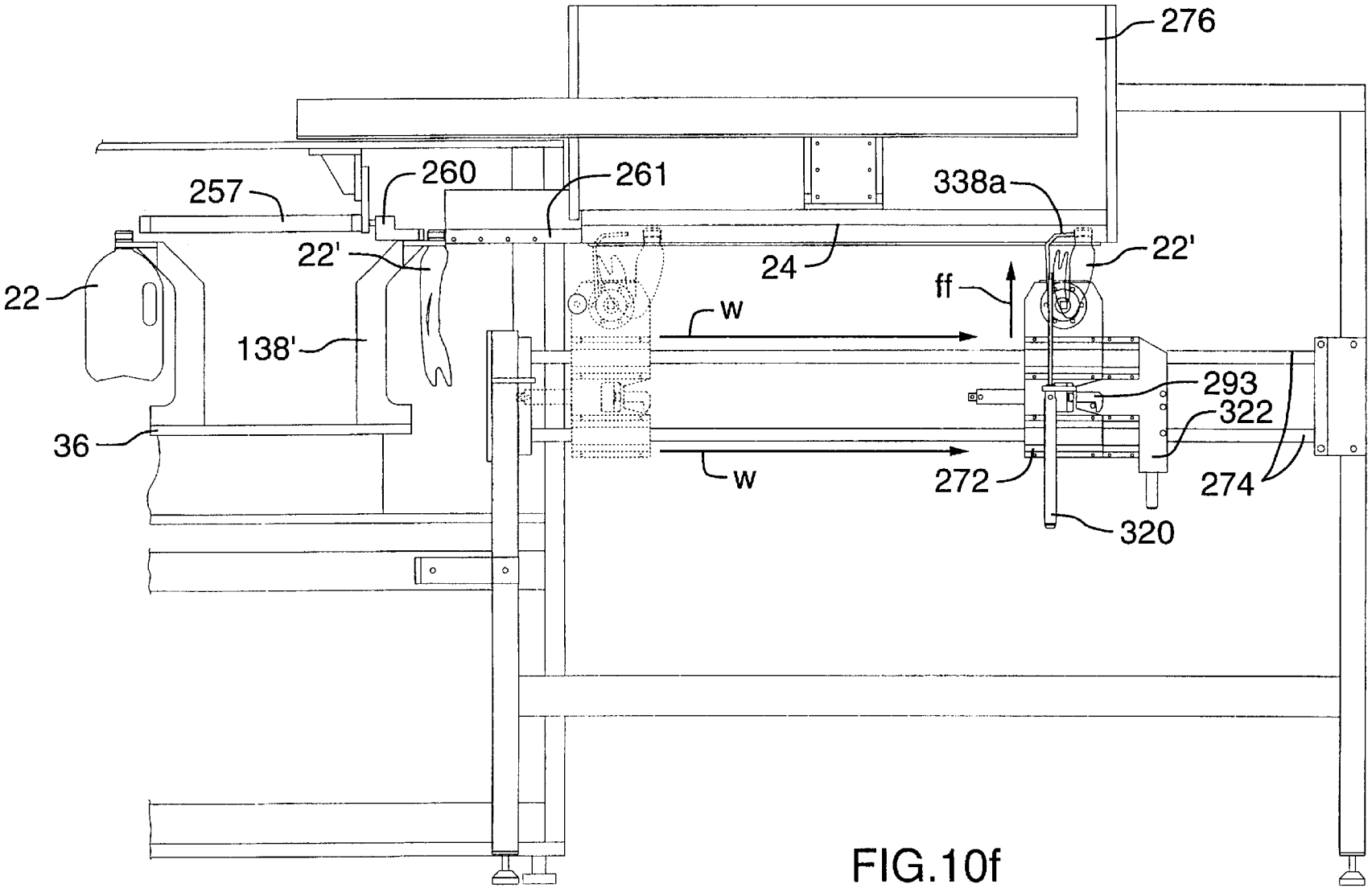
Figure 10G:
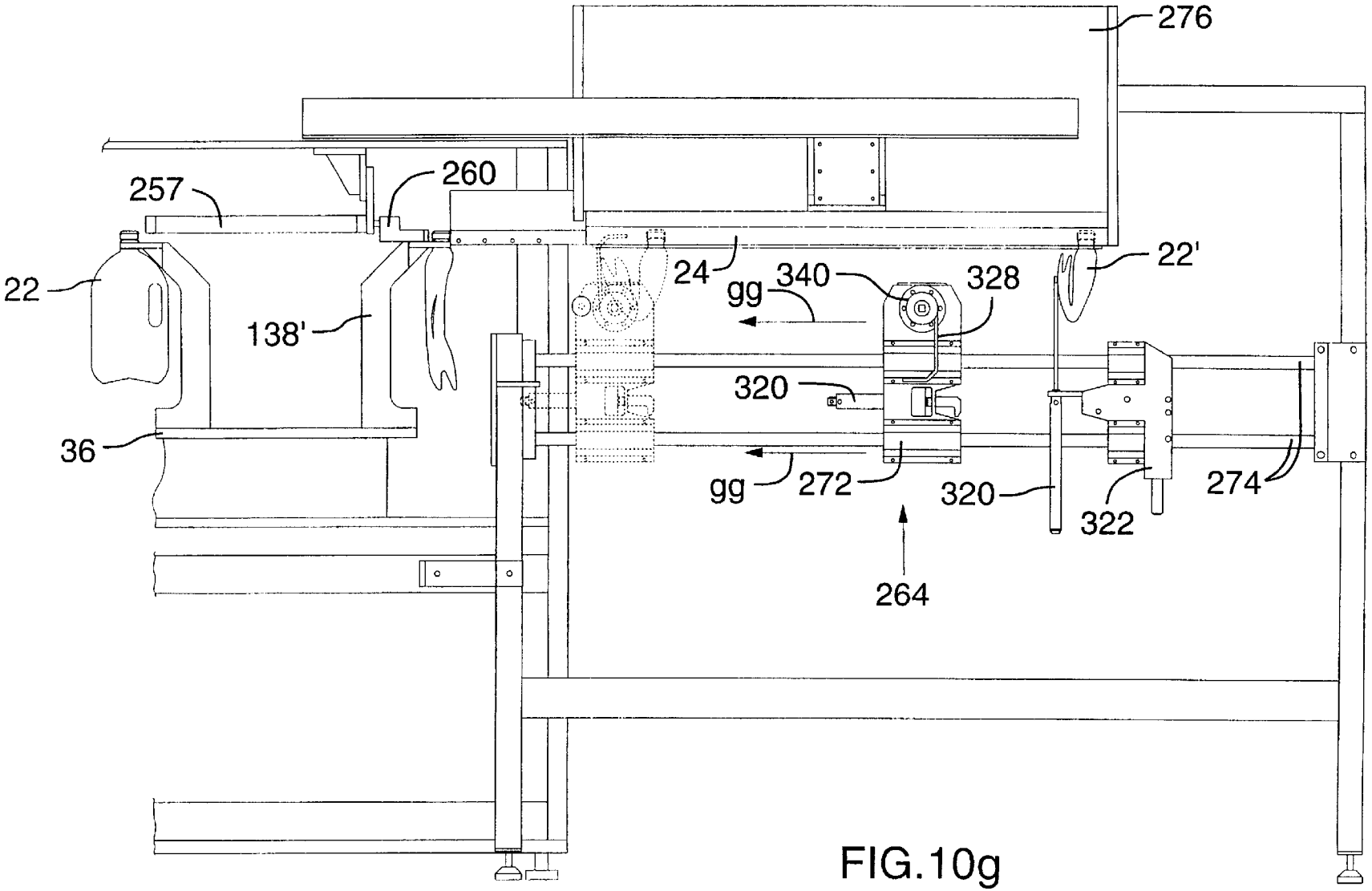
Figure 10H:
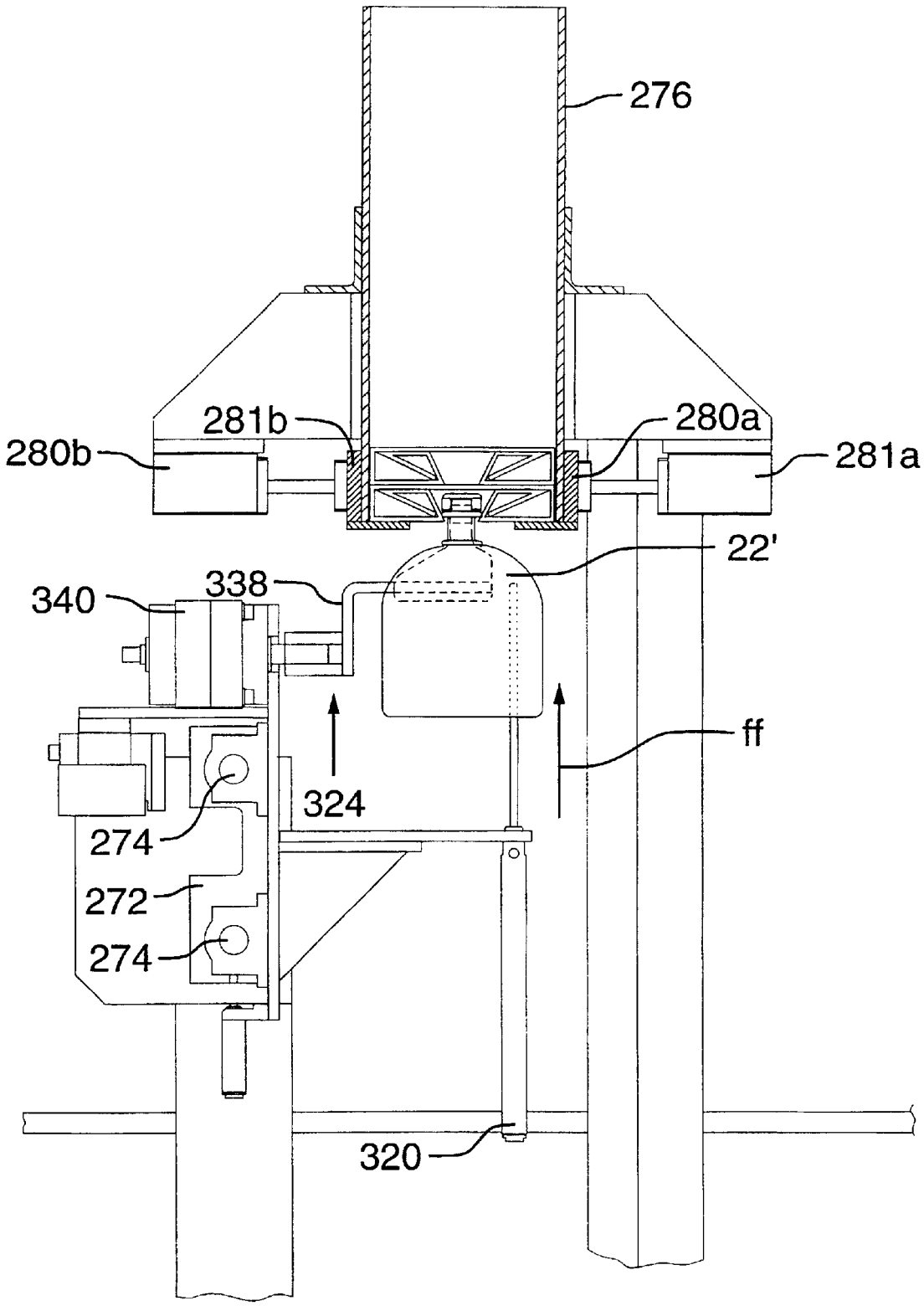

FIGS. 10 through 10*h* illustrate an alternative embodiment of the present invention wherein the mechanical transporting means 248 of the device 20 has been modified adjacent the magazine loading station 34 to provide a container folding means 324 operating in co-operation with the mechanical transporting means 264 for folding of the collapsible body portion 40 of the selected collapsible plastic container 22' held within the magazine clip means 24 about an axis "bb", which axis is transverse to the longitudinal axis "dd" of the selected collapsible plastic container 22'. Such folding is diagrammatically represented in FIG. 10 by arrow "cc".

FIG. 10*a* is a side elevational view of the alternative embodiment of the apparatus shown in FIG. 9*d*. The modifications shown deal primarily with the carriage means 272 of the previously described embodiment, and with additions to the mechanical transporting means 264, and like reference numerals will be used in FIGS. 10 through 10*h* to designate structures or features in the alternate embodiment analogous to structures or features that have already been described in relation to the preferred embodiment first described herein. The structure and operation of such analogous structures and features will not be repeated in respect of the alternate embodiment of FIGS. 10 through 10*h;* rather, only the significant differences will be described.

The modified mechanical transporting means 264 comprises, in combination, a secondary carriage means 322, and a modified carriage means 272, both of which independently slide horizontally along track rails 274 in a controlled, sequenced manner under direction from the computer CPU means (not shown). The modified carriage means 272 is fitted with a container folding means 324 and with a stop means 320, having a limit switch 321, which operatively limits sliding movement of the modified carriage means 272 to the leftmost position of FIGS. 10*a* through 10*g*.

The container folding means 324 provides a rotatable folding arm 338 driven through the computer CPU means (not shown) by an electric motor 340, said folding arm 338 defining, at its outer end, an upwardly extending hook portion 338*a*. The sequential operation of the folding arm 338 is shown in FIGS. 10*b* through 10*h,* wherein said arm 338 rotates through substantially one hundred and eighty degrees of rotation (in the direction of arrow "ee" of FIGS. 10*c* and 10*d*) to capture the collapsible body portion 40 of the selected collapsible plastic container 22' and to fold same during said rotation about fold arm 329 (which fold arm 329 defines the horizontal axis "bb" of FIG. 10), thereby to shorten the effective longitudinal length of the selected collapsible plastic container 22' protruding from the magazine clip means 24.

Figure 9I:
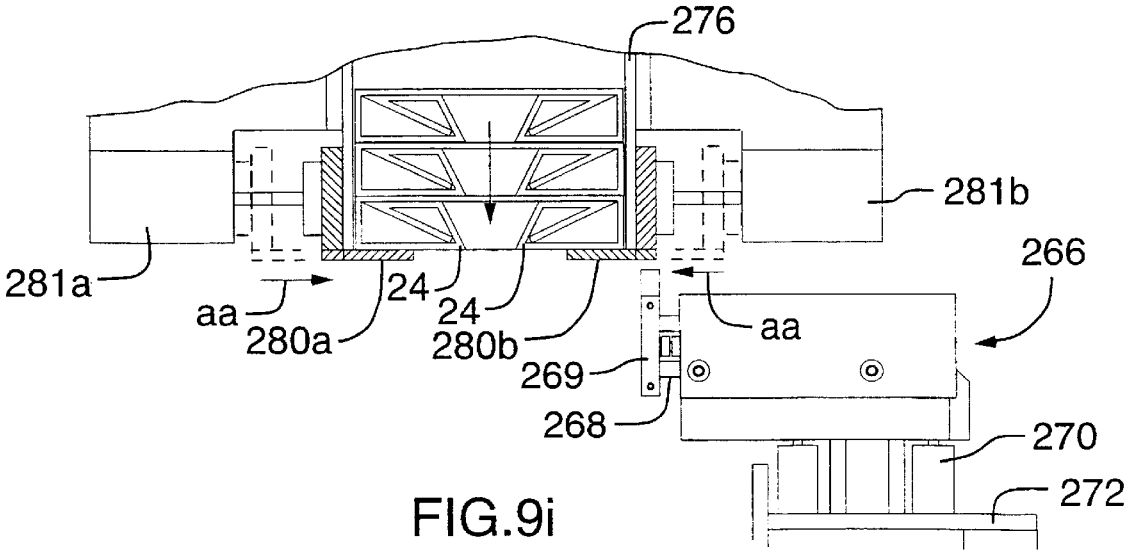
FIG. 9*i* is a view similar to FIG. 9*h,* showing a fresh magazine clip being lowered into position within the clip holder of the loading means for subsequent loading of a plurality of the selected collapsible plastic container into the magazine clip.

Once the selected plastic container 22' is folded in this manner, the modified carriage means 272 transports the folded container 22' in the direction of arrows "w" of FIGS. 10*e* and 10*f* from its initial position within the magazine clip means 24 proximal to the loading station 34 (which proximal position is shown in phantom outline in FIGS. 10*e* and 10*f*) to its assigned final position within the magazine clip means 24 distal to the loading station 34 (which distal position is shown in solid outline in FIGS. 10*e*), in a manner generally analogous to such movement of the selected collapsible plastic container 22' as shown and described in relation to the preferred embodiment of FIGS. 9 through 9*i*.

Once carried by the modified carriage means 272 to the distal position just described, the modified carriage means 277 matingly contacts the secondary carriage means 322 with the aid of an electronically controlled latch member 293, to temporarily join the modified carriage means 272 to the secondary carriage means 322. After such latching, a vertically disposed ram assembly 320 mounted on the secondary carriage means 322 extends upwardly (as indicated by arrows "ff" in FIGS. 10*f* and 10*g*) behind the selected collapsible plastic container 22' to hold the selected plastic container in its folded configuration. Such holding allows the modified carriage means 272 to disjoin from the secondary carriage 322 upon computer controlled unlatching of the latch member 293, and to thereafter return (in the direction of arrow "gg" of FIGS. 10*g* to its initial cycle to repeat the folding and transport cycle over again in respect of the next collapsible plastic container waiting for it. Once the magazine clip means 24 is filled by the device 20 with folded collapsible plastic containers, they can be banded with shrink-wrap plastic film, or otherwise packaged to hold said containers 22 in their folded configurations within the magazine clip means 24.

I claim:

1. A process for machine packing a plurality of collapsible plastic containers 22 into a magazine clip means for subsequent handling of the collapsible plastic containers, each plastic container having a collapsible body portion and a non-collapsible neck portion defining an opening to the plastic container, the process comprising the steps of:

a) mechanically selecting one of said plastic containers from a serially arranged row of said plurality of containers by gripping said first collapsible plastic container about said neck portion;

b) mechanically translating said selected collapsible plastic container to a predetermined capping station;

c) at said capping station, mechanically applying to the non-collapsible neck portion of the selected collapsible plastic container, in closed, sealing relation to said opening of the collapsible plastic container, a closure cap having a rim portion and a lid portion connected to the rim portion by a hinge means;

d) mechanically translating said selected collapsible plastic container to a predetermined collapsing station;

e) at said collapsing station, mechanically opening the lid portion of said closure cap to break said sealing relation to said opening of the collapsible plastic container by hinged movement in a first direction of the lid portion about said hinge means;

f) at said collapsing station, mechanically removing a substantial portion of the volume of air from within the selected collapsible plastic container so as to cause substantial collapse of the body portion of said selected collapsible plastic container at said collapsing station;

g) at said collapsing station, mechanically closing the lid portion of said closure cap to re-establish said sealing relation with said opening of the selected collapsible plastic container by hinged movement of the lid portion in a second direction opposed to said first direction about said hinge means;

h) mechanically translating said selected collapsible plastic container to a predetermined magazine loading station; and, i) at said magazine loading station, mechanically loading said selected collapsible plastic container into said magazine clip means so as to hold said selected collapsible plastic container within said clip means by way of frictional interaction between said non-collapsible neck portion and said magazine clip means.

2. The process of claim 1 additionally comprising, between steps a) and b) the steps of:

a1) mechanically translating said selected collapsible plastic container to a predetermined leak testing station;

a2) at said leak testing station, mechanically pressurizing said selected collapsible plastic container with a pressurized fluid; and, a3) at said leak testing station, mechanically measuring the retention of said pressurized fluid within said selected collapsible plastic container over a predetermined period of time and comparing the retention value so obtained for said selected collapsible plastic container with a predetermined threshold retention value.

3. The process of claim 2 additionally comprising, after step a3), but before step I), the further step of:

a4) mechanically ejecting from the process each selected collapsible plastic container having a retention value obtained under step a3) less than the predetermined threshold value.

4. The process of claim 2 additionally comprising, after step a3), but before step b), the further steps of:

a5) mechanically translating said selected collapsible plastic container to a predetermined labelling station;

a6) at said labelling station, mechanically pressurizing said selected collapsible plastic container with a fluid so as to cause the collapsible body portion to become distended; and, a7) at said labelling station, mechanically applying a self-adhesive label to said body portion when so distended.

5. The process of claim 1 additionally comprising, after step i), the step of:

j) mechanically folding the collapsible body portion of said selected collapsible plastic container held within the magazine clip about an axis transverse to the longitudinal axis of said selected container so as to shorten the effective longitudinal length of said selected container projecting from said magazine clip.

6. The process of claim 5, additionally comprising, after step i), the step of:

k) mechanically transporting said selected collapsible plastic container held within the magazine clip in a direction parallel to the longitudinal axis of said magazine clip from an initial loaded position within the magazine clip which initial loaded position is proximal to the magazine loading station, to a final loaded position within the magazine clip, which final loaded position is distal to said magazine loading station.

7. The process of claim 4, additionally comprising, after step i), the step of:

1) mechanically transporting said selected collapsible plastic container held within the magazine clip, in a direction parallel to the longitudinal axis of said magazine clip, from an initial loaded position within the magazine clip which initial loaded position is proximal to the magazine loading station, to a final loaded position within the magazine clip, which final loaded position is distal to said magazine loading station.

8. The process of claim 4 additionally comprising, after step a3), but before step g), the further step of:

a4) mechanically ejecting from the process each selected collapsible plastic container having a retention value obtained under step a3) less than the predetermined threshold value.

9. The process of claim 5 additionally comprising, after step a3), but before step g), the further step of:

a4) mechanically ejecting from the process each selected collapsible plastic container having a retention value obtained under step a3) less than the predetermined threshold value.

10. The process of claim 7 additionally comprising, after step a3), but before step g), the further step of:

a4) mechanically ejecting from the process each selected collapsible plastic container having a retention value obtained under step a3) less than the predetermined threshold value.

11. An apparatus for machine packing a plurality of collapsible plastic containers into a magazine clip means for subsequent handling of the collapsible plastic containers, each plastic container having a collapsible body portion and a non-collapsible neck portion defining an opening to the collapsible plastic container, the apparatus comprising:

a) selection means for selecting one of said plastic containers from a serially arranged row of said plurality of containers by gripping said selected collapsible plastic container about said neck portion and for transferring said selected collapsible plastic container to a transfer station;

b) translation means for receiving said selected container at said transfer station in retained relation about said neck portion and for thereafter translating said selected container, in serially indexed relation, to each of a capping station, a collapsing station and a magazine loading station;

c) capping means positioned at said capping station, for applying to the neck portion of the selected collapsible plastic container, in closed, sealing relation to said opening of the collapsible plastic container, a closure cap having a rim portion and a lid portion connected to the rim portion by a hinge means;

e) cap opening means positioned between said capping station and said collapsing station for opening the lid portion of said closure cap to break said sealing relation to said opening of the selected collapsible plastic container by hinged movement in a first direction of the lid portion about said hinge means;

f) collapsing means positioned at said collapsing station for removing a substantial portion of the volume of air from within the selected collapsible plastic container so as to cause substantial collapse of the body portion of said selected collapsible plastic container at said collapsing station;

g) cap closing means positioned at said collapsing station for closing the lid portion of said closure cap to re-establish said sealing relation with said opening of the selected collapsible plastic container by hinged movement of the lid portion in a second direction opposed to said first direction about said hinge means;

h) loading means positioned at said magazine loading station for translating said selected collapsible plastic container from said translation means into said magazine clip means so as to hold said selected collapsible plastic container within said clip means by way of frictional interaction between said non-collapsible neck portion and said magazine clip means.

12. The apparatus of claim 11, wherein said translation means comprises a carousel means adapted for accepting said selected collapsible plastic container at said transfer station as aforesaid and for translating said selected collapsible plastic container in serially indexed, rotary relation to each of said capping, collapsing and magazine stations.

13. The apparatus of claim 12, wherein said carousel means is additionally adapted to receive said selected container at said transfer station in radially axially indexed, retained relation about said neck portion.

14. The apparatus of claim 13, wherein said collapsing means removes said substantial portion of the volume of air from within the selected collapsible plastic container by evacuation.

15. The apparatus of claim 13, wherein said collapsing means removes said substantial portion of the volume of air from within the selected collapsible plastic container by physical compression of the collapsible body portion of said container.

16. The apparatus of claim 13, wherein said collapsing means removes said substantial portion of the volume of air from within the selected collapsible plastic container by evacuation and by physical compression of the collapsible body portion of said container.

17. The apparatus of claim 16, wherein said carousel means additionally translates said selected container in serially indexed rotary relation, to each of a leak testing station, said capping station, said collapsing station and said magazine loading station and wherein said apparatus additionally comprises, at said leak testing station, a first pressurizing means for pressurizing said selected collapsible plastic container with a fluid and a leak testing means for measuring the retention of said pressurized fluid within said selected collapsible plastic container over a predetermined period of time and for comparing the retention value so obtained for said selected collapsible plastic container with a predetermined threshold retention value so as to permit identification of said selected container as a leaking container if said retention value is less than said threshold value.

18. The apparatus of claim 17, wherein ejection means are provided for ejecting each said selected collapsible plastic container identified as a leaking container from said carousel means.

19. The apparatus of claim 17, wherein said carousel means additionally translates said selected container in serially indexed rotary relation, to each of a leak testing station, a labelling station, said capping station, said collapsing station and said magazine loading station, and wherein said apparatus additionally comprises, at said labelling station, a second pressurizing means for pressurizing said selected collapsible plastic container with a fluid so as to cause the collapsible body portion to become distended, and a label applicator means for applying an adhesive label to the body portion when so distended.

20. The apparatus of claim 19, wherein said carousel means additionally translates said selected container in serially indexed rotary relation, to each of said leak testing station, said labelling station, said capping station, said collapsing station and said magazine loading station, and wherein said apparatus additionally comprises, at said labelling station, a second pressurizing means for pressurizing said selected collapsible plastic container with a fluid so as to cause the collapsible body portion to become distended, and a label applicator means for applying an adhesive label to the body portion when so distended.

21. The apparatus of claim 20, wherein a container folding means is provided adjacent said magazine loading station for folding the collapsible body portion of said selected collapsible plastic container held within the magazine clip means about an axis transverse to the longitudinal axis of said selected container so as to shorten the effective longitudinal length of said selected container projecting from said magazine clip means.

22. The apparatus of claim 20, wherein a transport means is provided adjacent said magazine loading station for transporting the selected collapsible plastic container held within the magazine clip means, in a direction parallel to the longitudinal axis of said magazine clip means, from an initial loaded position within the magazine clip means, which initial loaded position is proximally adjacent to the magazine loading station, to a final loaded position for said selected collapsible plastic container, which final loaded position is distally spaced from said magazine loading station.

23. The apparatus as set forth in claim 11, wherein said selection means comprises a plunger member adapted to grippingly engage an inner portion of said collapsible plastic container, means for raising and lowering said plunger member into and out of gripping engagement with said container and means for translating said plastic container from a predetermined position to said transfer station.

24. The apparatus as set forth in claim 17, additionally comprising an axial orientation means.

25. The apparatus as set forth in claim 17, additionally comprising means associated with said capping means for providing selectively orientated closure caps thereto.

* * * * *